US011882930B2

(12) United States Patent
Choi

(10) Patent No.: US 11,882,930 B2
(45) **Date of Patent: *Jan. 30, 2024**

(54) FOLDABLE FRAME AND TABLE HAVING SAME

(71) Applicant: Inno-Sports Co., Ltd., Xiamen (CN)

(72) Inventor: Kwan Jun Choi, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/847,840

(22) Filed: Jun. 23, 2022

(65) Prior Publication Data

US 2022/0312951 A1 Oct. 6, 2022

Related U.S. Application Data

(63) Continuation-in-part of application No. 17/583,037, filed on Jan. 24, 2022.

(30) Foreign Application Priority Data

| | | |
|---|---|---|
| Feb. 4, 2021 | (CN) | 202110155525.2 |
| Feb. 4, 2021 | (CN) | 202120325447.1 |
| Feb. 4, 2021 | (CN) | 202120325449.0 |
| Feb. 4, 2021 | (CN) | 202120344817.6 |
| Mar. 16, 2021 | (CN) | 202120545898.6 |
| May 7, 2021 | (CN) | 202120962684.9 |
| Jul. 2, 2021 | (CN) | 202121504966.0 |

(51) Int. Cl.
*A47B 3/091* (2006.01)
*A47B 3/087* (2006.01)

(52) U.S. Cl.
CPC ..... *A47B 3/0913* (2013.01); *A47B 3/087* (2013.01)

(58) Field of Classification Search
CPC ..... A47B 3/087; A47B 3/0913; A47B 2003/0827
See application file for complete search history.

(56) References Cited

U.S. PATENT DOCUMENTS

| | | | |
|---|---|---|---|
| 1,063,642 | A | 6/1913 | Birdsell |
| 2,136,569 | A | 11/1938 | Trimpi |
| 2,803,033 | A | 8/1957 | Rachman |
| 2,803,050 | A | 8/1957 | Birger |
| 2,868,599 | A | 1/1959 | Roggio |
| 3,075,809 | A | 1/1963 | Wilson |

(Continued)

FOREIGN PATENT DOCUMENTS

| | | | |
|---|---|---|---|
| CA | 2971886 | A1 | 12/2018 |
| DE | 4321853 | A1 | 1/1995 |

(Continued)

*Primary Examiner* — Matthew W Ing
(74) *Attorney, Agent, or Firm* — MORGAN, LEWIS & BOCKIUS LLP

(57) ABSTRACT

A table includes a tabletop and a frame supporting the tabletop. The frame includes a mounting assembly, first and second leg assemblies coupled with the mounting assembly, and first and second supporting assemblies to control rotation of the first and second leg assemblies. The frame also includes one or more couplers disposed at a mounting member of the mounting assembly to connect the mounting assembly with the first and second supporting assemblies or to connect the mounting assembly with the tabletop.

19 Claims, 42 Drawing Sheets

(56) References Cited

U.S. PATENT DOCUMENTS

| | | | | |
|---|---|---|---|---|
| 3,187,373 | A | 6/1965 | Fisher | |
| 3,368,504 | A | 2/1968 | Cohen | |
| 3,410,232 | A | 11/1968 | Bills | |
| 3,410,327 | A | 11/1968 | Ausnit | |
| 3,861,328 | A | 1/1975 | Lawless | |
| 4,191,111 | A | 3/1980 | Emmert | |
| 4,285,105 | A | 8/1981 | Kirkpatrick | |
| 4,561,108 | A | 12/1985 | Kamp | |
| 4,792,240 | A | 12/1988 | Ausnit | |
| 5,325,794 | A | 7/1994 | Hontani | |
| 5,483,710 | A | 1/1996 | Chan | |
| 5,745,954 | A | 5/1998 | Shogan | |
| 5,857,229 | A | 1/1999 | Magnani, Jr. | |
| 5,921,623 | A | 7/1999 | Nye | |
| 6,192,809 | B1 * | 2/2001 | Riach | A47B 3/087 108/115 |
| 6,223,366 | B1 | 5/2001 | Cheng | |
| 6,347,831 | B1 | 2/2002 | Nye | |
| 6,363,550 | B1 | 4/2002 | Wang | |
| 6,508,262 | B1 | 1/2003 | Takayama | |
| 6,644,734 | B1 | 11/2003 | Tseng | |
| 6,843,183 | B2 | 1/2005 | Strong | |
| 6,971,321 | B1 | 12/2005 | Strong | |
| 7,059,254 | B2 | 6/2006 | Strong et al. | |
| 7,096,799 | B2 | 8/2006 | Strong et al. | |
| 7,097,380 | B2 | 8/2006 | Lee | |
| 7,171,910 | B2 | 2/2007 | Neunzert et al. | |
| 7,260,871 | B2 | 8/2007 | Borchardt | |
| 7,428,872 | B2 | 9/2008 | Strong et al. | |
| 7,475,643 | B2 | 1/2009 | Haney et al. | |
| 7,475,644 | B2 | 1/2009 | Strong et al. | |
| 7,634,969 | B2 | 12/2009 | Neunzert et al. | |
| 7,640,870 | B2 | 1/2010 | Strong et al. | |
| 7,644,667 | B2 | 1/2010 | Strong et al. | |
| 7,735,431 | B2 | 6/2010 | Neunzert et al. | |
| 7,874,303 | B2 | 1/2011 | Xie | |
| 8,006,630 | B2 | 8/2011 | Strong et al. | |
| 8,033,228 | B2 | 10/2011 | Haney et al. | |
| 8,042,475 | B2 | 10/2011 | Larcom et al. | |
| 8,113,130 | B2 | 2/2012 | Leng | |
| 8,132,517 | B2 | 3/2012 | Leng | |
| 8,156,875 | B2 | 4/2012 | Neunzert et al. | |
| 8,302,541 | B2 | 11/2012 | Haney et al. | |
| 8,342,107 | B2 | 1/2013 | Mover et al. | |
| 8,534,205 | B1 | 9/2013 | Johnson et al. | |
| 8,578,865 | B2 | 11/2013 | Haney et al. | |
| 8,622,007 | B2 | 1/2014 | Peery et al. | |
| 8,746,155 | B2 | 6/2014 | Haney et al. | |
| 8,757,069 | B2 | 6/2014 | Peery et al. | |
| 8,904,943 | B2 | 12/2014 | Jin | |
| 9,027,952 | B2 | 5/2015 | Zhu | |
| 9,103,368 | B2 | 8/2015 | Mendes | |
| D748,418 | S | 2/2016 | Johnson et al. | |
| 9,277,808 | B2 | 3/2016 | Cai et al. | |
| 9,282,812 | B2 | 3/2016 | Chang | |
| D756,694 | S | 5/2016 | Johnson et al. | |
| 9,351,563 | B2 | 5/2016 | Bennett et al. | |
| 10,159,334 | B1 | 12/2018 | Wang | |
| 10,470,561 | B2 | 11/2019 | Clegg et al. | |
| 10,806,246 | B1 * | 10/2020 | Chen | A47B 3/0815 |
| 2003/0089286 | A1 | 5/2003 | Wang | |
| 2004/0070235 | A1 | 4/2004 | Gregory | |
| 2004/0187749 | A1 | 9/2004 | Zhurong | |
| 2004/0195869 | A1 | 10/2004 | Zhurong | |
| 2005/0005826 | A1 | 1/2005 | Strong | |
| 2005/0097829 | A1 | 5/2005 | Seo | |
| 2005/0241550 | A1 | 11/2005 | Neunzert | |
| 2005/0279260 | A1 | 12/2005 | Stanford | |
| 2006/0062632 | A1 | 3/2006 | Jang | |
| 2006/0181114 | A1 | 8/2006 | Nye | |
| 2006/0196395 | A1 | 9/2006 | Lin | |
| 2007/0079441 | A1 | 4/2007 | Chen | |
| 2008/0078310 | A1 | 4/2008 | VanNimwegen | |
| 2009/0293779 | A1 * | 12/2009 | Leng | A47B 3/0913 108/132 |
| 2013/0000528 | A1 | 1/2013 | Jin | |
| 2013/0025509 | A1 | 1/2013 | Jin | |
| 2013/0233210 | A1 | 9/2013 | Jin | |
| 2014/0030012 | A1 | 1/2014 | Lee | |
| 2014/0070070 | A1 | 3/2014 | Shinoda | |
| 2014/0099155 | A1 | 4/2014 | Chen | |
| 2014/0130837 | A1 | 5/2014 | Sy-Facunda | |
| 2016/0348395 | A1 | 12/2016 | Jin | |
| 2017/0013955 | A1 | 1/2017 | Lin | |
| 2017/0340100 | A1 | 11/2017 | Tsai | |
| 2018/0153302 | A1 | 6/2018 | Jiang | |
| 2019/0150608 | A1 | 5/2019 | Johnson et al. | |
| 2019/0284831 | A1 | 9/2019 | Volin | |
| 2019/0292808 | A1 | 9/2019 | Dotterweich | |
| 2020/0029684 | A1 | 1/2020 | Jiang | |
| 2021/0112968 | A1 | 4/2021 | Ponomar | |
| 2021/0177135 | A1 | 6/2021 | Leng | |
| 2021/0274929 | A1 | 9/2021 | Choi | |
| 2021/0274930 | A1 | 9/2021 | Choi | |

FOREIGN PATENT DOCUMENTS

| | | | |
|---|---|---|---|
| DE | 29515948 | U1 | 1/1996 |
| EP | 1492432 | B1 | 10/2016 |
| WO | WO 2013000149 | A1 | 1/2013 |

* cited by examiner

FOLDABLE FRAME AND TABLE HAVING SAME

CROSS-REFERENCE TO RELATED APPLICATIONS

The present application claims priority to Chinese Utility Model Application CN 202121504966.0 filed Jul. 2, 2021, and is a continuation-in-part of U.S. patent application Ser. No. 17/583,037 filed Jan. 24, 2022, which claims priority to Chinese Utility Model Applications CN 202110155525.2 filed Feb. 4, 2021, CN 202120325449.0 filed Feb. 4, 2021, CN 202120325447.1 filed Feb. 4, 2021, CN 202120344817.6 filed Feb. 4, 2021, CN 202120545898.6 filed Mar. 16, 2021, CN 202120962684.9 filed May 7, 2021. The disclosure of each application is incorporated herein for all purposes by reference in its entirety.

FIELD OF THE INVENTION

The present invention generally relates to frames and tables, and in particular to foldable frames and tables.

BACKGROUND

Foldable tables are popular because they require less storage space and are easy to carry around. An existing foldable table generally includes two panels coupled to a supporting frame having two or more foldable leg assemblies. However, many existing foldable tables lack a mechanism to control the folding and unfolding of the tables. In particular, some exiting foldable tables lack a mechanism to lock the leg assemblies when the tables are in use. Consequently, existing foldable tables may fold accidentally, and are not safe to use. In addition, many existing foldable tables suffer from uneven distribution of loads, resulting in poor stability and shortened service life.

Given the current state of the art, there remains a need for frames and tables that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present disclosure provides foldable frames and tables that are stable, convenient to use, and have long service life.

In various exemplary embodiments, the present disclosure provides a frame including a mounting assembly, first and second leg assemblies, and first and second supporting assemblies. The mounting assembly includes a first mounting member, a second mounting member and a third mounting member. Each of the first and second mounting members includes a first bar and a second bar. Proximal end portions of the first and second bars of the first mounting member are connected to or formed with each other. Proximal end portions of the first and second bars of the second mounting member are connected to or formed with each other. The third mounting member has an end portion coupled with the proximal end portions of the first bars of the first and second mounting members and another end portion coupled with the proximal end portions of the second bars of the first and second mounting members. The first leg assembly is coupled with distal end portions of the first bars of the first and second mounting members and rotatable with respect to the first bars. The second leg assembly is coupled with distal end portions of the second bars of the first and second mounting members and rotatable with respect to the second bars. The first and second supporting assemblies are configured to control rotation of the first and second leg assemblies. Each of the first and second assemblies includes a first supporting member, a slider and one or more second supporting members. The first supporting member has an end portion pivotally coupled with the third mounting member. The slider is coupled with the first supporting member and selectively movable along the first supporting member. Each of the one or more second supporting members has an end portion coupled with the slider and another end portion pivotally coupled with the first or second leg assembly.

In some exemplary embodiments, the frame further includes a coupler, a first connecting member and a second connecting member. The coupler includes a base fixedly coupled with the third mounting member and a pivoting piece connected to or formed with the base. The first connecting member is formed or coupled with the end portion of the first supporting member of the first supporting assembly and pivotally coupled with the pivoting piece of the coupler. The second connecting member is formed or coupled with the end portion of the first supporting member of the second supporting assembly and pivotally coupled with the pivoting piece of the coupler.

In some exemplary embodiments, each of the first and second connecting members includes an indent to accommodate, cross-sectional-wise, a portion of the third mounting member. The indent facilitates smooth folding and unfolding of the frame and allows the first or second connecting member to abut the third mounting member more firmly to help stabilizing the frame when the frame is in use.

In an exemplary embodiment, cross-sectional-wise, the third mounting member has a substantially rectangular or square shape, and the indent has a substantially right-angled corner shape.

In another exemplary embodiment, cross-sectional-wise, the third mounting member has a substantially circular shape, and the indent has a substantially rounded corner shape.

In some exemplary embodiments, the first and second bars of the first mounting member are pivotally coupled with each other, and the first and second bars of the second mounting member are pivotally coupled with each other. The pivoting piece of the coupler has an axis aligned with a pivoting axis along which the first and second bars of the first mounting member and the first and second bars of the second mounting member rotate.

In some exemplary embodiments, the first and second bars of the first mounting member are pivotally coupled with each other, and the first and second bars of the second mounting member are pivotally coupled with each other. The pivoting piece of the coupler is formed with a through-hole aligned with a pivoting axis along which the first and second bars of the first mounting member and the first and second bars of the second mounting member rotate. Each of the first and second connecting members includes one or more lugs, and each lug is formed with a through-hole. Each of the first and second connecting members is pivotally connected to the pivoting piece of the coupler by a fastener passing through the through-hole of the one or more lugs and the through-hole of the pivoting piece.

In an exemplary embodiment, each of the first and second connecting members includes a pair of lugs.

In some exemplary embodiments, for each of the first and second connecting members, each of the one or more lugs is formed with an indent to accommodate, cross-sectional-wise, a portion of the third mounting member. The indent facilitates smooth folding and unfolding of the frame and allows the first or second connecting member to abut the third mounting member more firmly to help stabilizing the frame when the frame is in use.

In some exemplary embodiments, the first or second leg assembly includes a first leg and a second leg. The one or more second supporting members of the first or second supporting assembly include two second supporting members, one connected to the first let and another connected to the second leg.

In some exemplary embodiments, the proximal end portions of the first and second bars of the first mounting member are pivotally coupled with each other by a first pivoting mechanism and the proximal end portions of the first and second bars of the second mounting member are pivotally coupled with each other by a second pivoting mechanism. The first or second pivoting mechanism includes first, second and third coupling pieces, and first and second rods. The first coupling piece is fixed at the proximal end of the first bar of the first or second mounting member and including a first slot elongated in a first direction. The second coupling piece is fixed at the proximal end of the second bar of the first or second mounting member and including a second slot. The second slot has a closed bottom and an open top. The second slot has a length in the first direction that is shorter than the first slot of the first coupling piece in the first direction. The third coupling piece includes a third slot having a closed bottom and a closed top. The third slot is elongated in the first direction. The first rod is disposed, cross-sectional-wise, in the third slot of the third coupling piece and movable along the third slot of the third coupling piece. The first and second coupling pieces are pivotally coupled with each other by the first rod. The second rod is integrally formed or coupled with a top portion of the third coupling piece. The second rod is disposed, cross-sectional-wise, in the first slot of the first coupling piece and movable along the first slot of the first coupling piece. When the first and second coupling pieces are aligned with each other and the open top of the second slot of the second coupling piece faces downwardly, the third coupling piece together with the second rod moves by gravity to a first position where the second rod is disposed outside of the second slot of the second coupling piece, thereby allowing the first and second coupling pieces to rotate with respect to each other around the first rod. When the first and second coupling pieces are aligned with each other and the open top of the second slot of the second coupling piece faces upwardly, the third coupling piece together with the second rod moves by gravity to a second position where the second rod is disposed in the second slot of the second coupling piece, thereby restricting the first and second coupling pieces from rotating with respect to each other around the first rod.

In some exemplary embodiments, the frame further includes a plurality of first retainers, each disposed at or adjacent to an interior side of the first or second bar of the first or second mounting member, and configured to retain the first or second leg assembly.

In some exemplary embodiments, the first and second bars of the first mounting member are pivotally coupled with each other, and the first and second bars of the second mounting member are pivotally coupled with each other. The frame further includes one or more second retainers. Each second retainer includes a first engaging member and a second engaging member. The first engaging member is disposed at a distal end portion of the first bar of the first or second mounting member. The second engaging member is disposed at a distal end portion of the second bar of the first or second mounting member. When the first and second bars of the first or second mounting member are folded onto each other, the first and second engaging members engage with each other, thereby retaining the frame in a folded position to prevent the folded frame from accidental unfolding.

In an exemplary embodiment, the one or more second retainers include two second retainers, one disposed at the first mounting member and the other disposed at the second mounting member.

In various exemplary embodiments, the present disclosure provides a frame including a mounting assembly, first and second leg assemblies, a coupler, first and second connecting members, and first and second supporting assemblies. The mounting assembly includes a first mounting member, a second mounting member and a third mounting member. Each of the first and second mounting members includes a first bar and a second bar. Proximal end portions of the first and second bars of the first mounting member are pivotally connected to each other. Proximal end portions of the first and second bars of the second mounting member are pivotally connected to each other. The third mounting member has an end portion coupled with the proximal end portions of the first bars of the first and second mounting members and another end portion coupled with the proximal end portions of the second bars of the first and second mounting members. The first leg assembly is coupled with the mounting assembly and rotatable with respect to the first bars of the first and second mounting members. The second leg assembly is coupled with the mounting assembly and rotatable with respect to the second bars of the first and second mounting members. The coupler includes a base fixedly coupled with the third mounting member and a pivoting piece connected to or formed with the base. The pivoting piece has an axis aligned with a pivoting axis along which the first and second bars of the first mounting member and the first and second bars of the second mounting member rotate. Each of the first and second connecting members is pivotally connected to the pivoting piece of the coupler. The first supporting assembly is connected to the first connecting member and the first leg assembly to control rotation of the first leg assembly with respect to the first bars of the first and second mounting members. The second supporting assembly is connected to the second connecting member and the second leg assembly to control rotation of the second leg assembly with respect to the second bars of the first and second mounting members.

In some exemplary embodiments, the frame further includes a plurality of first retainers, each disposed at or adjacent to an interior side of the first or second bar of the first or second mounting member and configured to retain the first or second leg assembly when the first or second leg assembly is folded to retain the first or second leg assembly.

In some exemplary embodiments, the flame further includes one or more second retainers. Each second retainer includes a first engaging member and a second engaging member. The first engaging member is disposed at a distal end portion of the first bar of the first or second mounting member. The second engaging member is disposed at a distal end portion of the second bar of the first or second mounting member. When the first and second bars of the first or second mounting member are folded onto each other, the first and second engaging members engage with each other, thereby retaining the frame in a folded position to prevent the folded frame from accidental unfolding.

In various exemplary embodiments, the present disclosure provides a table including a frame disclosed herein, a first panel coupled with the first bars of the first and second mounting members, and a second panel coupled with the second bars of the first and second mounting members.

The frames and tables of the present disclosure have other features and advantages that will be apparent from, or are set forth in more detail in, the accompanying drawings, which are incorporated herein, and the following Detailed Description, which together serve to explain certain principles of exemplary embodiments of the present disclosure.

BRIEF DESCRIPTION OF THE DRAWINGS

The accompanying drawings, which are incorporated into and constitute a part of this specification, illustrate one or more exemplary embodiments of the present disclosure and, together with the Detailed Description, serve to explain the principles and implementations of exemplary embodiments of the invention.

Figure 1A:
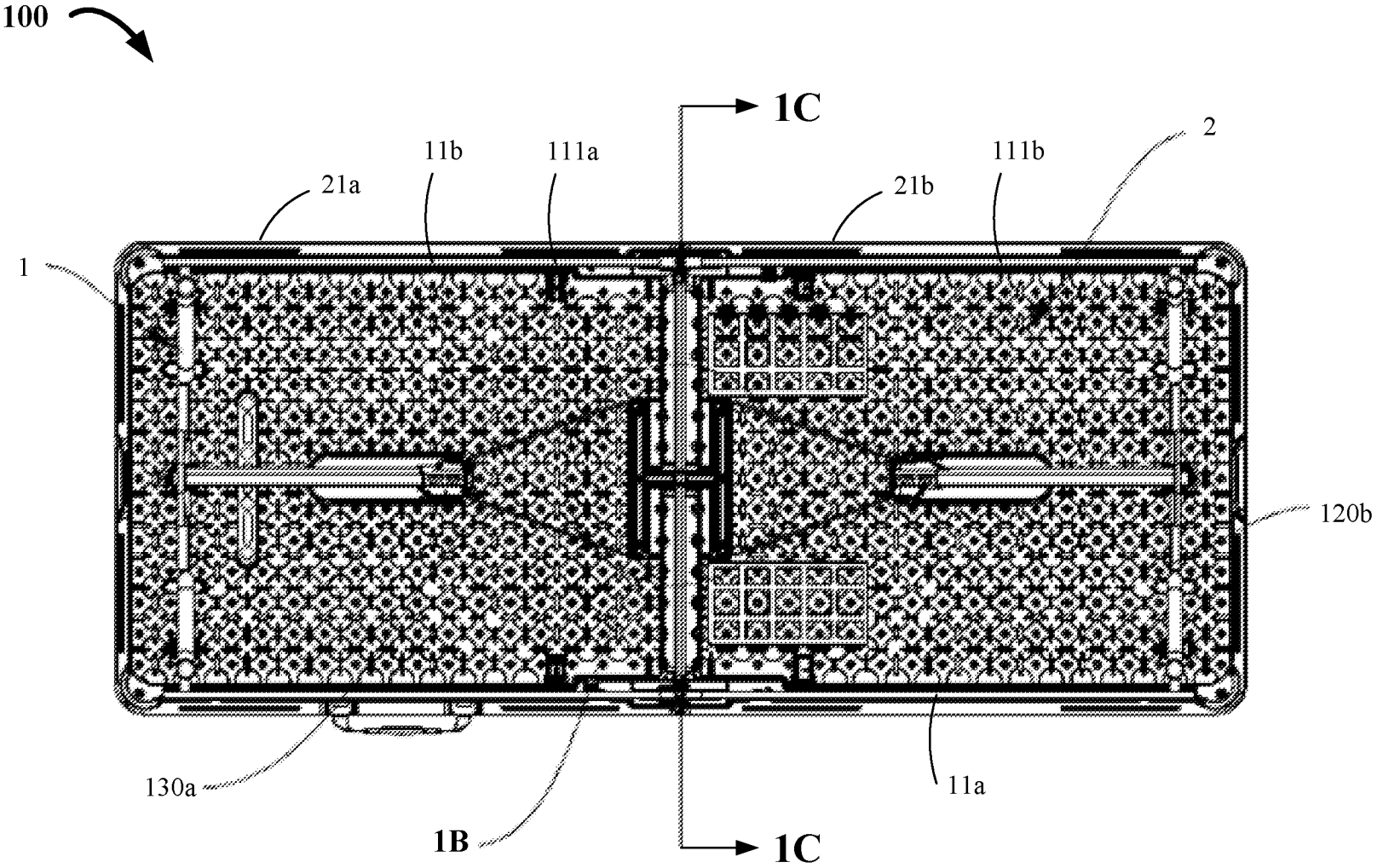
FIG. 1A is a bottom view illustrating an exemplary table in an unfolded state in accordance with exemplary embodiments of the present disclosure.

As will be apparent to those of skill in the art, the components illustrated in the figures described above are combinable in any useful number and combination. The figures are intended to be illustrative in nature and are not limiting.

DETAILED DESCRIPTION

Reference will now be made in detail to implementations of exemplary embodiments of the present disclosure as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present disclosure will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the exemplary embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present disclosure are described in the context of foldable frames and tables. A foldable frame generally includes a mounting assembly, and first and second leg assemblies coupled with the mounting assembly. A foldable frame can include one or more additional, optional or alternative components, such as couplers, retainers, pivoting mechanisms, sliding mechanisms, supporting assemblies, or any combination thereof. For instance, in some exemplary embodiments, the foldable frame includes one or more couplers disposed at a mounting member of the mounting assembly and configured to connect the mounting assembly with the first and second supporting assemblies or to connect the mounting assembly with the tabletop. In some exemplary embodiments, a foldable frame also includes a plurality of retainers to retain the first and second leg assemblies when they are folded and thus prevent accidental unfolding of the first and second leg assemblies. In some exemplary embodiments, a foldable frame includes one or more pivoting mechanisms capable of automatically and selectively locking or unlocking the mounting assembly when directed. In some exemplary embodiments, a foldable table includes one or more supporting assemblies to control rotation of the first and second leg assemblies. In some exemplary embodiments, a supporting assembly includes a sliding mechanism capable of automatically and selectively locking or unlocking the supporting assembly.

The frames and tables of the present disclosure can be of various sizes. For instance, a frame of the present disclosure can be configured for a coffee table, a dining table, or the like, and can be of a square or rectangular shape. They can be made of various materials including but not limited to metals (e.g., iron, steel, and aluminum), plastics and woods.

Referring now to FIGS. 1A-7C, there is depicted exemplary table 100 in accordance with some embodiments of the present disclosure. As shown, exemplary table 100 includes a frame, such as frame 1, and a tabletop, such as tabletop 2. The frame is coupled with the tabletop and supports the tabletop when in use. Table 100 can include additional, optional or alternative components. For instance, in some exemplary embodiments, table 100 includes a handle, such as handle 3, to facilitate carrying and moving around of the table.

Referring in particular to FIGS. 1A, 2, 3A and 4A, in some exemplary embodiments, tabletop 2 includes first table panel 21*a* and second table panel 21*b*, which can be but do not necessarily have to be identical or symmetric with respect to each other. In some exemplary embodiments, the tabletop or each of the first and second panels is a unitary piece formed by blow molding plastics such as high density polyethylene (HDPE), low density polyethylene (LDPE), polypropylene (PP), polyvinyl chloride (PVC), polyethylene terephthalate (PET), thermoplastic elastomers (TPE), or the like. The panel generally includes a first panel wall, a second panel wall and a generally hollow interior formed between the first and second panel walls. The panel can be of various regular or irregular shapes, including but not limited to a square shape, a half circular shape or a rectangular shape. The panel can have other features, such as depressions, ridges, or the like, monolithically formed with the first and/or second panel walls.

Frame 1 generally includes a mounting assembly, such as mounting assembly 110, coupled with the tabletop. Frame 1 also includes one or more leg assemblies, such as first leg assembly 120*a* and second leg assembly 120*b*, coupled with the mounting assembly 110 to support the mounting assembly and the tabletop. The first and second leg assemblies can be but do not necessarily have to be identical or symmetric with respect to each other. By way of example, the first and second leg assemblies are illustrated to be substantially the same. To enhance the strength and stability of the frame or table, in some exemplary embodiments, frame 1 includes one or more supporting assemblies, such as first supporting assembly 130*a* and second supporting assembly 130*b*, to control rotation of the one or more leg assemblies and/or to stabilize the one or more leg assemblies when the frame or table is in use. The first and second supporting assemblies can be but do not necessarily have to be identical or symmetric with respect to each other. By way of example, the first and second supporting assemblies are illustrated to be substantially the same.

Figure 3A:
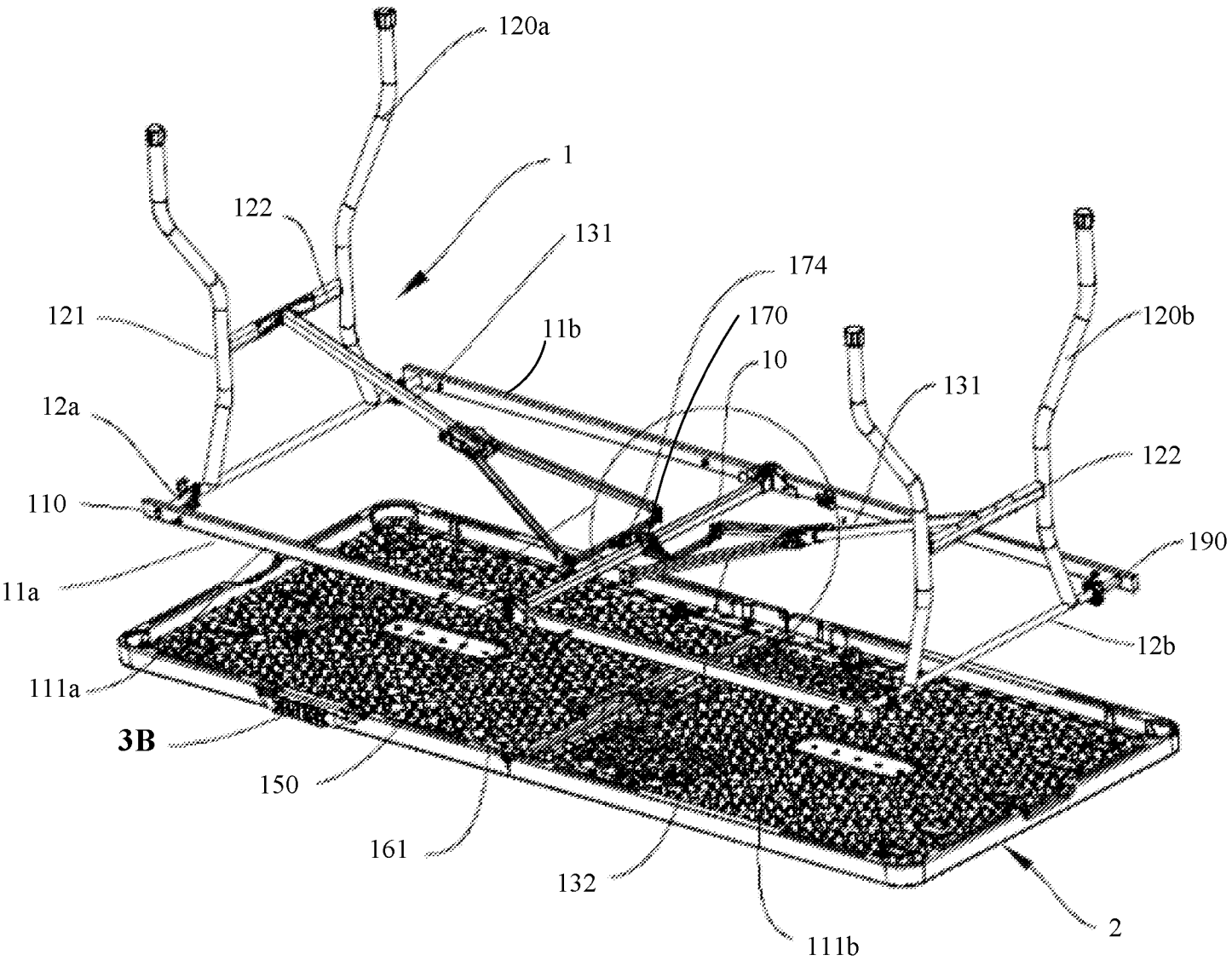
FIG. 3A is a partially disassembled perspective view illustrating the exemplary table of FIG. 1A.
Figure 5A:
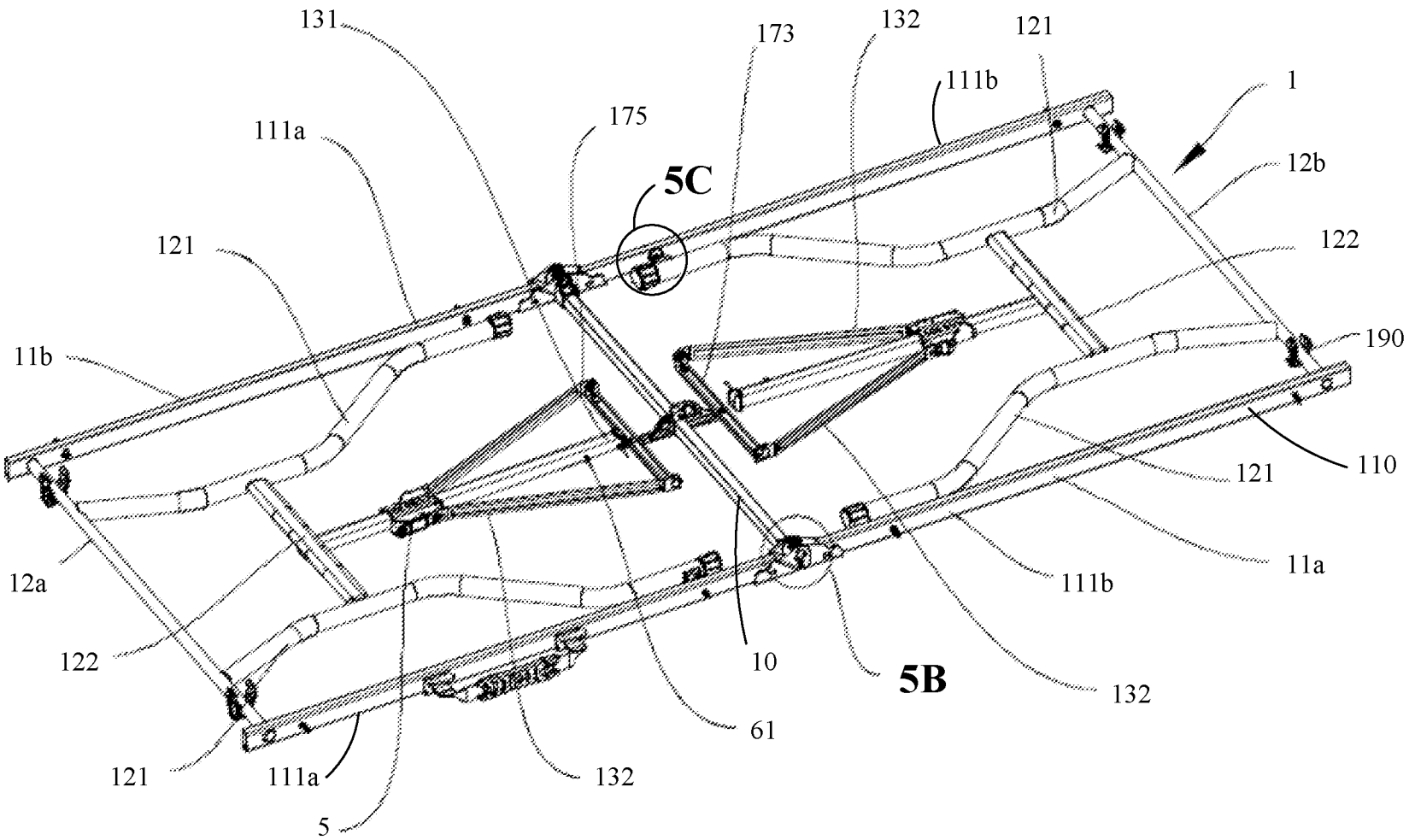
FIG. 5A is a perspective view illustrating an exemplary frame in a first state in accordance with exemplary embodiments of the present disclosure.

Referring in particular to FIGS. 1A, 3A and 5A, in some exemplary embodiments, mounting assembly 110 includes a first mounting member, such as first mounting member 11*a*, and a second mounting member, such as second mounting member 11*b*. The first mounting member is disposed at a first side of the frame. The second mounting member is disposed at a second side of the frame and substantially parallel to the first mounting member. It should be noted that the term "side" does not necessarily mean an outmost edge of a frame or an outmost edge of a table. It should also be noted that the first and second mounting members can be but do not necessarily have to be identical or symmetric with respect to each other. By way of example, FIGS. 1A, 3A and 5A illustrate that the first and second mounting members are substantially the same.

In some exemplary embodiments, each of the first and second mounting members includes a first bar, such as first bar 111*a*, and a second bar, such as second bar 111*b*. The first and second bars can be configured the same or differently, e.g., having the same or different lengths, shapes, sizes, or made of the different materials. By way of example, FIGS. 1A, 3A and 5A illustrate that the first and second bars are substantially the same.

The first and second bars of the first mounting member are connected to or formed with each other at their proximal end portions, and the first and second bars of the second mounting member are connected to or formed with each other at their proximal end portions. For instance, in an exemplary embodiment, each of the first and second bars is a bar segment of the first or second mounting member, e.g., the first or second mounting member is a single bar. In another exemplary embodiment, the first and second bars of the first or second mounting member are fixedly connected to each other or formed with each other such that the first or second first or second mounting member operates as a single bar. In still another exemplary embodiment, proximal end portions of the first and second bars of the first mounting member are pivotally connected with each other, and proximal end portions of the first and second bars of the second mounting member are pivotally connected with each other, for instance, by one or more pivoting mechanisms such as pivoting mechanism 150.

In some exemplary embodiments, mounting assembly 110 includes a first lateral bar, such as first lateral bar 12*a*, disposed at a third side of the frame and a second lateral bar, such as second lateral bar 12*b*, disposed at a fourth side of the frame. In some exemplary embodiments, each of the first and second lateral bars has a first end pivotally coupled with the first mounting member and a second end pivotally coupled with the second mounting member.

In some exemplary embodiments, mounting assembly 110 includes one or more interior lateral bars spaced apart from the first and second lateral bars, and each interior lateral bar has a first end coupled with the first mounting member and a second end coupled with the second mounting member. For instance, in some exemplary embodiments, mounting assembly 110 includes an interior lateral bar, such as third lateral bar 10, disposed in the middle of the frame. It should be noted that the term "middle" as used herein does not necessarily mean the center of the frame. The third lateral bar has an end portion coupled with the proximal end portions of the first bars of the first and second mounting members and another end portion coupled with the proximal end portions of the second bars of the first and second mounting members. In an exemplary embodiment, third lateral bar 10 has a first end portion coupled with the pivoting mechanism at the first side of the frame and a second end portion coupled with the pivoting mechanism at the second side of the frame.

Figure 5B:
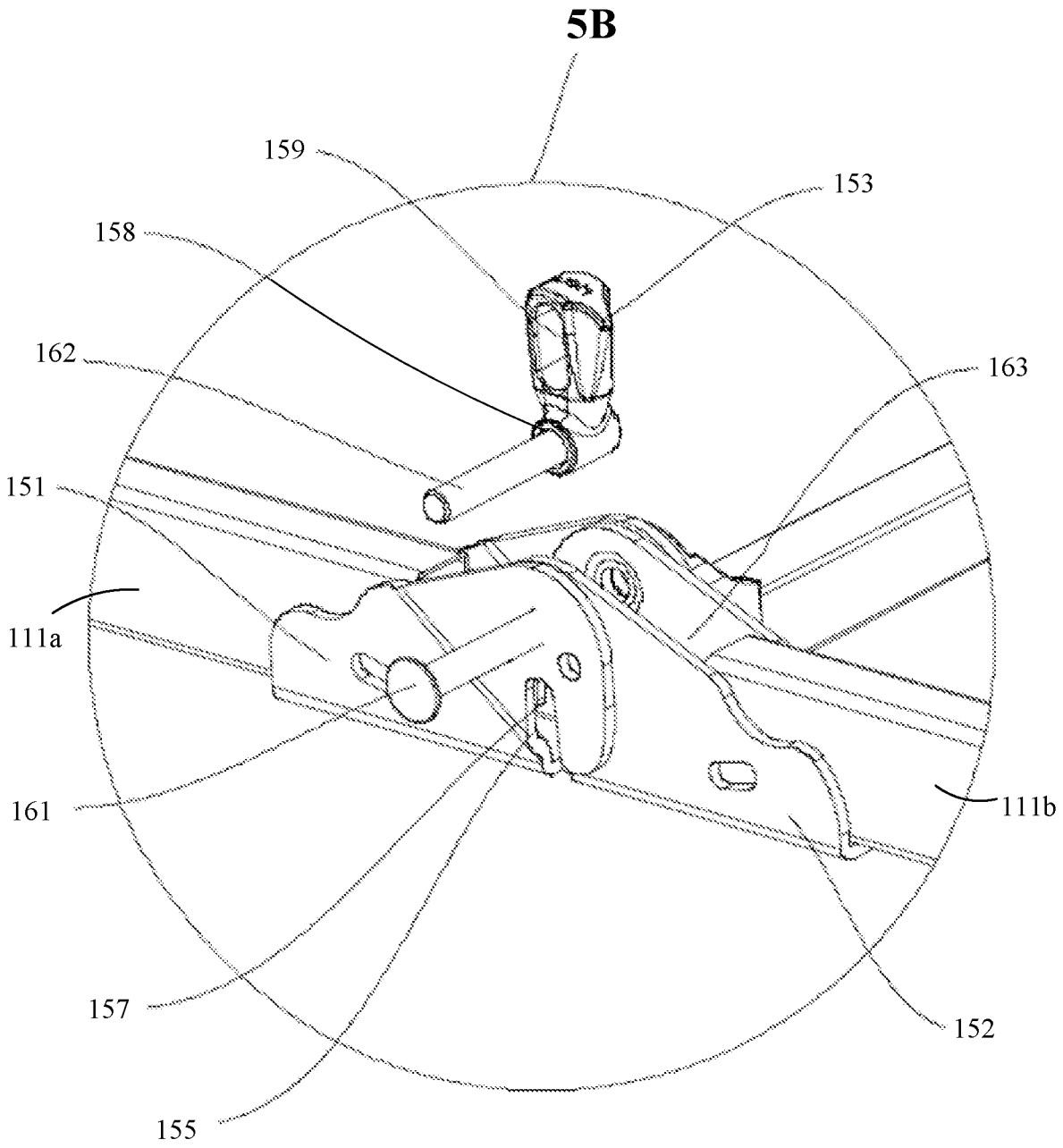
FIG. 5B is an enlarged view taken along circle 5B of FIG. 5A.
Figure 7A:
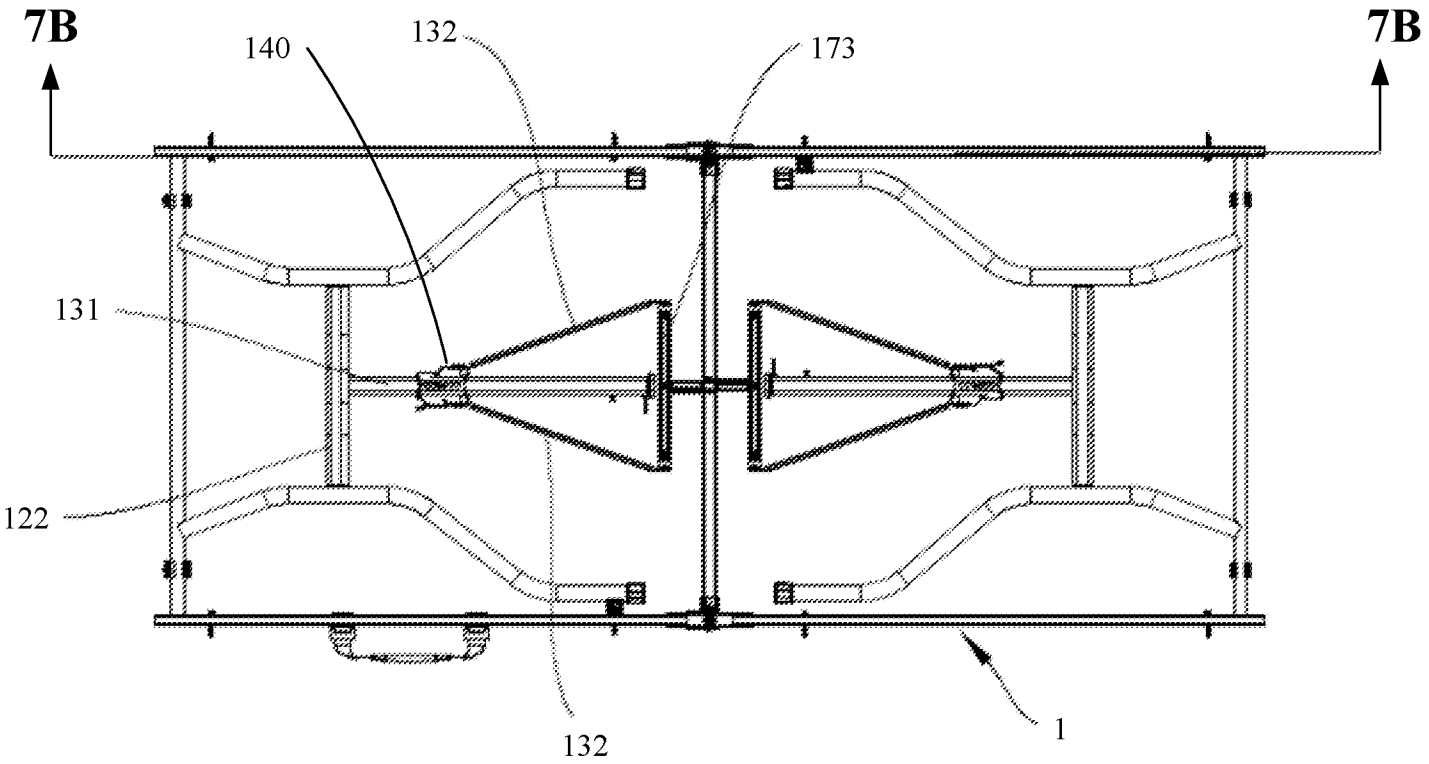
FIG. 7A is a bottom view illustrating the exemplary frame of FIG. 5A.
Figure 7B:
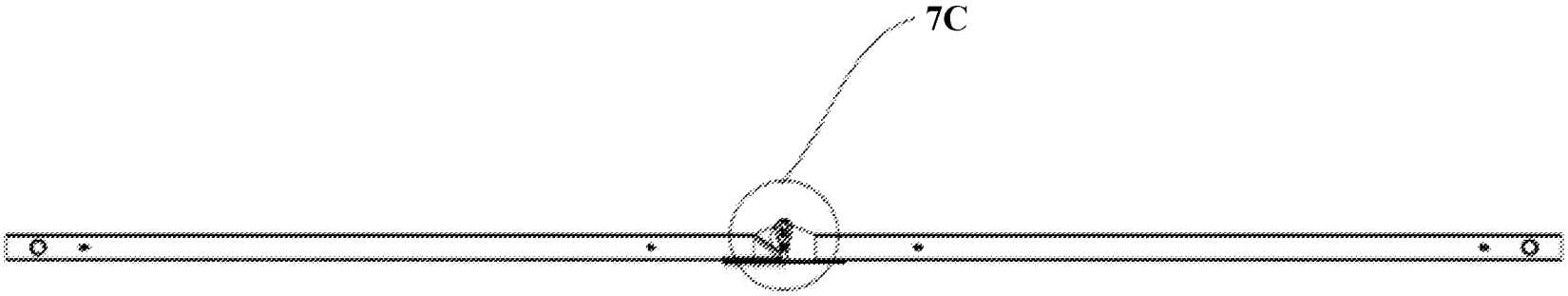
FIG. 7B is a view taken along line 7B-7B of FIG. 7A.
Figure 7C:
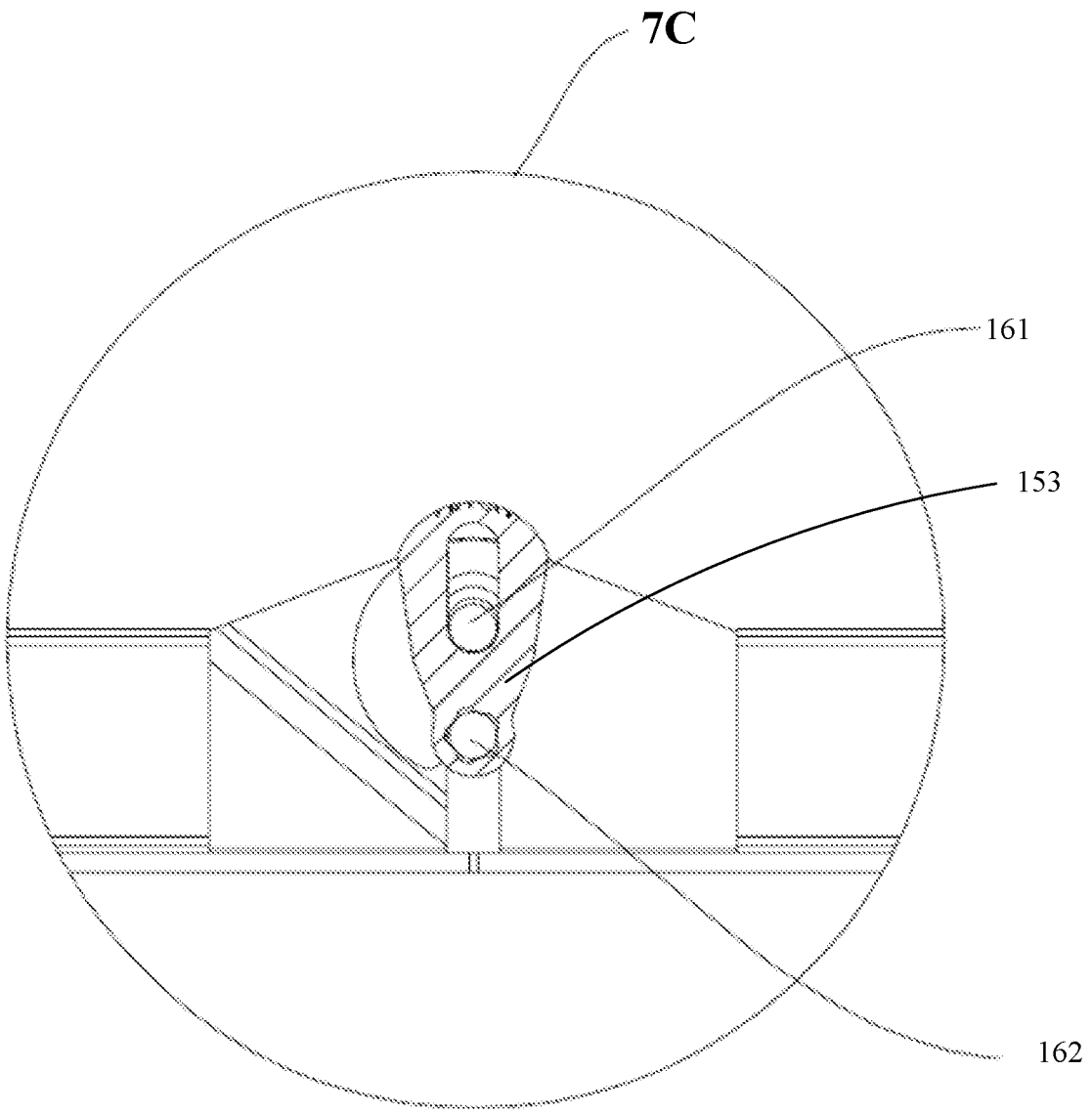
FIG. 7C is an enlarged view taken along circle 7C of FIG. 7B.

Referring in particular to FIGS. 5B and 7C, in some exemplary embodiments, pivoting mechanism 150 generally includes first and second coupling pieces configured to be fixed respectively at proximal ends of first and second bars. The pivoting mechanism also includes a rod to control the relative movement of the first and second coupling pieces. In some exemplary embodiments, the pivoting mechanism includes a third coupling piece, and two rods to control the relative movement of the first and second coupling pieces. However, the present invention is not limited to this. The pivoting mechanism can have other configurations. Examples of pivoting mechanisms are disclosed in U.S. patent application Ser. No. 16/838,939 (now U.S. Pat. No. 10,863,819 B1), U.S. patent application Ser. No. 16/839,337 (now U.S. Pat. No. 10,806,246 B2) and U.S. patent application Ser. No. 17/368,284, the disclosure of each application is incorporated herein for all purposes by reference in its entirety.

In some exemplary embodiments, pivoting mechanism 150 includes first coupling piece 151, second coupling piece 152, third coupling piece 153, first rod 161 and second rod 162. First coupling piece 151 is configured to be fixedly coupled with the first bar 111*a* at an end of the first bar, for instance, by welding, bolting or the like. Second coupling piece 152 is configured to be fixedly coupled with second bar 111*b* at an end of the second bar, for instance, by welding, bolting or the like. In some exemplary embodiments, the ends or end portions of the first and second bars are spatially separated from each other, forming a space such as space 163 in between to accommodate at least a portion of third coupling piece 153.

In some exemplary embodiments, first coupling piece 151 is formed with a slot such as slot 155. Slot 155 is elongated in a first direction, e.g., the vertical direction in FIG. 5B. Second coupling piece 152 is formed with a slot such as slot 157. Slot 157 has a closed bottom and an open top. Slot 157 of the second coupling piece is shorter than slot 155 of the first coupling piece, e.g., the slot of the second coupling piece has a length in the first direction that is shorter than the slot of the first coupling piece in the first direction. Third coupling piece 153 is formed with a slot such as slot 159. Slot 159 has a closed bottom and a closed top. Similar to the slot of the first coupling piece, the slot of the third coupling piece is elongated in the first direction.

The first, second and third coupling pieces are coupled with each other by first rod 161, for instance, by having the first rod pass through a hole formed at the first coupling piece, a hole formed at the second coupling piece, and the slot of the third coupling piece (e.g., the first rod is disposed, cross-sectional-wise, in the slot of the third coupling piece). Such a connection allows the first and second coupling pieces to rotate with respect to each other around the first rod. Such a connection also allows relative movement between the first rod and the third coupling piece, e.g., allowing the first rod to move along the elongated slot of the third coupling piece.

Second rod 162 is integrally formed or coupled with a top portion of third coupling piece 153, and movable together with the third coupling piece. For instance, in an exemplary embodiment, third coupling piece 153 is formed with a hole such as hole 158, and rod 162 is coupled with the third coupling piece by passing through the hole of the third coupling piece. In addition, the second rod is disposed, cross-sectional-wise, in the elongated slot of the first coupling piece, and thus is movable along the elongated slot of the first coupling piece.

Pivoting mechanism 150 selectively allows the first and second coupling pieces to rotate with respect to each other, and accordingly selectively allows the first and second bars to fold and unfold. For instance, when the first and second coupling pieces are aligned with each other and the open top of the second slot of the second coupling piece faces downwardly (corresponding to a table placed upside-down table), the gravity pulls down the third coupling piece together with the second rod to a first position. At the first position, second rod 162 is disposed outside of the slot of the second coupling piece. That is, the second rod is disposed only in the slot of the first coupling piece. As such, at this first position, the first and second coupling pieces are allowed to rotate with respect to each other around the first rod. Consequently, first bar 111*a* and second bar 111*b* are allowed to rotate with respect to each other, thereby allowing the table to fold. In some exemplary embodiments, at the first position, first rod 161 is disposed adjacent to the bottom of the slot of the third coupling piece.

When the first and second coupling pieces are aligned with each other and the open top of the second slot of the second coupling piece faces upwardly (corresponding to a table placed upright), the gravity again pulls down the third coupling piece together with the second rod, moving them to a second position. At the second position, second rod 162 is disposed in the slot (e.g., adjacent to the bottom of the slot) of the second coupling piece. That is, the second rod is disposed not only in the slot of the first coupling piece but also in the slot of the second coupling piece. As such, at this second position, the first and second coupling pieces are restricted from rotating with respect to each other around the first rod. Consequently, first bar 111*a* and second bar 111*b* are restricted from rotating with respect to each other, thereby preventing accidental unfolding of the table. In some exemplary embodiments, at the second position, first rod 161 is disposed adjacent to the top of the third slot of the third coupling piece.

In some exemplary embodiments, when the first and second coupling pieces are aligned with each other, slot 155 of the first coupling piece and slot 159 of the third coupling piece are aligned with each other in the first direction.

Referring in particular to FIGS. 2, 3A, 4A, and 5A, in some exemplary embodiments, first leg assembly 120*a* is coupled with distal end portions of first bars 111*a* of the first and second mounting members and rotatable with respect to first bars 111*a*. Second leg assembly 120*b* is coupled with distal end portions of second bars 111*b* of the first and second mounting members and rotatable with respect to second bars 111*b*. For instance, in some exemplary embodiments, each of the first and second leg assemblies includes two legs, such as leg 121. The upper end portions of the two legs of the first leg assembly are connected with lateral bar 12*a*, and the upper end portions of the two legs of the second leg assembly are connected with lateral bar 12*b*. Additionally or optionally, each of the first and second leg assemblies includes a leg lateral bar, such as leg lateral bar 122, disposed between the two legs and connected with the two legs.

Referring in particular to FIGS. 2, 3A, 3B, 5A, 6A, and 7A, in some embodiments, first supporting assembly 130*a* is coupled with the mounting assembly (e.g., the third lateral bar) and first leg assembly and configured to control rotation of the first leg assembly. Similarly, second supporting assembly 130*b* is coupled with the mounting assembly (e.g., the third lateral bar) and second leg assembly and configured to control rotation of the second leg assembly.

For instance, in some exemplary embodiments, the first or second supporting assembly includes a first supporting member such as first supporting member 131, a sliding mechanism such as sliding mechanism 140, and one or more second supporting members such as second supporting member 132. In some exemplary embodiments, the sliding mechanism is the same as or similar to those disposed in U.S. patent application Ser. No. 16/838,939 (now U.S. Pat. No. 10,863,819 B1), U.S. patent application Ser. No. 16/951,461, and U.S. patent application Ser. No. 17/368,284, the disclosure of each application is incorporated herein for all purposes by reference in its entirety.

One end of the first supporting member is coupled with the first or second leg assembly, for instance, pivotally coupled with leg lateral bar 122 of the first or second leg assembly. The sliding mechanism includes a slider, such as slider 5, coupled with the first supporting member and selectively movable along the first supporting member. Each second supporting member 132 (as a non-limiting example, two second supporting members are illustrated) has an end coupled with the slider of the sliding mechanism.

Figure 1B:
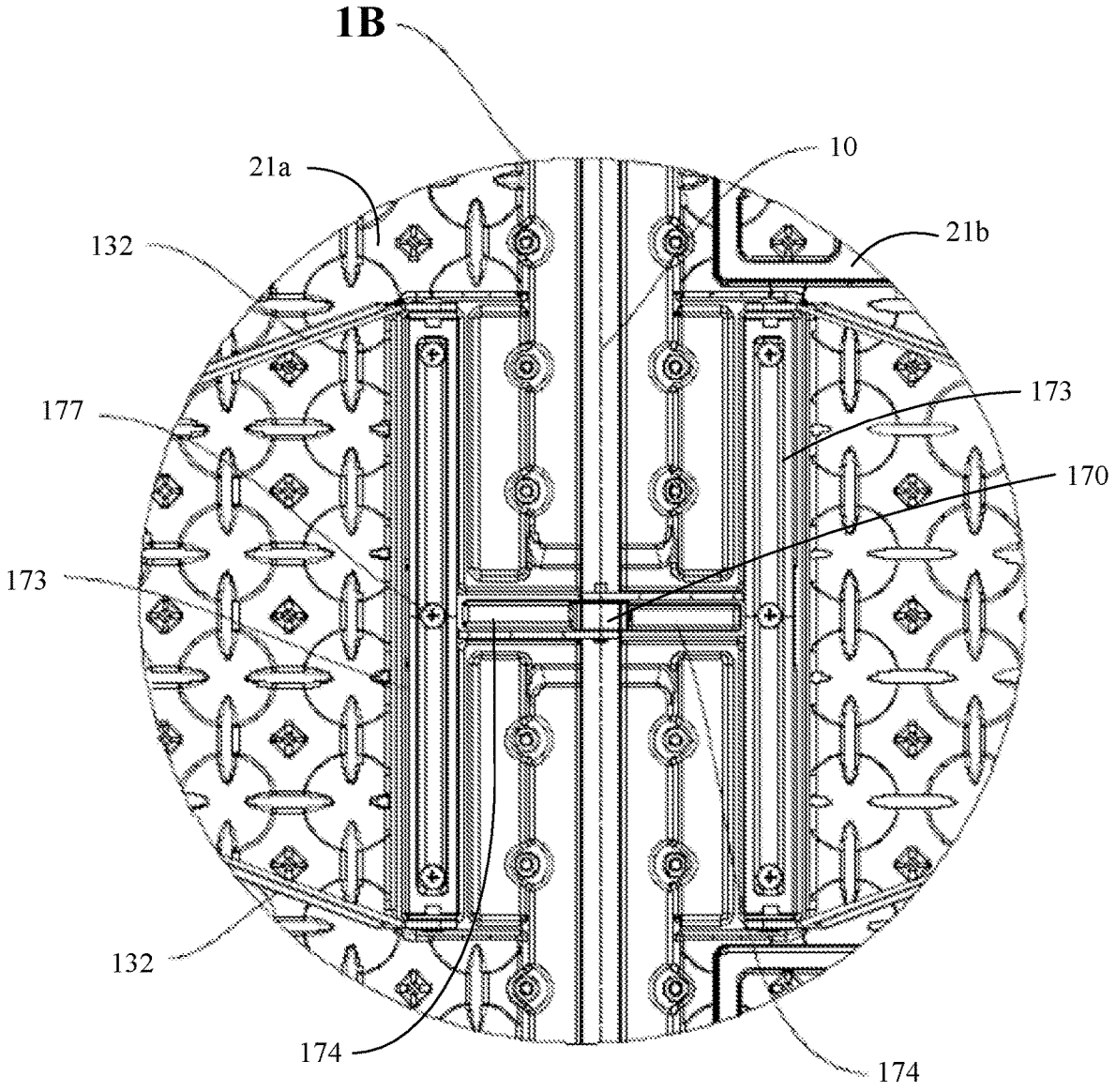
FIG. 1B is an enlarged view taken along circle 1B of FIG. 1A.
Figure 1C:
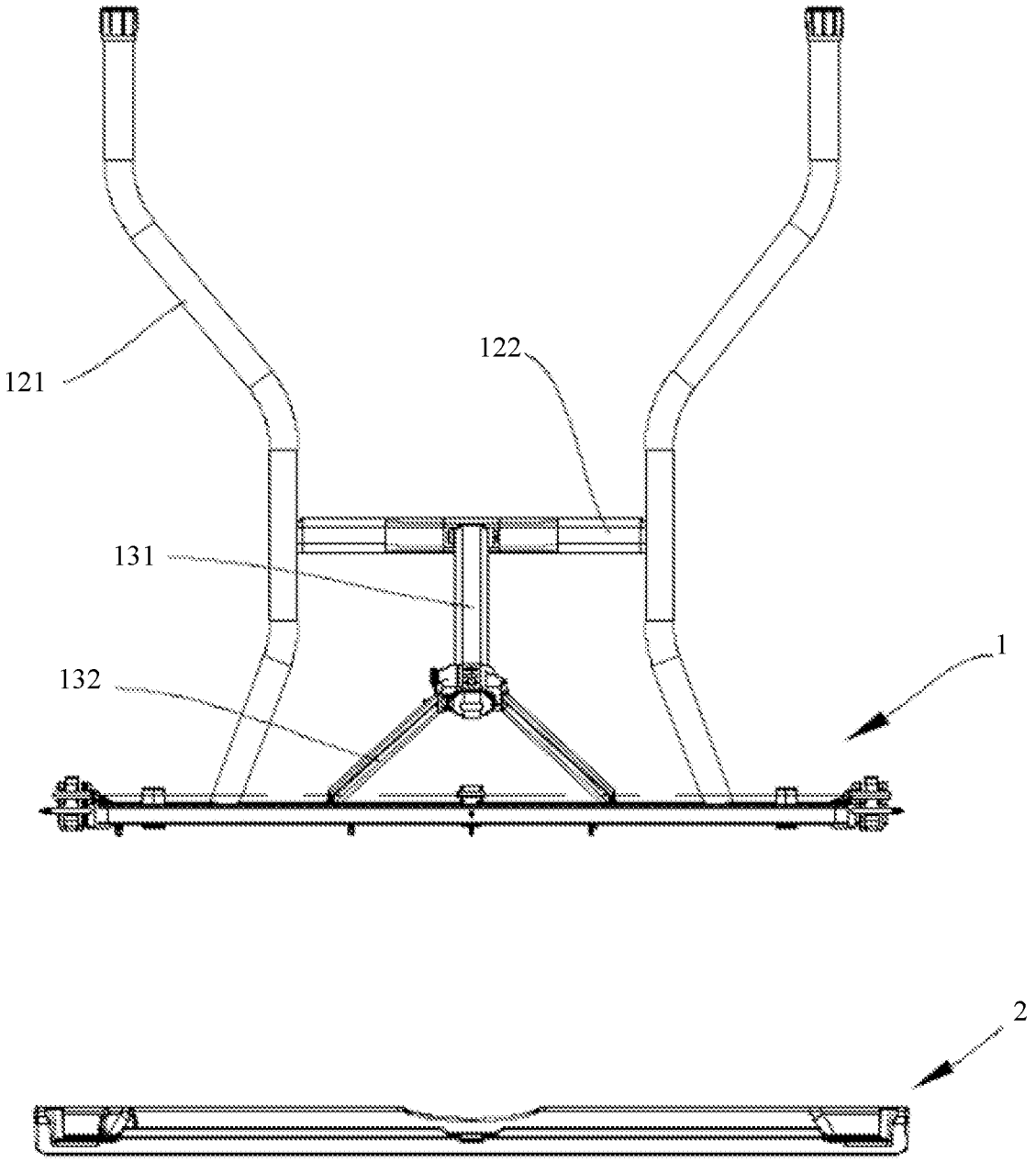
FIG. 1C is a partially disassembled view taken along line 1C-1C of FIG. 1A.
Figure 2:
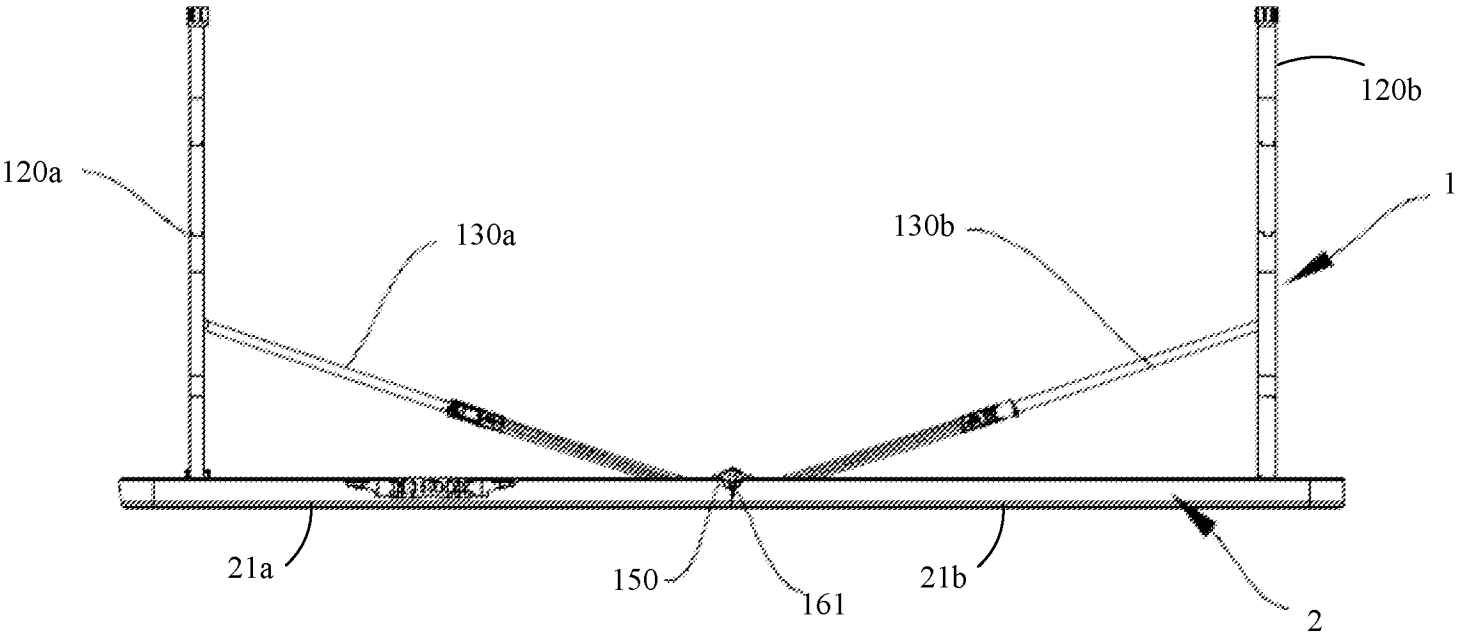
FIG. 2 is a side view illustrating the exemplary table of FIG. 1A.
Figure 3B:
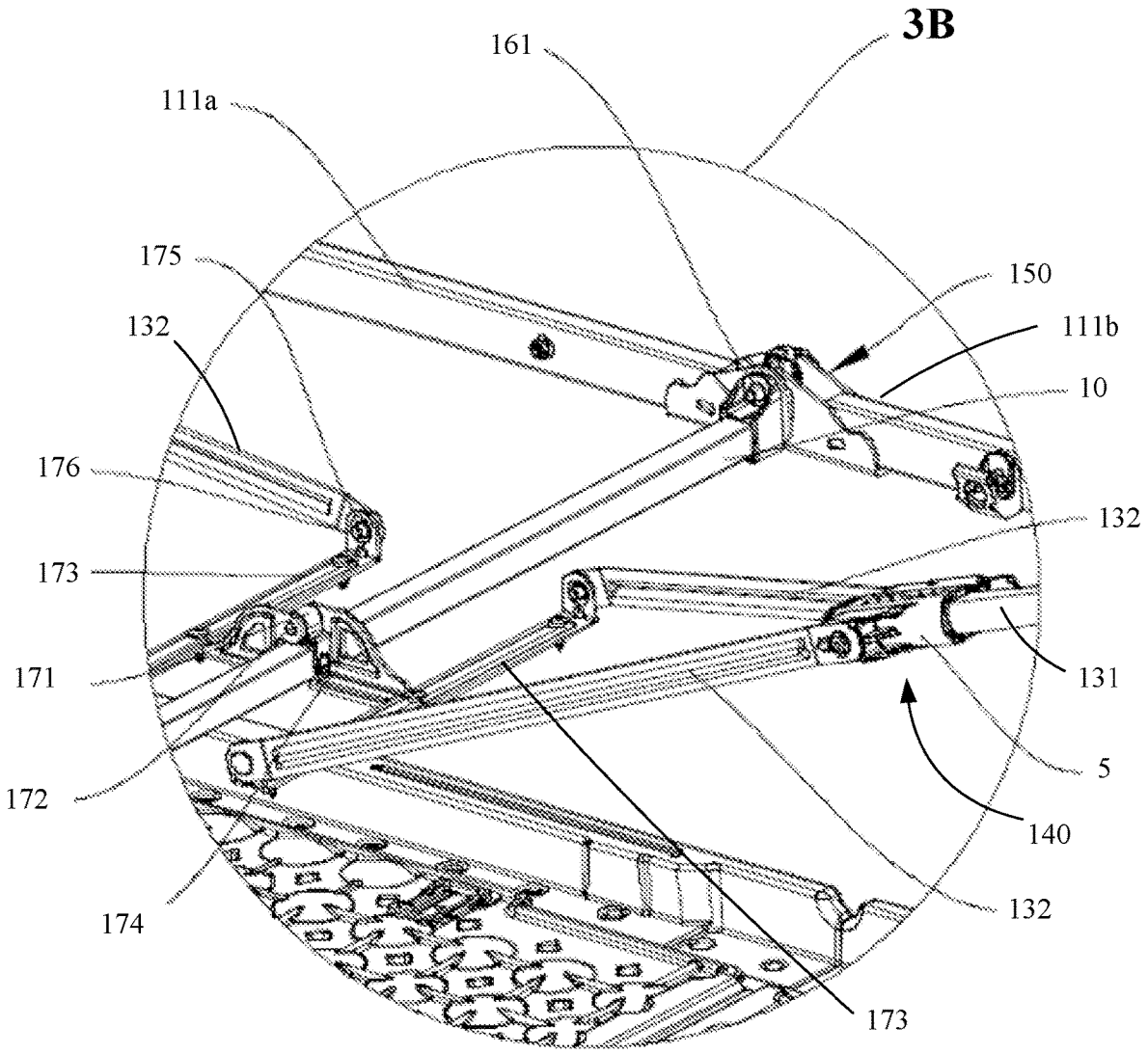
FIG. 3B is an enlarged view taken along circle 3B of FIG. 3A.

Referring in particular to FIGS. 1B, 3A and 3B, in some exemplary embodiments, frame 1 includes a first fixing member (e.g., fixing member 173 on the left side of third lateral bar 10 in FIG. 1B) and a second fixing member (e.g., fixing member 173 on the right side of third lateral bar 10 in FIG. 1B). The first fixing member is pivotally connected with another end portion of each second supporting member of the first supporting assembly, and the second fixing member is pivotally connected with another end portion of each second supporting member of the second supporting assembly. For instance, in an exemplary embodiment, fixing member 173 includes connecting portion or bended end portion 175 that is pivotally connected with second supporting member 132 by connector 176.

The first fixing member is configured to be coupled with a first portion of a tabletop and the second fixing member is configured to be coupled with a second portion of the tabletop. For instance, in an exemplary embodiment, the first fixing member is fixedly connected to first panel 21*a*, for instance, by fastener 177 or the like. Similarly, the second fixing member is fixedly connected to second panel 21*b*, for instance, by fastener 177 or the like.

In some exemplary embodiments, frame 1 includes a first connecting member (e.g., connecting member 174 on the left side of third lateral bar 10 in FIG. 1B) and a second connecting member (e.g., connecting member 174 on the right side of third lateral bar 10 in FIG. 1B). Connecting member 174 is formed or coupled with fixing member 173, preferably formed or coupled with a middle portion of the fixing member. The connecting member is also coupled with third lateral bar 10, for instance, through a coupler, such as coupler 170, disposed at the third lateral bar. As such, load to the panel(s) is more evenly distributed over the frame, making the frame and table more reliable and last longer.

In some exemplary embodiments, coupler 170 includes a base, such as base 171, and a pivoting piece, such as pivoting piece 172. Base 171 is fixedly coupled with the third bar and pivoting piece 172 is connected to or formed with the base. In an exemplary embodiment, base 171 includes a pair of lugs disposed on two sides of the third lateral bar and fixedly coupled with the third lateral bar. In an exemplary embodiment, pivoting piece 172 is a shaft, rod, or the like, connected to or formed with the base.

In some exemplary embodiments, the pivoting piece includes a first pivoting segment disposed at a first side of the base and a second pivoting segment disposed at a second side of the base. The first connecting member is pivotally coupled with the first pivoting segment and the second connecting member is pivotally coupled with the second pivoting segment. In an exemplary embodiment, the first side of the base is the side facing first mounting member 11*a*, and the second side of the base is the side facing second mounting member 11*b*. In an alternative exemplary embodiment, the first side of the base is the side facing second mounting member 11*b*, and the second side of the base is the side facing first mounting member 11*a*.

In some exemplary embodiments, pivoting piece 172 of coupler 170 is aligned with a pivoting axis along which the first and second bars of the first mounting member and the first and second bars of the second mounting member rotate. For instance, in an exemplary embodiment, first bar 111*a* and second bar 111*b* of the first or second mounting member are pivotally coupled with each other by pivoting mechanism 150, and pivoting piece 172 of coupler 170 is aligned with first rod 161 of pivoting mechanism 150 along which the first and second bars rotate. In other words, pivoting piece 172 of coupler 170 and first rod 161 of pivoting mechanism 150 are coaxially arranged or collectively form a common pivoting axis. As such, load to the panel(s) is more evenly distributed over the frame, making the frame and table more reliable and last longer.

Referring in particular to FIGS. 5A, 5C, 6A and 6B, in some exemplary embodiments, frame 1 includes a plurality of first retainers, such as retainer 180. Retainer 180 is disposed at or adjacent to an interior side of first bar 111*a* or second bar 111*b* of the first or second mounting member to retain leg 121 when the first or second leg assembly is folded. In some exemplary embodiments, retainer 180 includes a first wall such as first wall 181, a second wall such as second wall 182, and a groove such as groove 183 formed between the first and second walls. Retainer 180 can be made of plastic, steel, aluminum, or the like.

The first wall is fixedly coupled with the first or second bar of the first or second mounting member. In some exemplary embodiments, the first wall is fixedly coupled with the first or second bar by a fastener such as fastener 186. In an exemplary embodiment, the second wall is formed with a through hole, such as hole 185, to allow the fastener to pass through and fasten the first wall on the first or second bar.

Figure 5C:
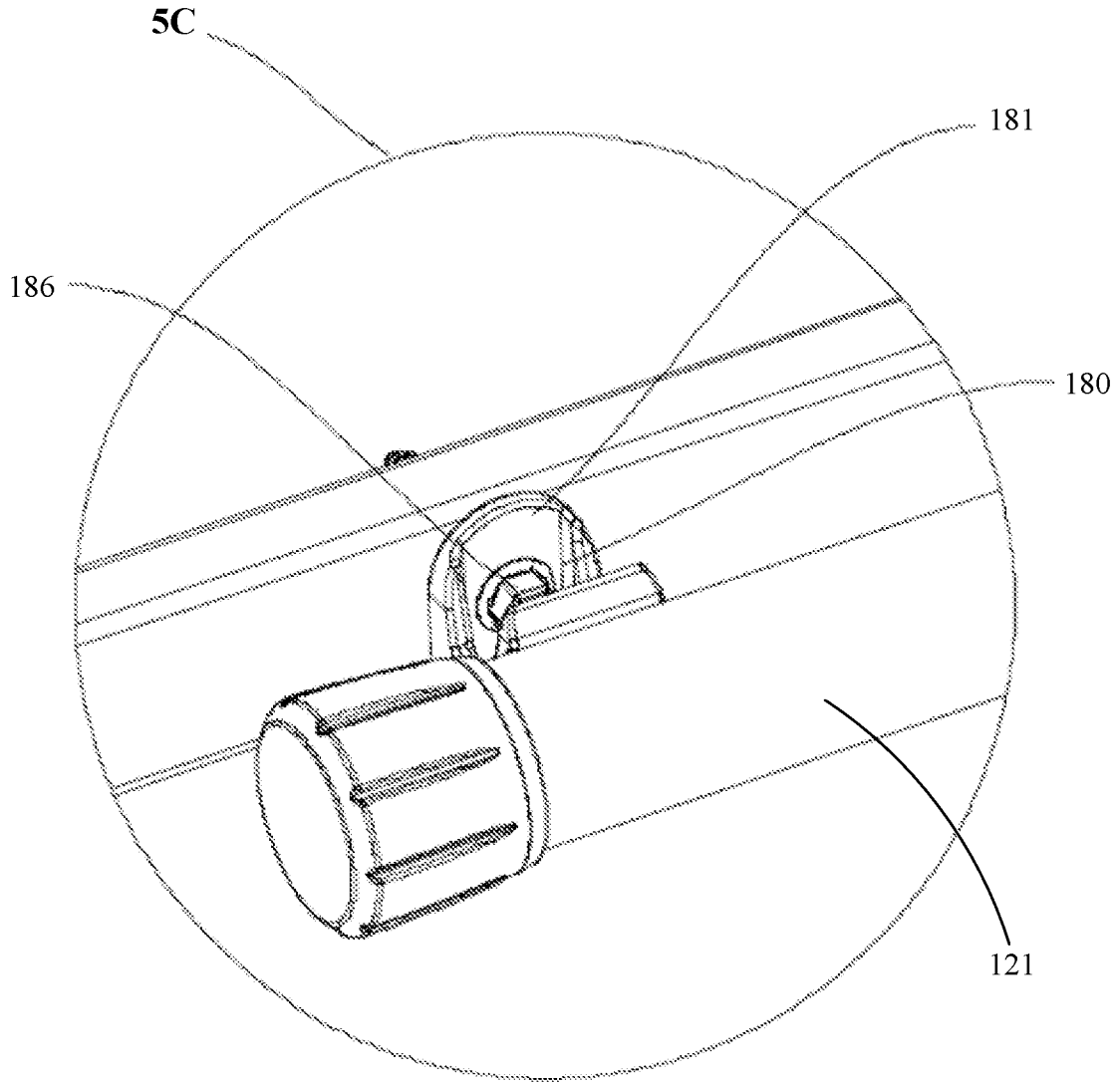
FIG. 5C is an enlarged view taken along circle 5C of FIG. 5A.
Figure 6A:
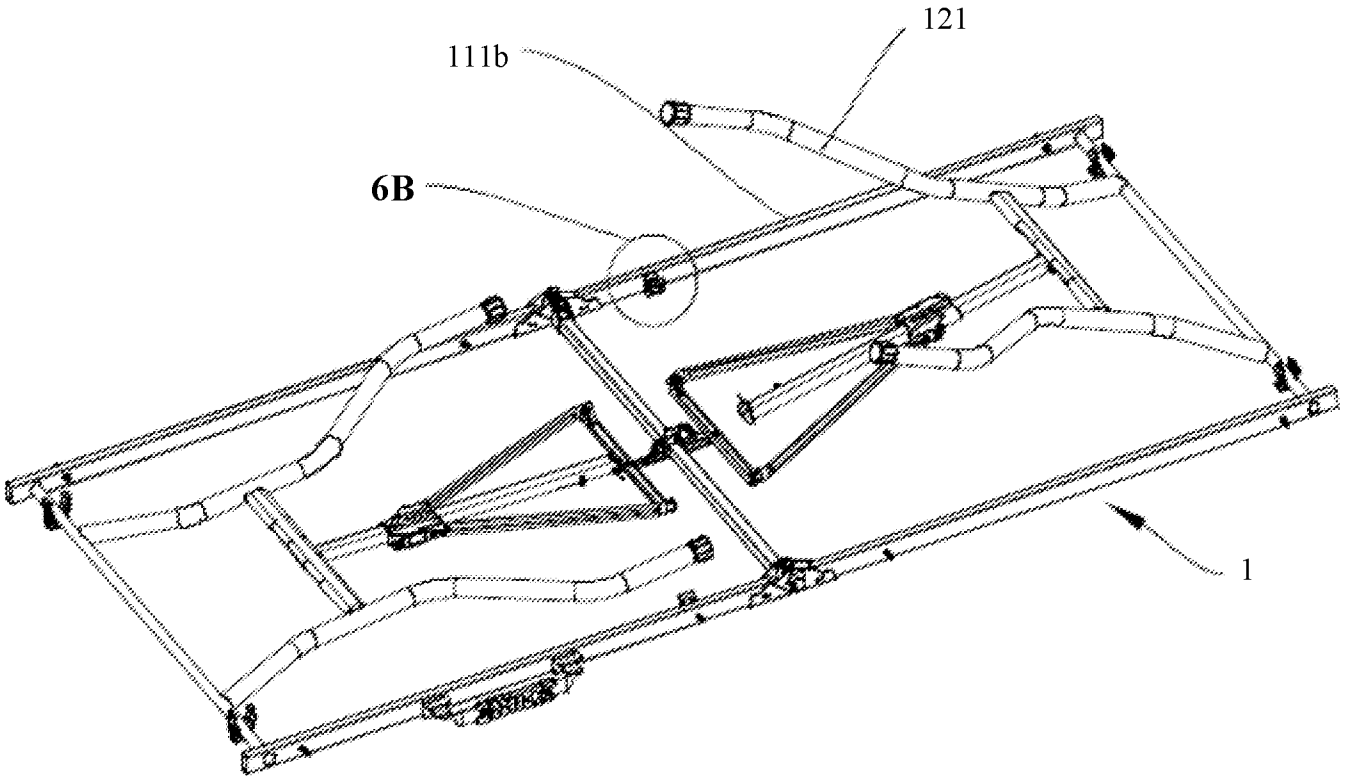
FIG. 6A is a perspective view illustrating the exemplary frame of FIG. 5A in a second state in accordance with exemplary embodiments of the present disclosure.
Figure 6B:
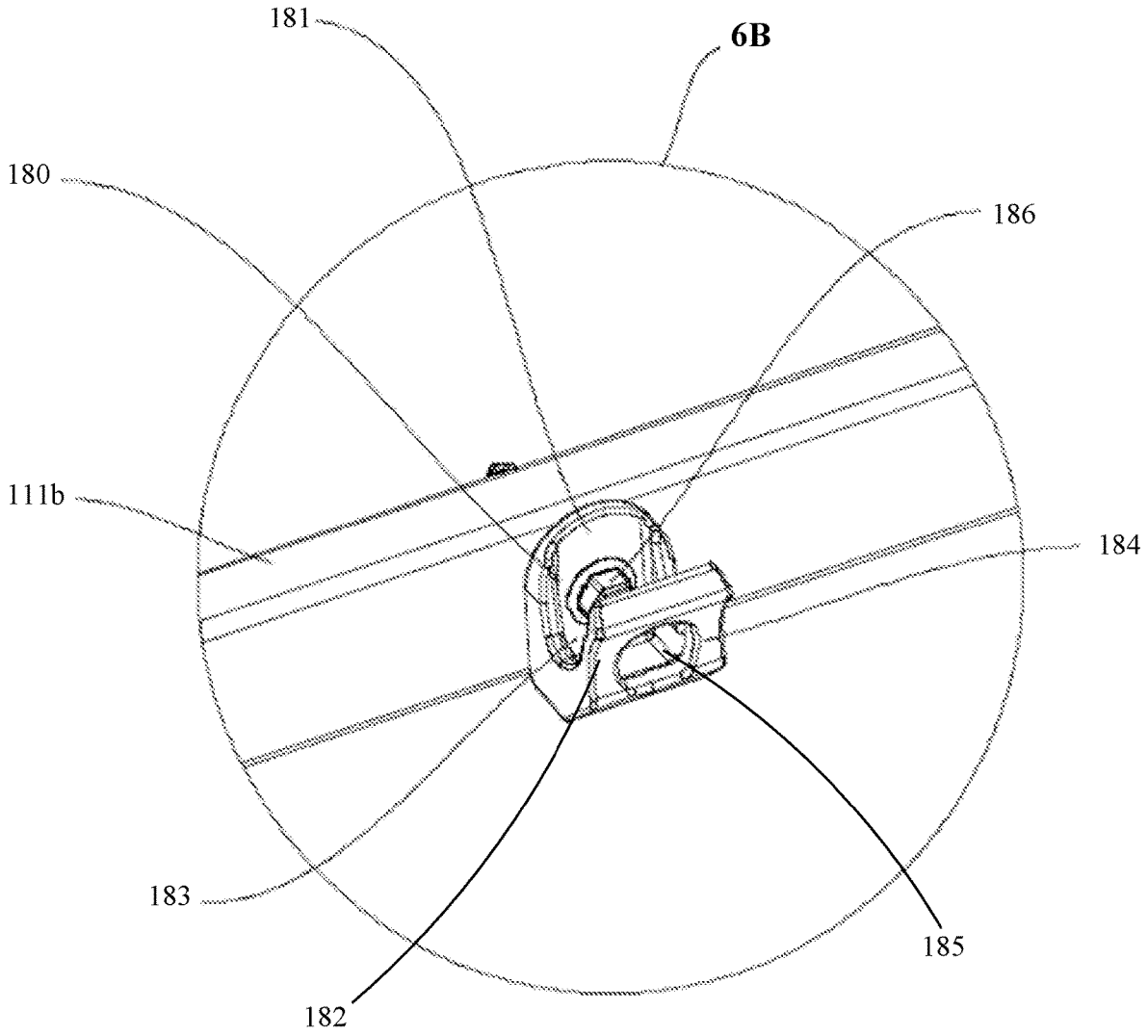
FIG. 6B is an enlarged view taken along circle 6B of FIG. 6A.

The presence of the groove provides elasticity to the second wall, e.g., allowing the second wall to tilt toward the first wall under force and return to its original position when the force is released. For instance, when pushed by leg 121 during a folding process of the first or second leg assembly, the second wall tilts toward the first wall to engage the leg. When folded, the second wall abuts the leg as illustrated in FIG. 5C, and thus retains the leg (as well as the first or second leg assembly) in the folded position. In some exemplary embodiments, an exterior surface of the second wall is formed with an indentation, such as indentation 184, to accommodate a portion of the leg and thus to better retain the leg. Preferably, the indentation is shaped in accordance with the shape of the leg, e.g., the indentation mates partially with the leg. When pushed by leg 121 during an unfolding process of the first or second leg assembly, the second wall again tilts toward the first wall to disengage the leg (e.g., release the leg so that the first or second leg assembly can be unfolded).

Figure 4A:
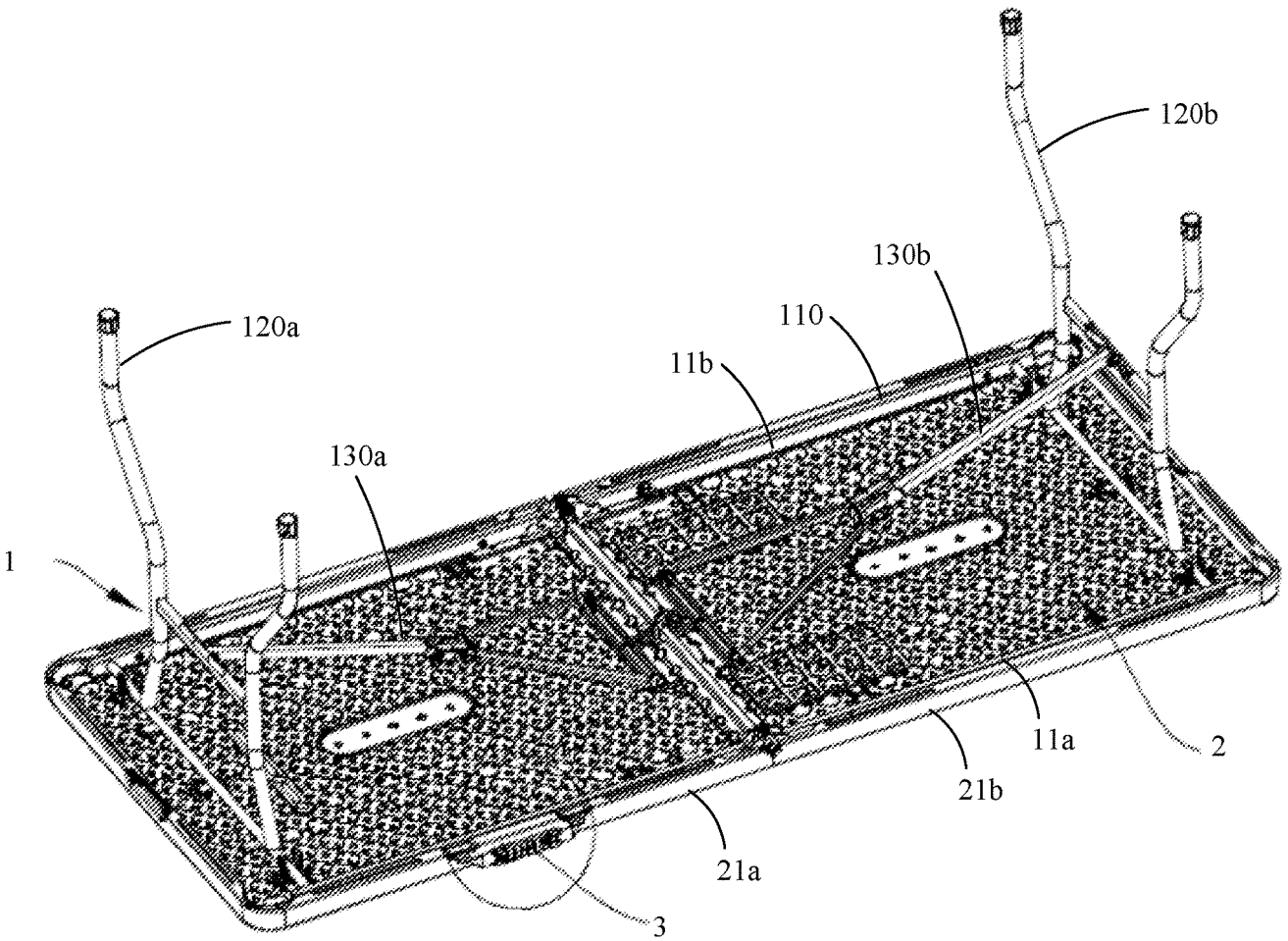
FIG. 4A is a perspective view illustrating the exemplary table of FIG. 1A.

Referring in particular to FIGS. 3A, 4A and 5A, in some embodiments, frame 1 includes a plurality of second retainers, such as retainer 190. Retainer 190 can be substantially the same as or similar to those disclosed in U.S. patent application Ser. No. 16/839,337 (now U.S. Pat. No. 10,806,246 B2), the content of which is incorporated herein for all purposes by reference in its entirety. In some exemplary embodiments, one or more retainers 190 are disposed at one side of the frame, each receiving cross-section-wise first lateral bar 12*a*, and one or more retainers 190 are disposed at the other side of the frame, each receive cross-section-wise second lateral bar 12*b*. The one or more retainers 190 at the one side help to stabilize the first lateral bar and first leg assembly, and the one or more retainers 190 at the other side help to stabilize the second lateral bar and second leg assembly. In some exemplary embodiments, when the table is folded, the one or more retainers 190 at the one side engage with the one or more retainers 190 at the other side, thereby retaining the table in the folded state and preventing accidental unfolding of the table.

Figure 4B:
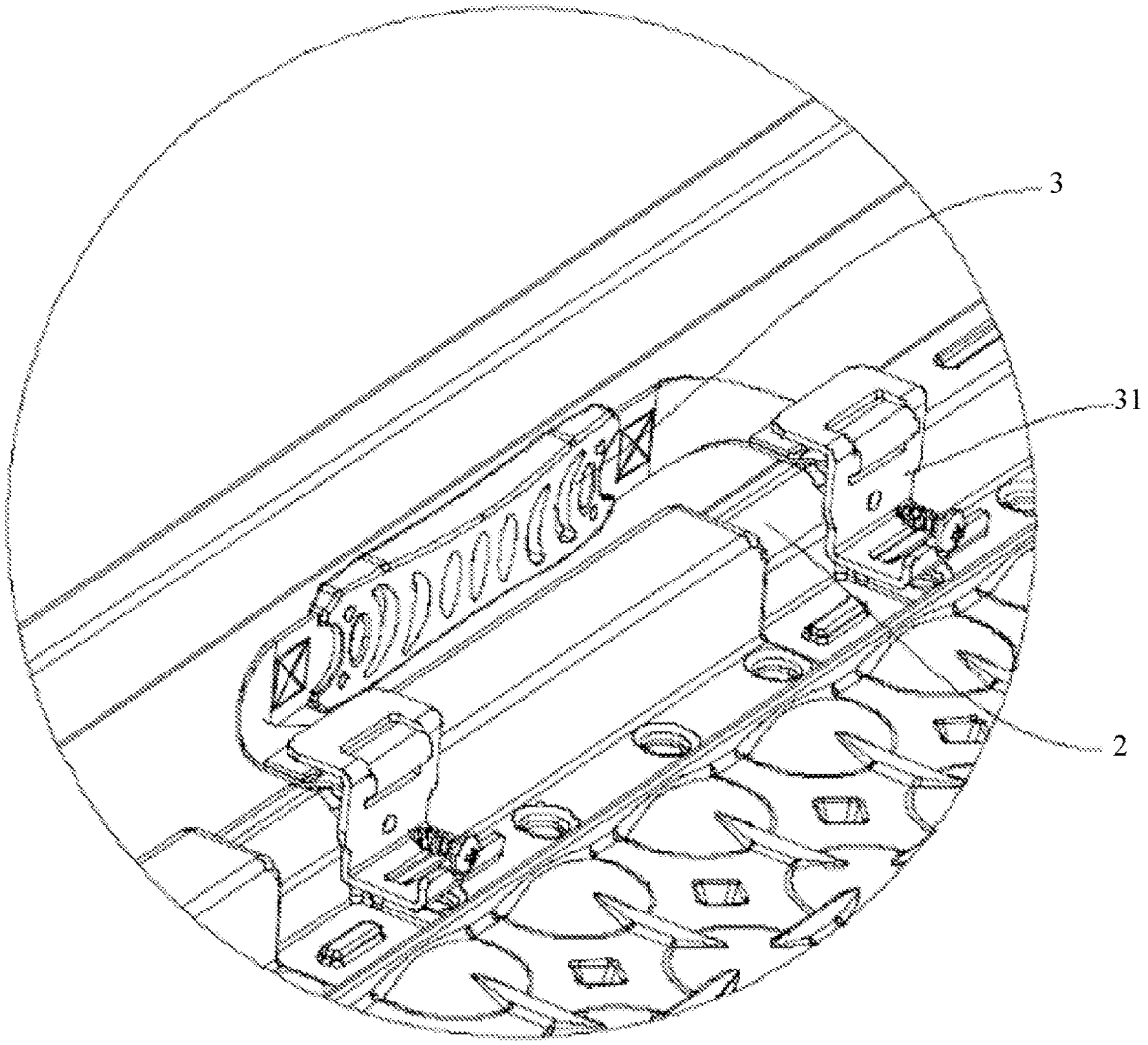
FIG. 4B is an enlarged view illustrating an exemplary handle in accordance with exemplary embodiments of the present disclosure.

Referring in particular to FIGS. 4A and 4B, handle 3 is connected to an edge of tabletop 2 by one or more connectors such as connector 31. However, the present invention is not limited to this. A handle can have various configurations and can be connected to the frame (e.g., mounting member 11*a* or 11*b*), tabletop or both of the frame and tabletop. Examples of handle configurations and attachments to frames, tabletops, and/or panels are disclosed in U.S. patent application Ser. No. 17/246,038, the disclosure of which is incorporated herein for all purposes by reference in its entirety. With a handle, the table is easy to carry or move around.

Figure 8A:
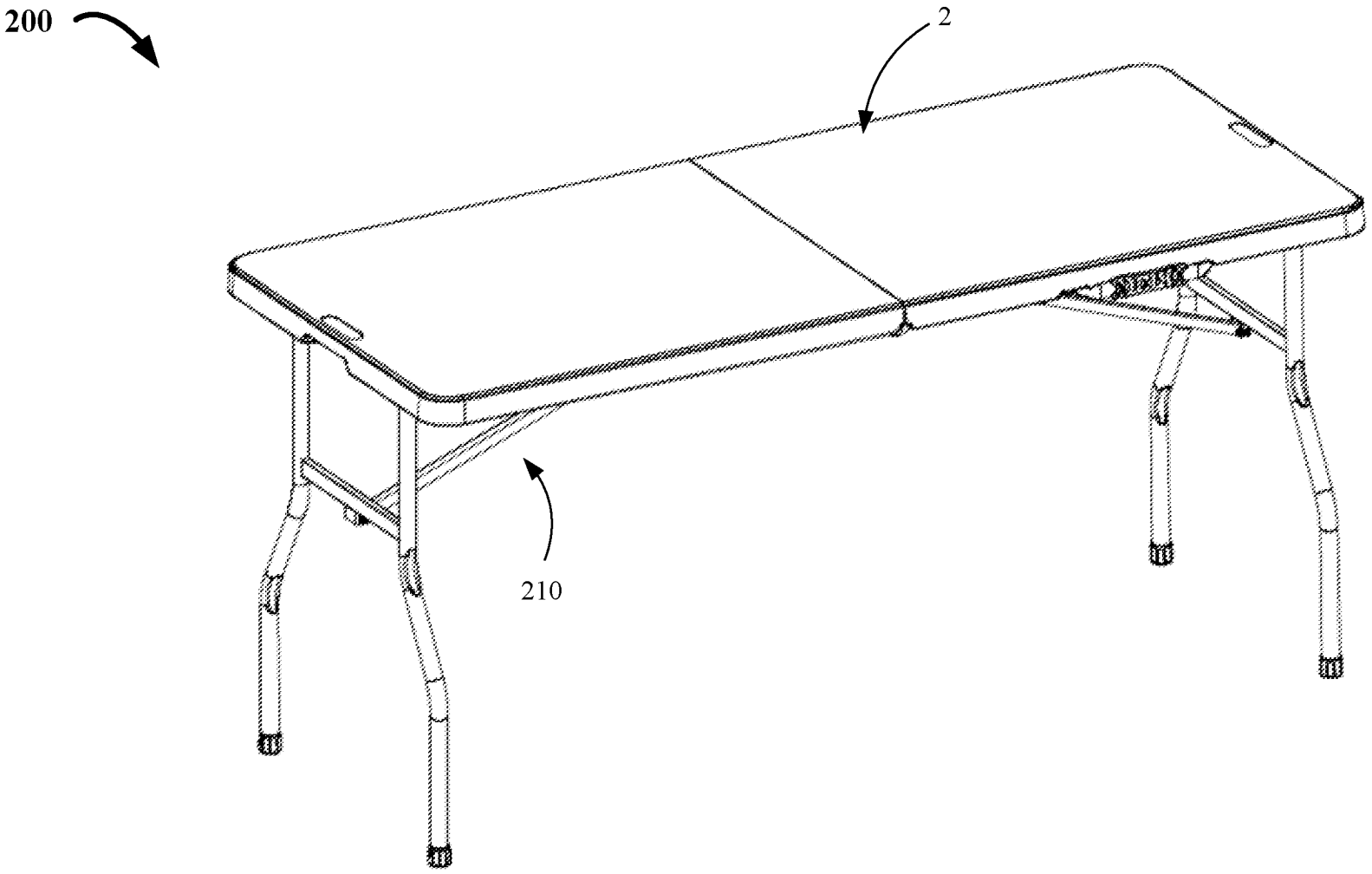
FIG. 8A is a top perspective view illustrating an exemplary table in an unfolded state in accordance with exemplary embodiments of the present disclosure.
Figure 8B:
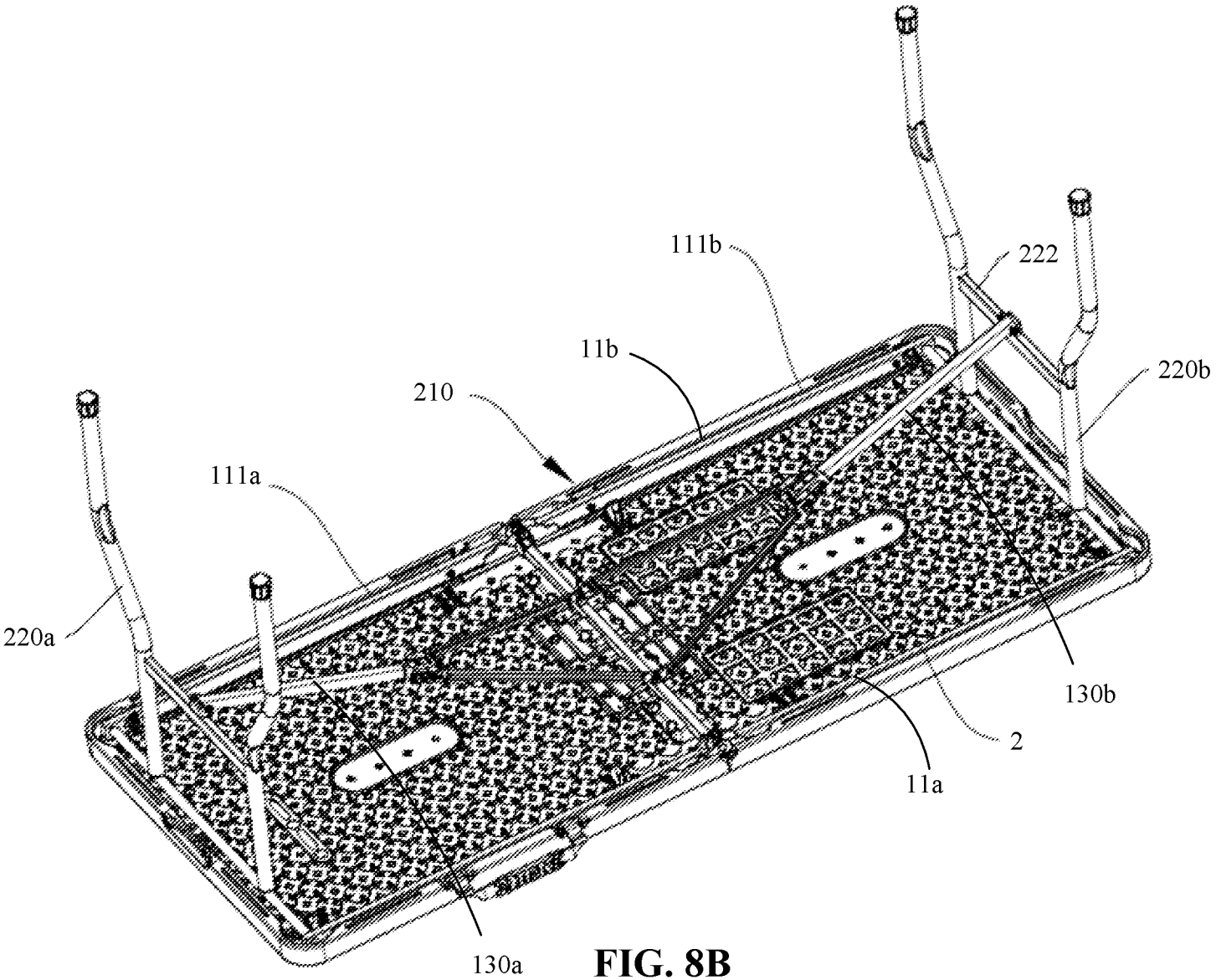
FIG. 8B is a bottom perspective view illustrating the exemplary table of FIG. 8A.
Figure 8C:
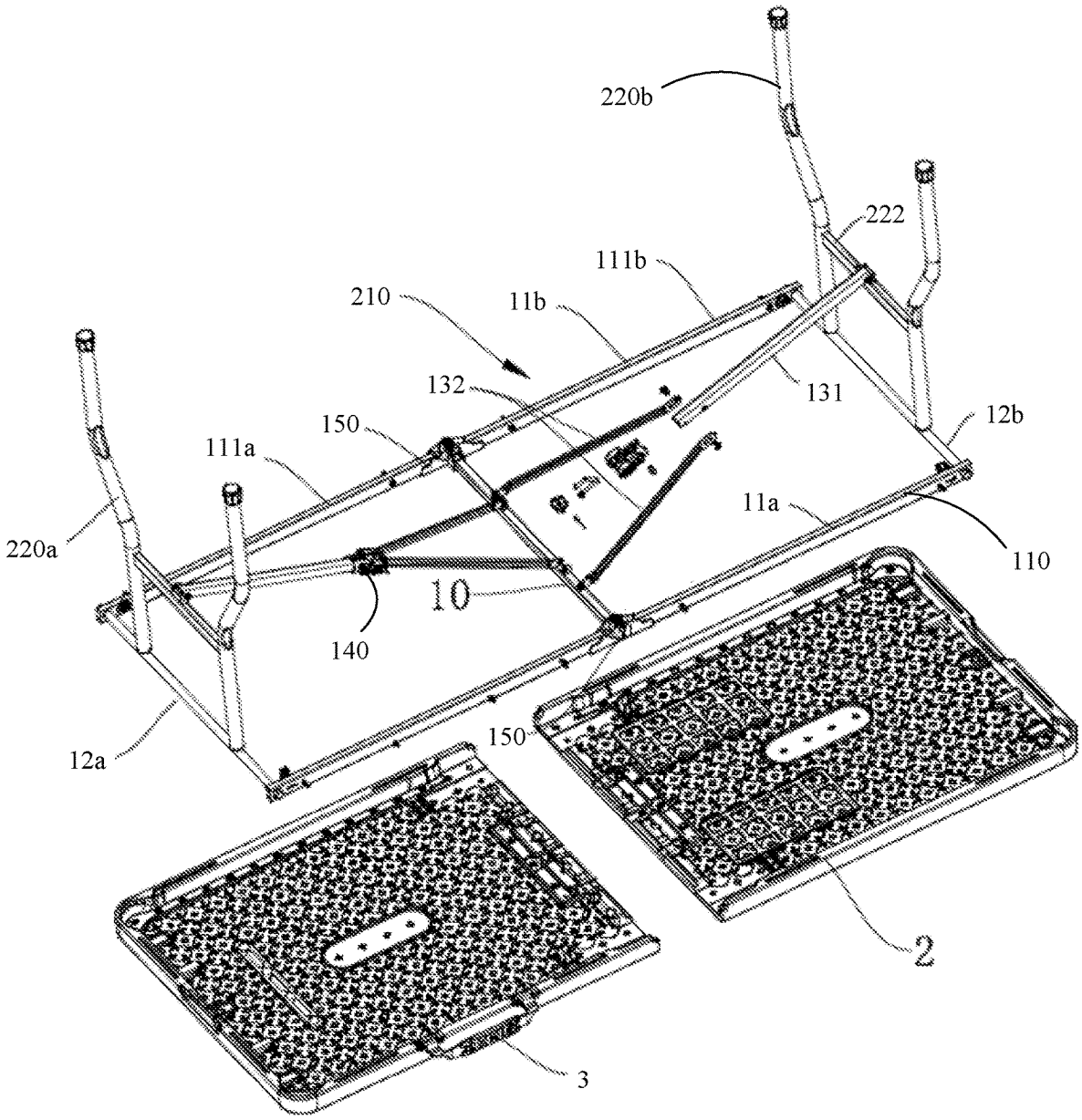
FIG. 8C is a partially disassembled view illustrating the exemplary table of FIG. 8A.

Referring now to FIGS. 8A-8C, there is depicted an exemplary table in accordance with some embodiments of the present disclosure. As shown, exemplary table 200 includes a tabletop, such as tabletop 2, and a frame, such as frame 210, coupled with the tabletop and supporting the tabletop when in use.

Similar to frame 1, frame 210 includes a mounting assembly, such as mounting assembly 110. Frame 210 also includes a first leg assembly, such as first leg assembly 220*a*, and a second leg assembly, such as second leg assembly 220*b*. First leg assembly 220*a* and second leg assembly 220*b* can be but do not necessarily have to be identical or symmetric with respect to each other. By way of example, FIGS. 8A-8C illustrate that first leg assembly 220*a* and second leg assembly 220*b* are substantially the same. In some exemplary embodiments, like first leg assembly 120*a* and second leg assembly 120*b*, first leg assembly 220*a* has an upper end coupled with lateral bar 12*a* and second leg assembly 220*b* has an upper end coupled with lateral bar 12*b*. In addition, each of first leg assembly 220*a* and second leg assembly 220*b* includes two legs and a leg lateral bar, such as leg lateral bar 222, disposed between and connecting the two legs.

In some exemplary embodiments, frame 210 includes a first supporting assembly, such as first supporting assembly 130*a*, and a second supporting assembly, such as second supporting assembly 130*b*. First supporting assembly 130*a* is pivotally coupled with the mounting assembly and first table leg assembly 220*a* to control rotation of first leg assembly 220*a*. Second supporting assembly 130*b* is pivotally coupled with the mounting assembly and second table leg assembly 220*b* to control rotation of second leg assembly 220*b*.

For instance, referring to FIGS. 8C and 9A-9C, in some exemplary embodiments, first supporting assembly 130*a* or second supporting assembly 130*b* includes a first supporting member, such as first supporting member 131, at least one second supporting member, such as second supporting member 132, and a sliding mechanism, such as sliding mechanism 140. One end portion of the first supporting member is pivotally coupled with the first or second leg assembly, for instance, pivotally coupled with leg lateral bar 222 of the first or second leg assembly. One end of the second supporting member is coupled with the first supporting member, for instance, through the sliding mechanism. The other end of the second supporting member is pivotally coupled with third lateral bar 10, for instance, via coupler 170.

In some exemplary embodiments, sliding mechanism 140 includes a slider, such as slider 5, slidably coupled with the first supporting member and movable along a length direction of the first supporting member. For instance, in some exemplary embodiments, slider 5 includes a sleeve, such as sleeve 51, slidably coupled with first supporting member. It should be noted that the sleeve can be coupled with any suitable bars including but not limited the first supporting member, and accordingly sliding mechanism 140 can be used in applications including but not limited to table frames disclosed herein. For instance, sliding mechanism 140 can be used in other furniture such as chairs, beds or the like.

In some exemplary embodiments, slider 5 includes a portion, such as portion 52, configured to couple a bar or the like (e.g., second supporting member 132) with the slider. In an exemplary embodiment, portion 52 is a pivoting portion configured to pivotally couple a bar or the like with the slider. In some exemplary embodiments, portion 52 is formed or coupled with the sleeve. For instance, in an exemplary embodiment, portion 52 is a protrusion or a hole formed at the sleeve. In some exemplary embodiments, one or more portions 52 are formed or coupled with the sleeve, each configured to couple a bar or the like with the sleeve.

In some exemplary embodiments, a restriction hole, such as restriction hole 53, is formed at the sleeve. In some exemplary embodiments, slider 5 includes a push button, such as push button 54, movably coupled with the restriction hole of the slider, such that the push button or at least a portion of the push button can be inserted into the restriction hole of the slider.

In some exemplary embodiments, sliding mechanism 140 includes a locking member, such as a locking member 6, that selectively restricts the sleeve of the slider from moving with respect to the first supporting member. For instance, in some exemplary embodiments, the first supporting member, or at least a portion adjacent to another end of the first supporting member is hollow. A restriction hole, such as restriction hole 139, is formed at a side wall of the hollow portion of the first supporting member. Locking member 6 includes a restriction piece, such as restriction piece 61, and an elastic piece, such as elastic piece 62, formed or coupled with the restriction piece. The elastic piece is disposed in the hollow portion of the first supporting member and adjacent to the first restriction hole formed at the first supporting member.

Figure 9A:
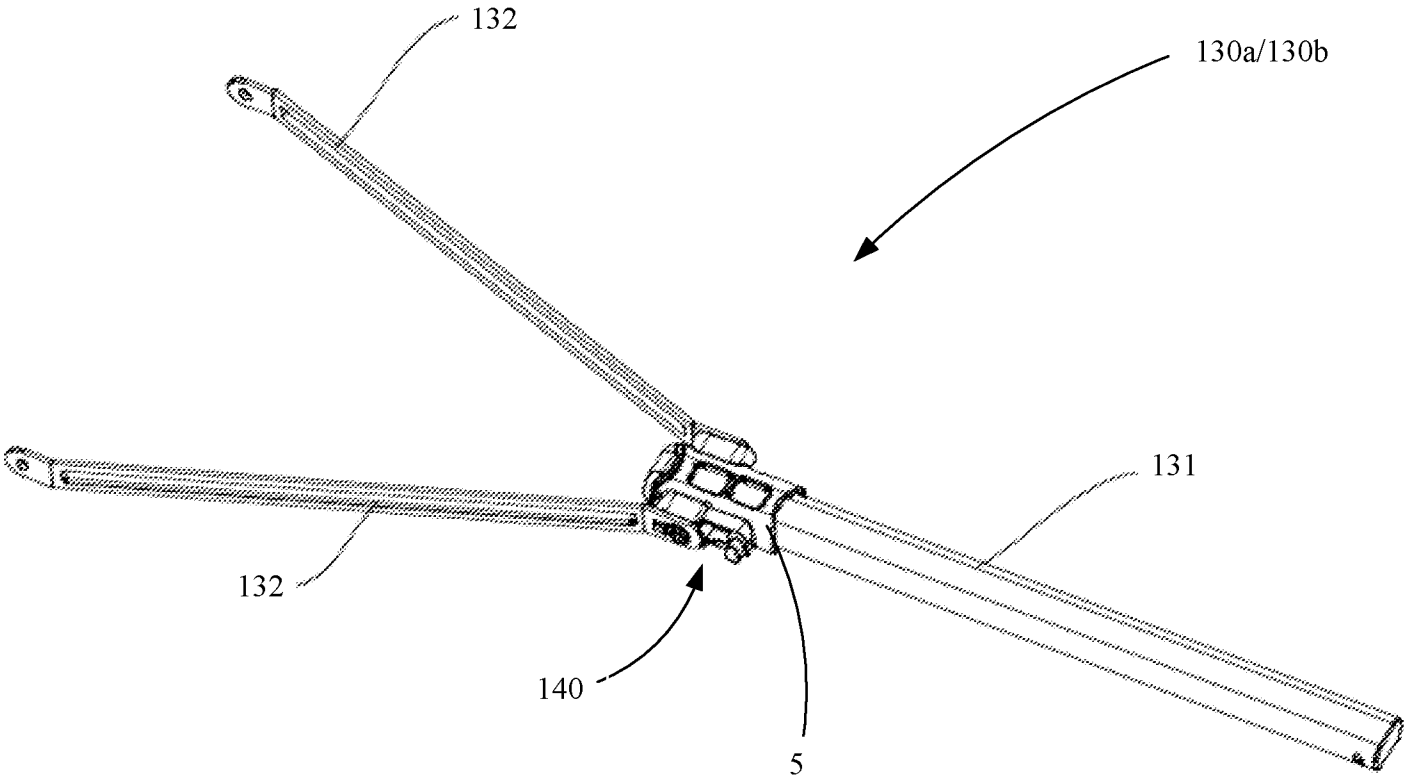
FIG. 9A is a perspective view illustrating an exemplary supporting assembly in accordance with exemplary embodiments of the present disclosure.
Figure 9B:
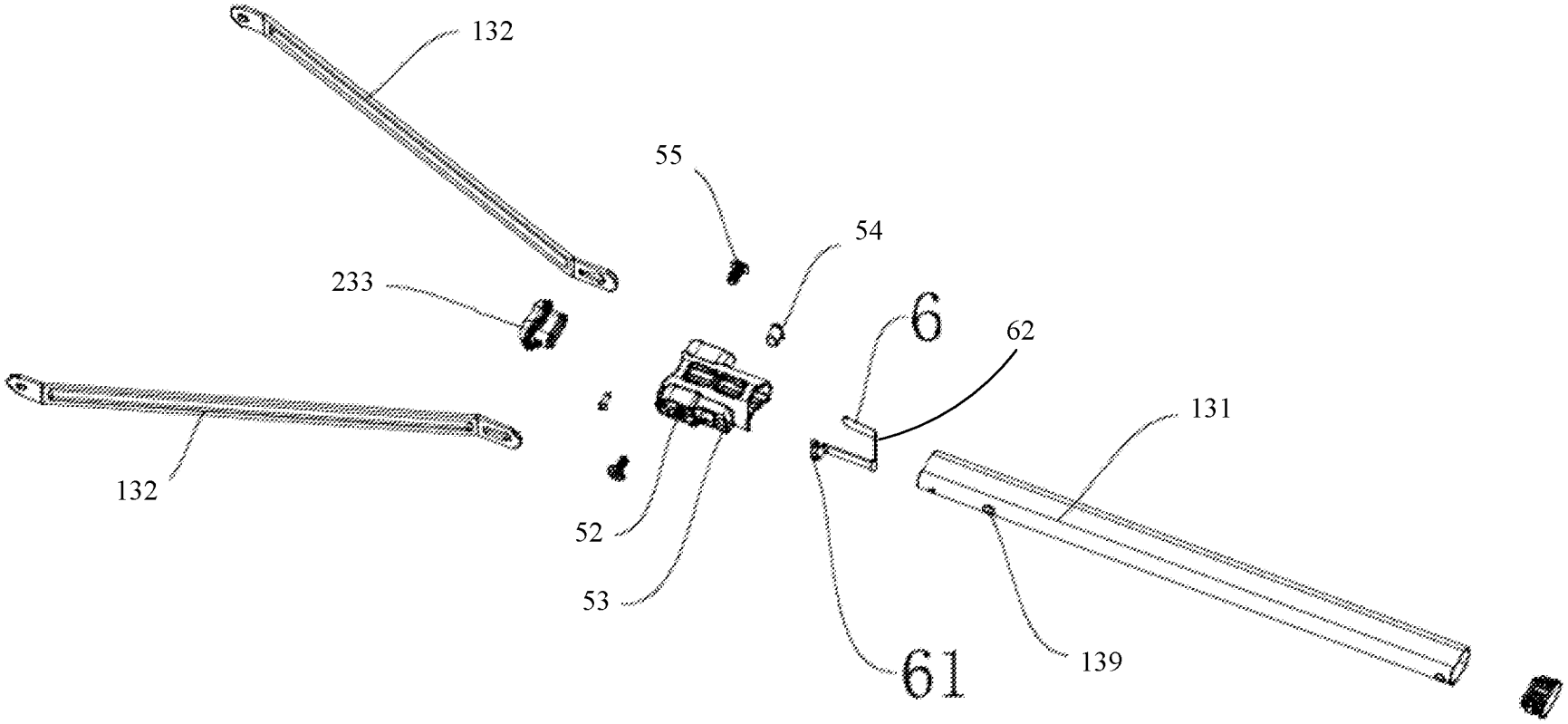
FIG. 9B is a partially disassembled view illustrating the exemplary supporting assembly of FIG. 9A.
Figure 9C:
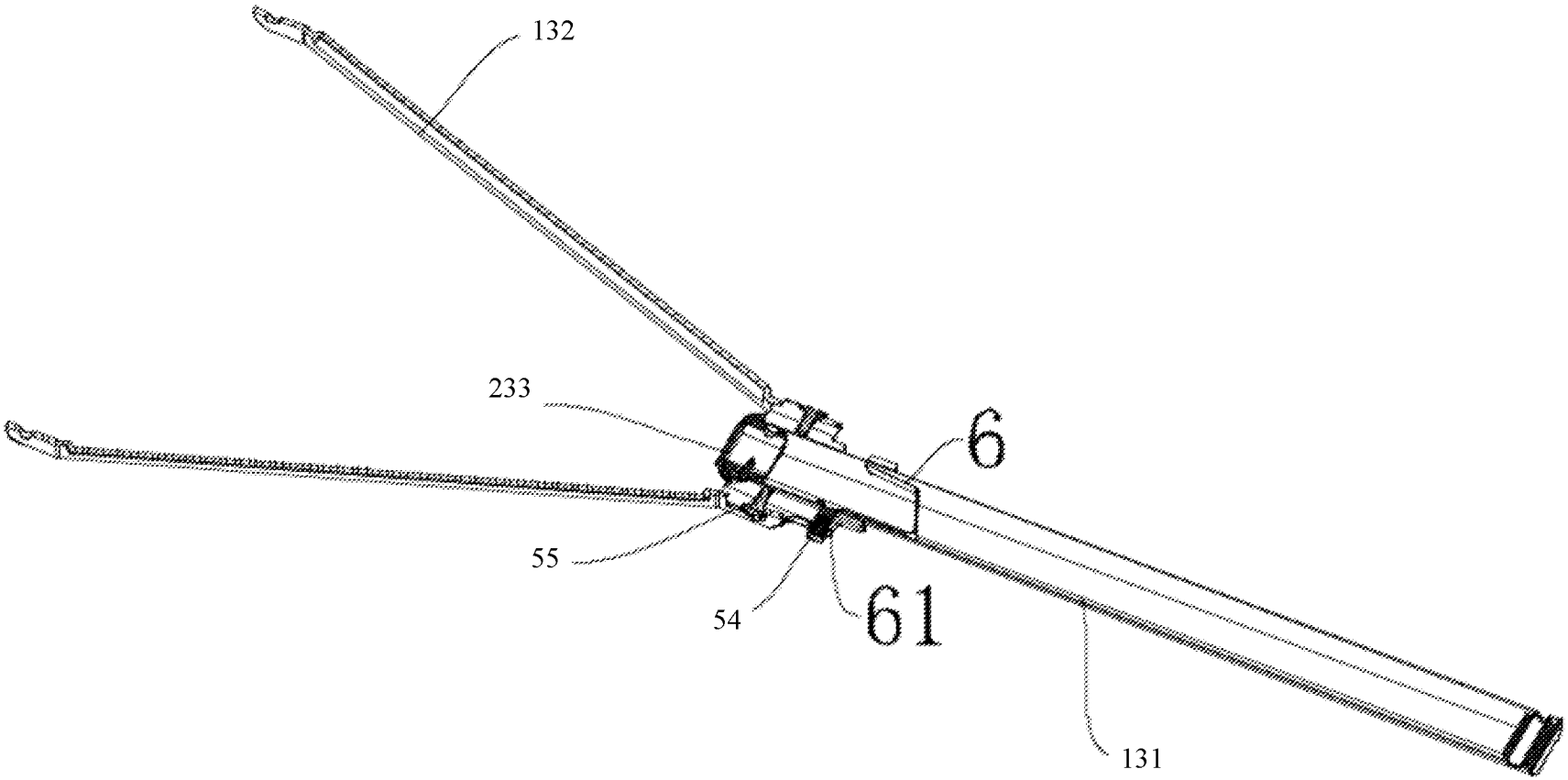
FIG. 9C is a partially cutout view illustrating the exemplary supporting assembly of FIG. 9A.

The elastic piece of the locking member can be made of any suitable materials, including but not limited to plastics and metals. The elastic piece of the locking member can also have any suitable configurations (e.g., shapes, sizes). In some exemplary embodiments, the elastic piece of the locking member includes a plurality of portions. For instance, in an exemplary embodiment, the elastic piece includes two portions forming a "V" shape. In another exemplary embodiment, the elastic piece includes first, second and third portions with the second portion bended with respect to the first portion and the third portion bended with respect to the second portion as illustrated in FIG. 9B. The bended elastic piece can be made, for instance, by bending a metal strip, molding a plastic, or the like. In some exemplary embodiments, the restriction piece is coupled or formed with the elastic piece at a location adjacent to an end of the elastic piece.

When the restriction hole formed at the sleeve is aligned with the restriction hole formed at the first supporting member, the elastic piece of the sliding mechanism pushes the restriction piece outwardly through the restriction hole formed at the first supporting member and the restriction hole formed at the sleeve. As such, the restriction piece engages the sleeve with the first supporting member and thus restricts the sleeve from moving along the first supporting member. Pressing the push button of the sliding mechanism will push the restriction piece inwardly, disengage the position piece from the restriction hole formed at the sleeve, and thus allow the sleeve to move along the first supporting member.

In some exemplary embodiments, each second supporting member has an end portion coupled with the sleeve of the sliding mechanism, for instance, through portion 52 and/or fastener 55. Each second supporting member has another end portion pivotally coupled with the mounting assembly, for instance, pivotally coupled with third lateral bar 10.

Figure 10A:
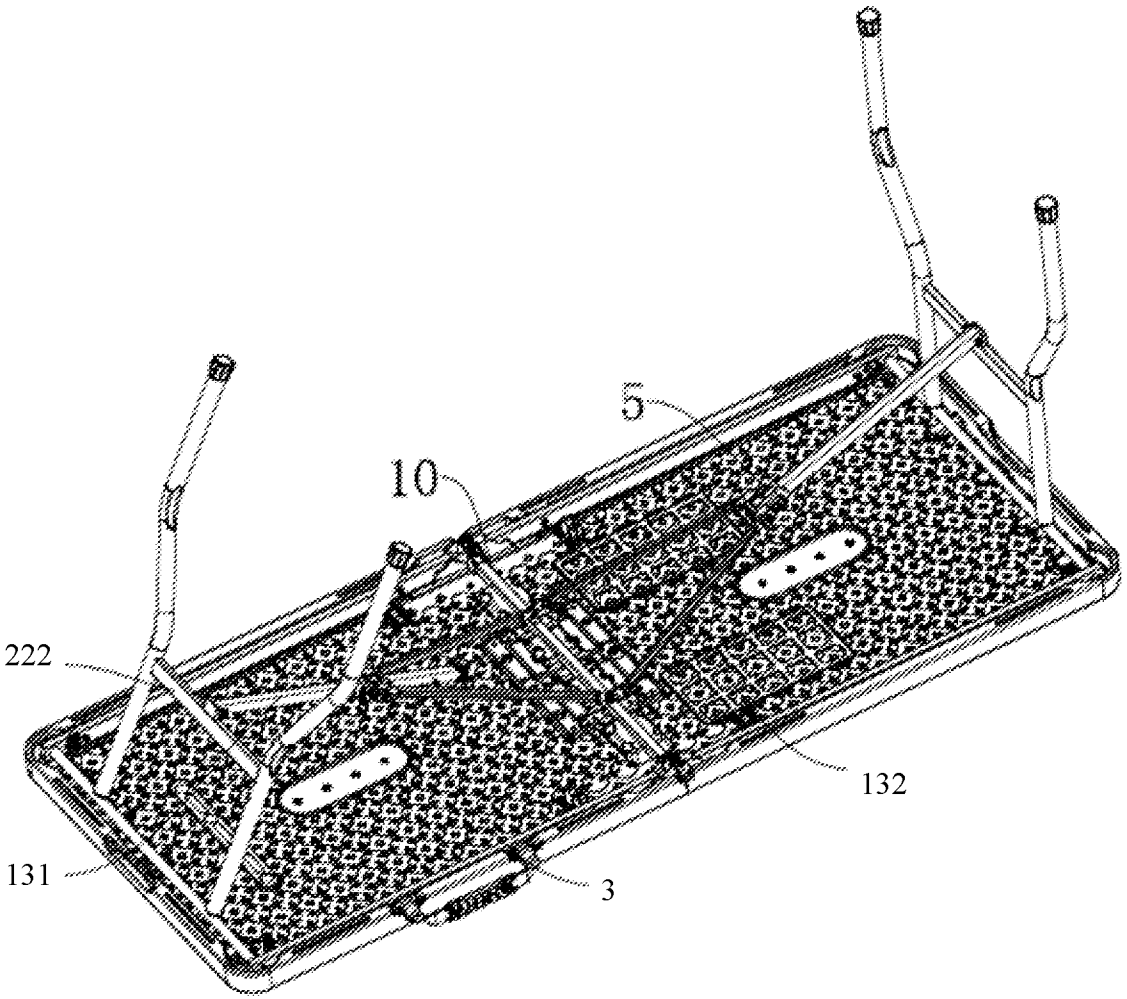
FIG. 10A is a perspective view illustrating the exemplary table of FIG. 8A in a first partially folded state assembly in accordance with exemplary embodiments of the present disclosure.
Figure 10B:
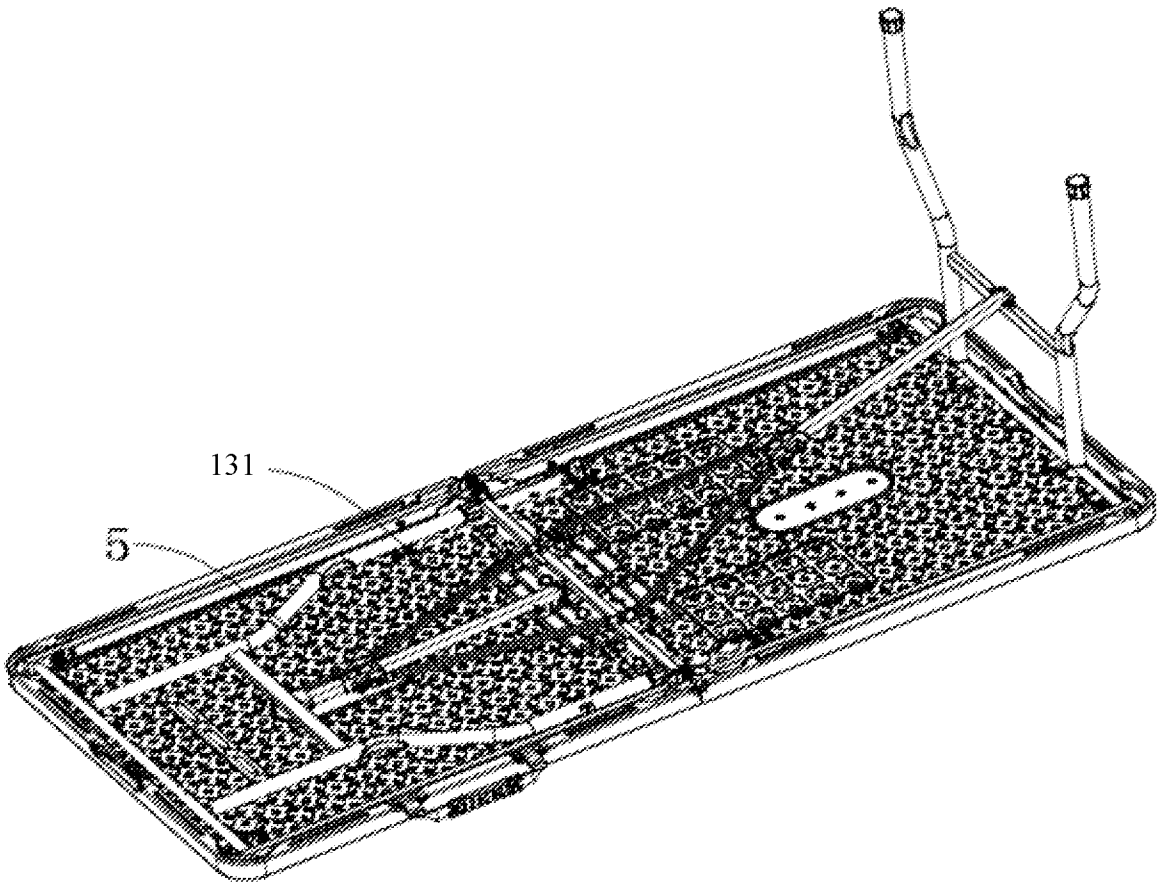
FIG. 10B is a perspective view illustrating the exemplary table of FIG. 8A in a second partially folded state assembly in accordance with exemplary embodiments of the present disclosure.
Figure 10C:
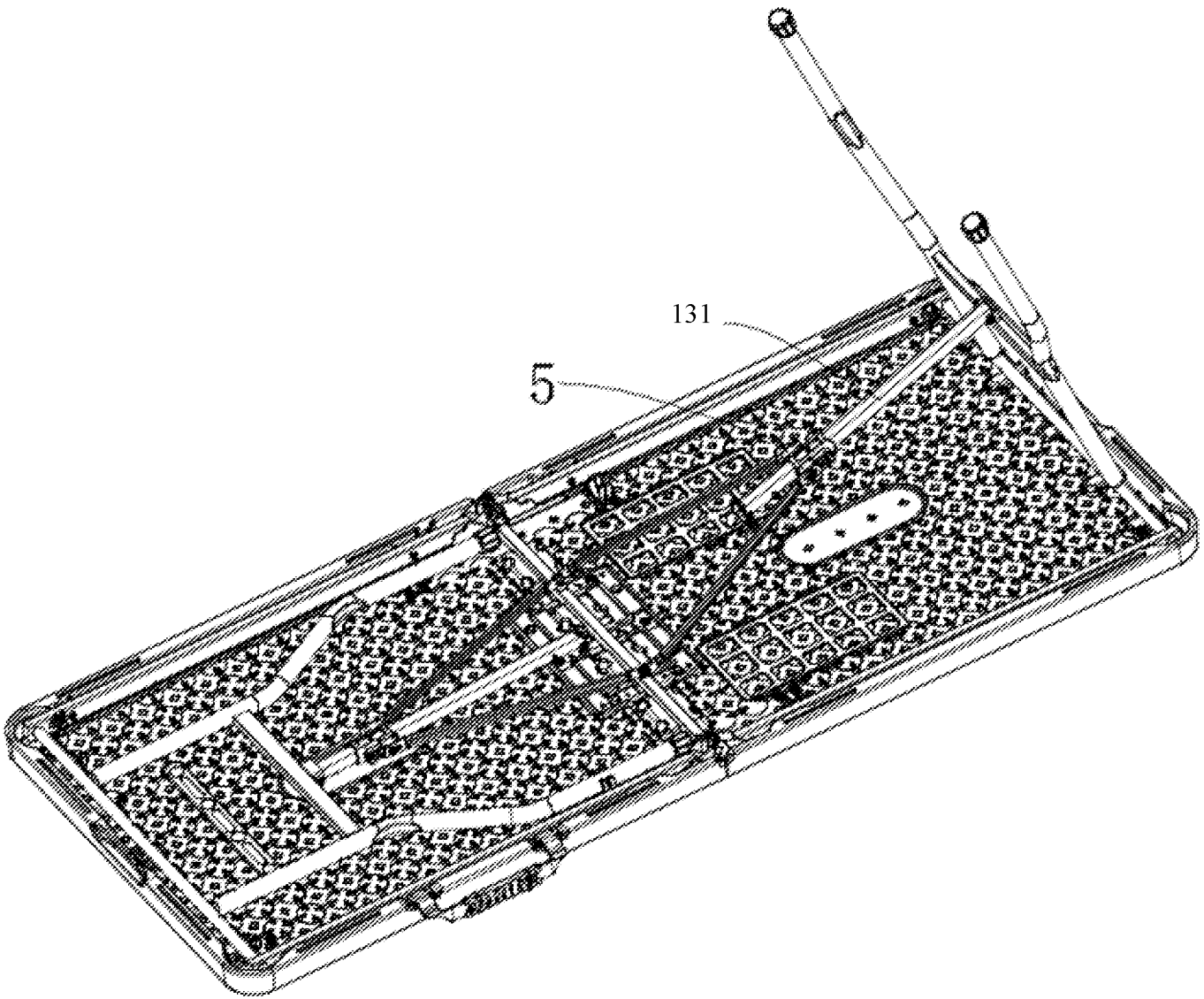
FIG. 10C is a perspective view illustrating the exemplary table of FIG. 8A in a third partially folded state assembly in accordance with exemplary embodiments of the present disclosure.
Figure 10D:
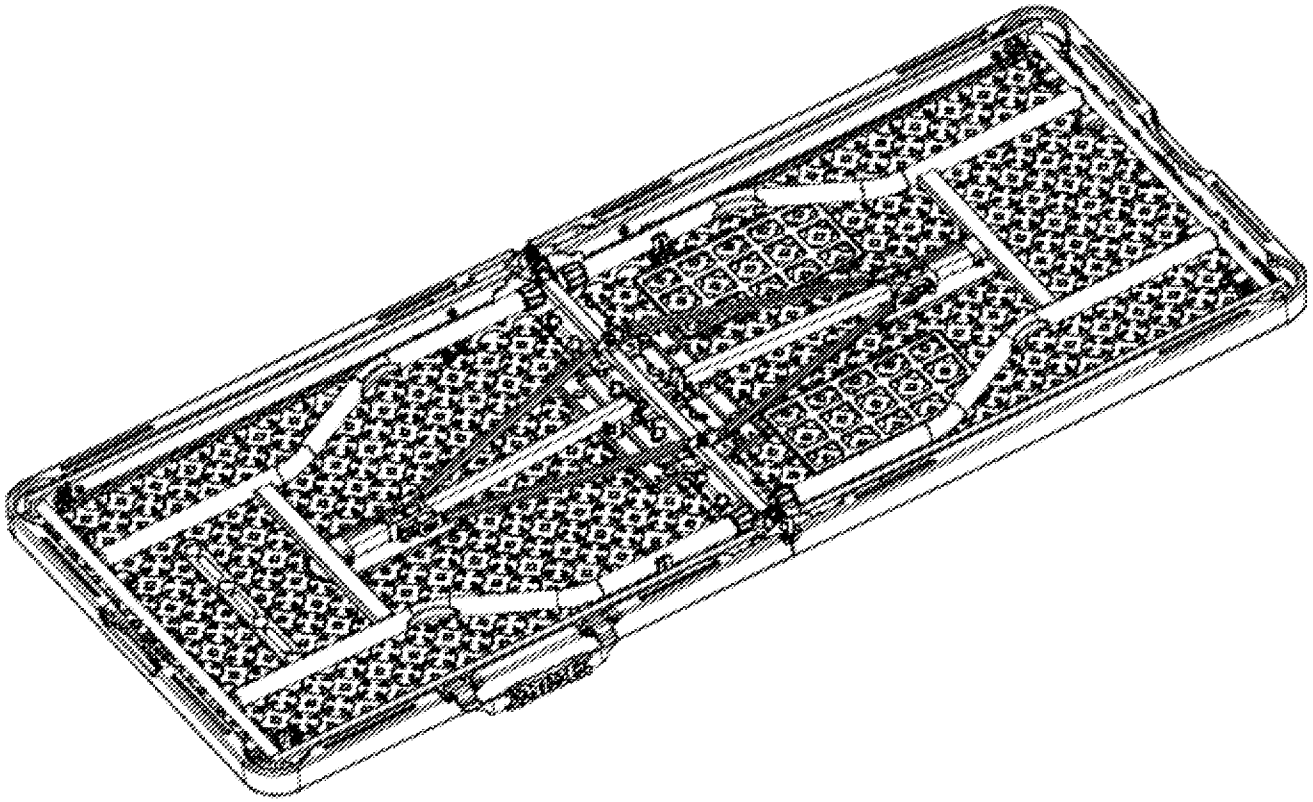
FIG. 10D is a perspective view illustrating the exemplary table of FIG. 8A in a fourth partially folded state assembly in accordance with exemplary embodiments of the present disclosure.
Figure 10E:
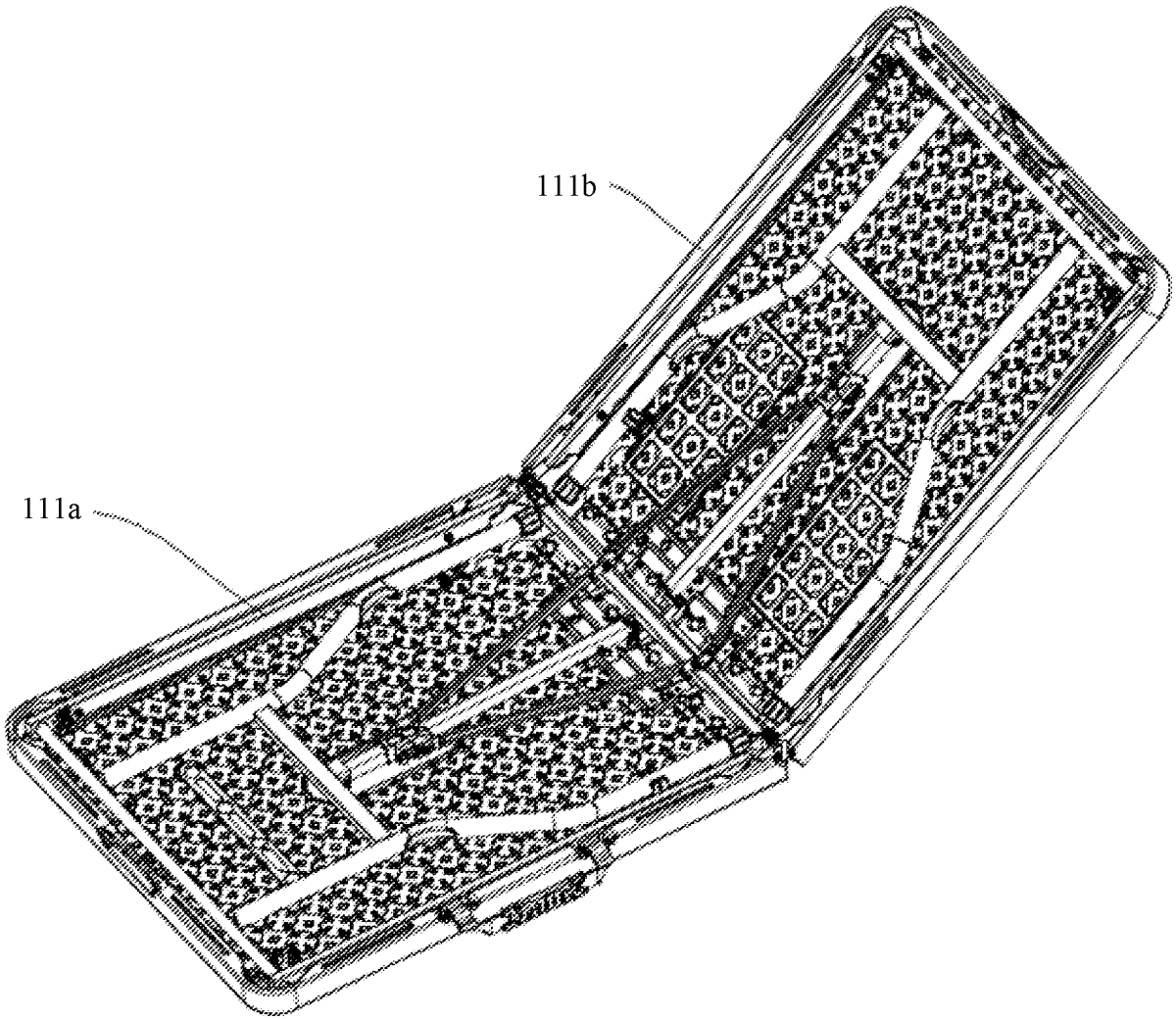
FIG. 10E is a perspective view illustrating the exemplary table of FIG. 8A in a fifth partially folded state assembly in accordance with exemplary embodiments of the present disclosure.
Figure 10F:
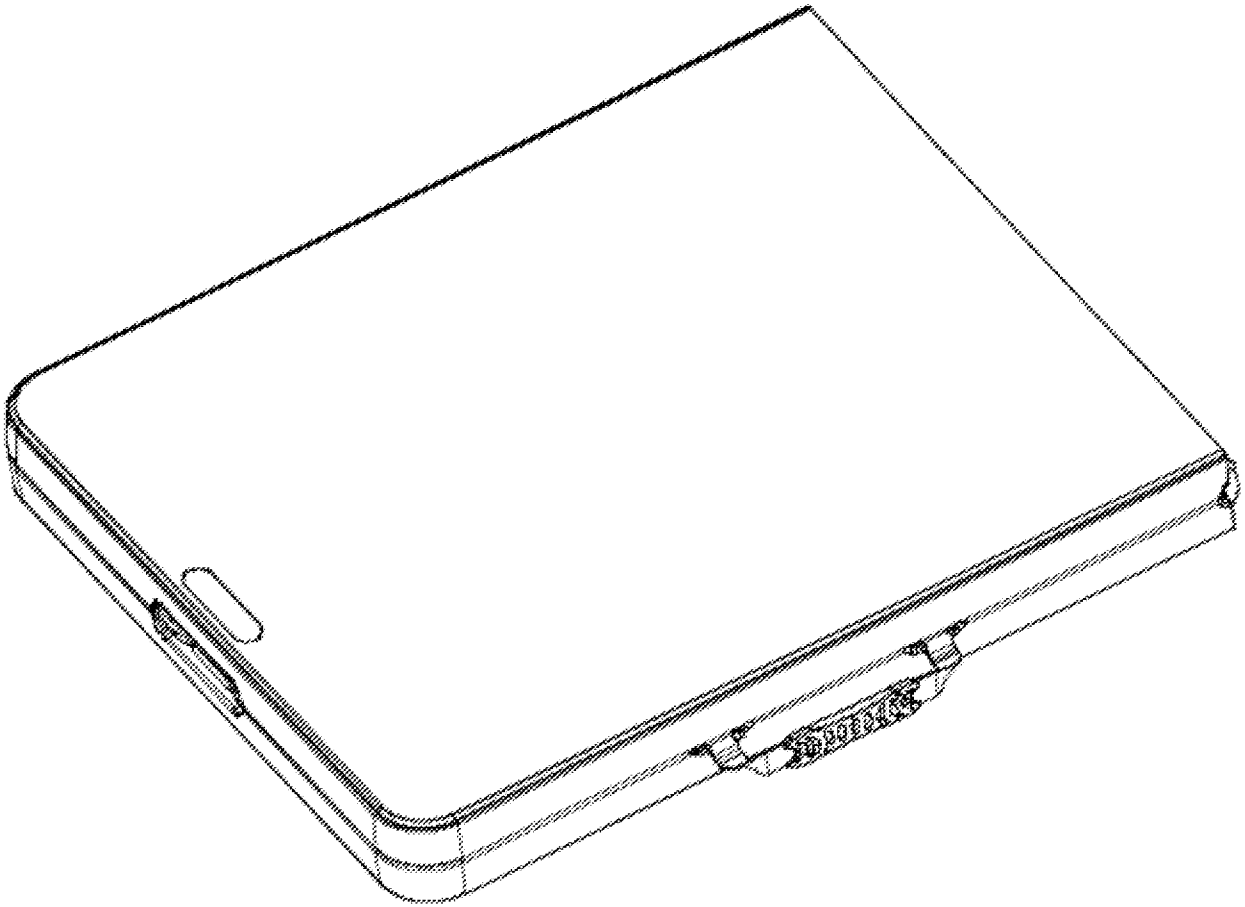
FIG. 10F is a perspective view illustrating the exemplary table of FIG. 8A in a folded state assembly in accordance with exemplary embodiments of the present disclosure.

Referring now to FIGS. 10A-10F, there is depicted an exemplary process to fold an exemplary table in accordance with some embodiments of the present disclosure. For instance, as illustrated in FIGS. 10A-10C, to fold the leg assembly, one can press the push button of the sliding mechanism to push the restriction piece inwardly and thus disengage the position piece from the restriction hole formed at the sleeve. This allows the sleeve to move along the first supporting member, and accordingly allows the leg assembly to fold. Since the table in FIG. 10D is placed upside down, the second rod of the pivoting mechanism, pulled by the gravity, is disposed outside of the slot of the second coupling piece. This unlocks the first and second coupling pieces of the pivoting mechanism, and thus allows the tabletop and frame to fold as illustrated in FIG. 10E. The resulted folded table in half is illustrated in FIG. 10F. Using the handle, one can easily carry around the folded table.

Reversing the process will unfold the table. For instance, from the folded state illustrated in FIG. 10F, one can first unfold the tabletop and frame as illustrated in FIGS. 10E and 10D. From there, one can unfold the leg assemblies as illustrated in FIGS. 10C, 10B and 10A. As the leg assembly rotates, the sleeve of the slider moves along the first supporting member until the slider contacts the positioning piece. At this position, the restriction hole formed at the sleeve aligns with the restriction hole formed at the first supporting member. The elastic piece pushes the restriction piece into the restriction holes formed at the sleeve and first supporting member, thereby restricting the sleeve from moving along the first supporting member and locking the leg assembly in the unfolded state.

Figure 11:
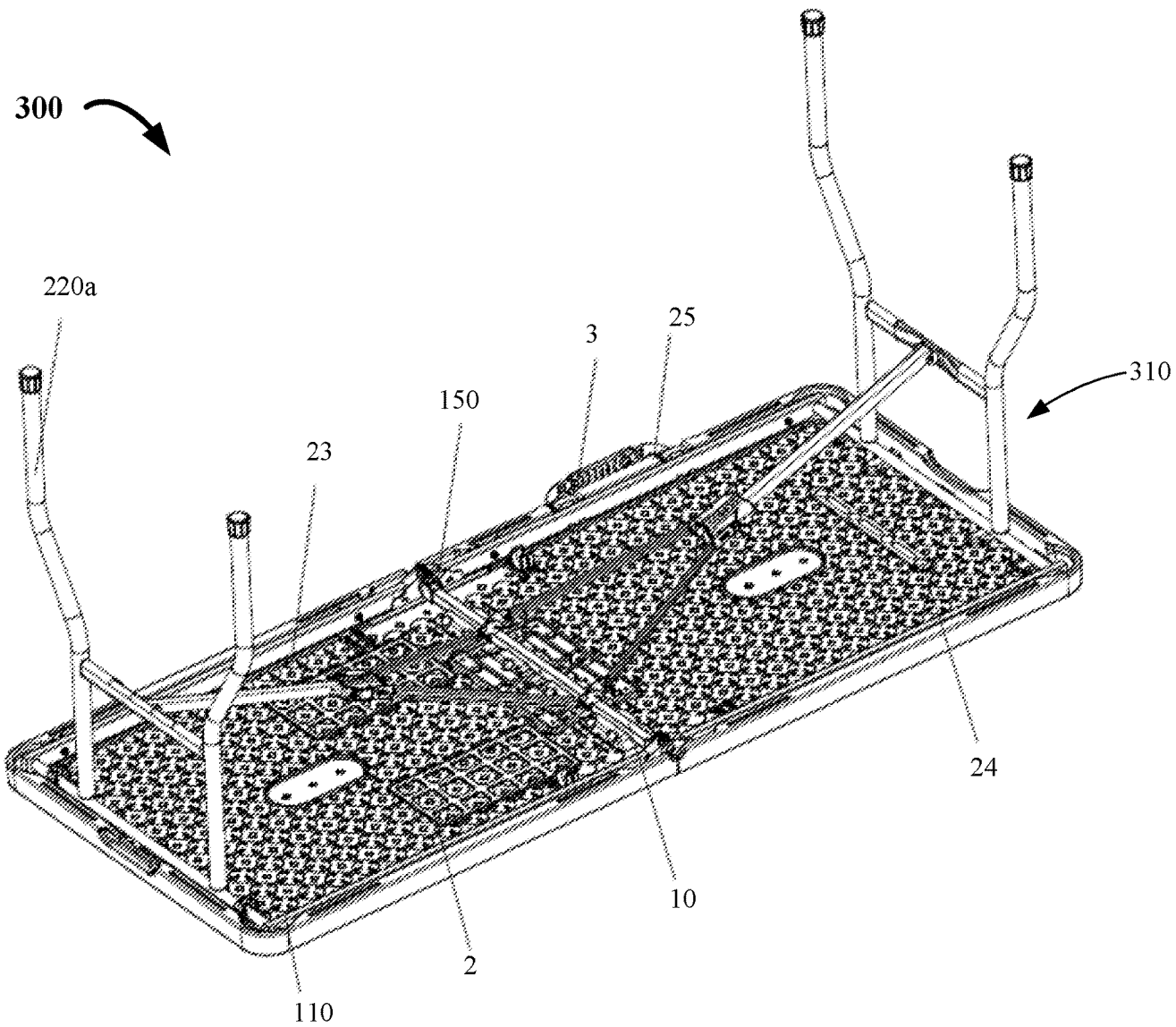
FIG. 11 is a bottom perspective view illustrating an exemplary table in an unfolded state in accordance with exemplary embodiments of the present disclosure.
Figure 12A:
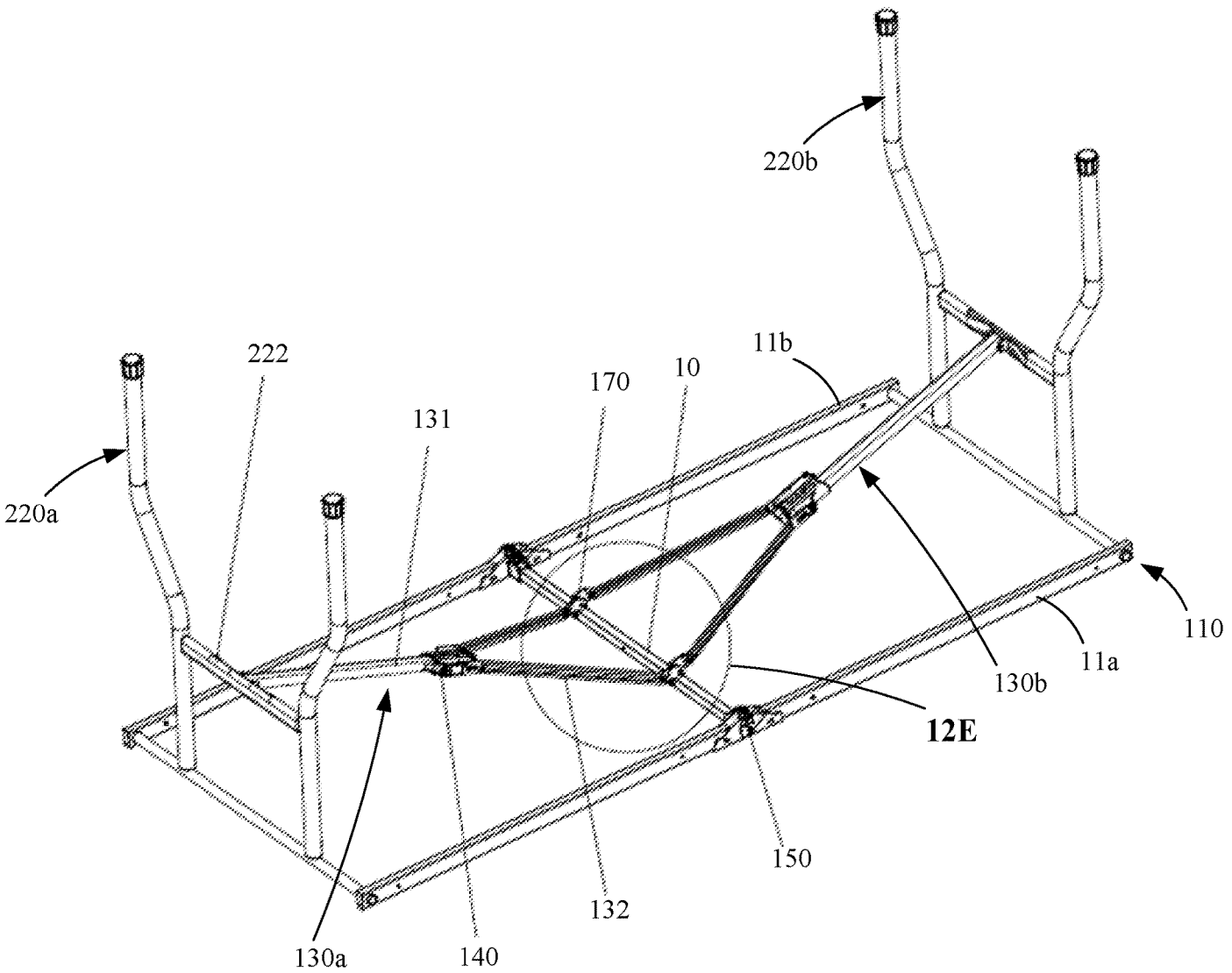
FIG. 12A is a bottom perspective view illustrating an exemplary frame in an unfolded state in accordance with exemplary embodiments of the present disclosure.
Figure 12B:
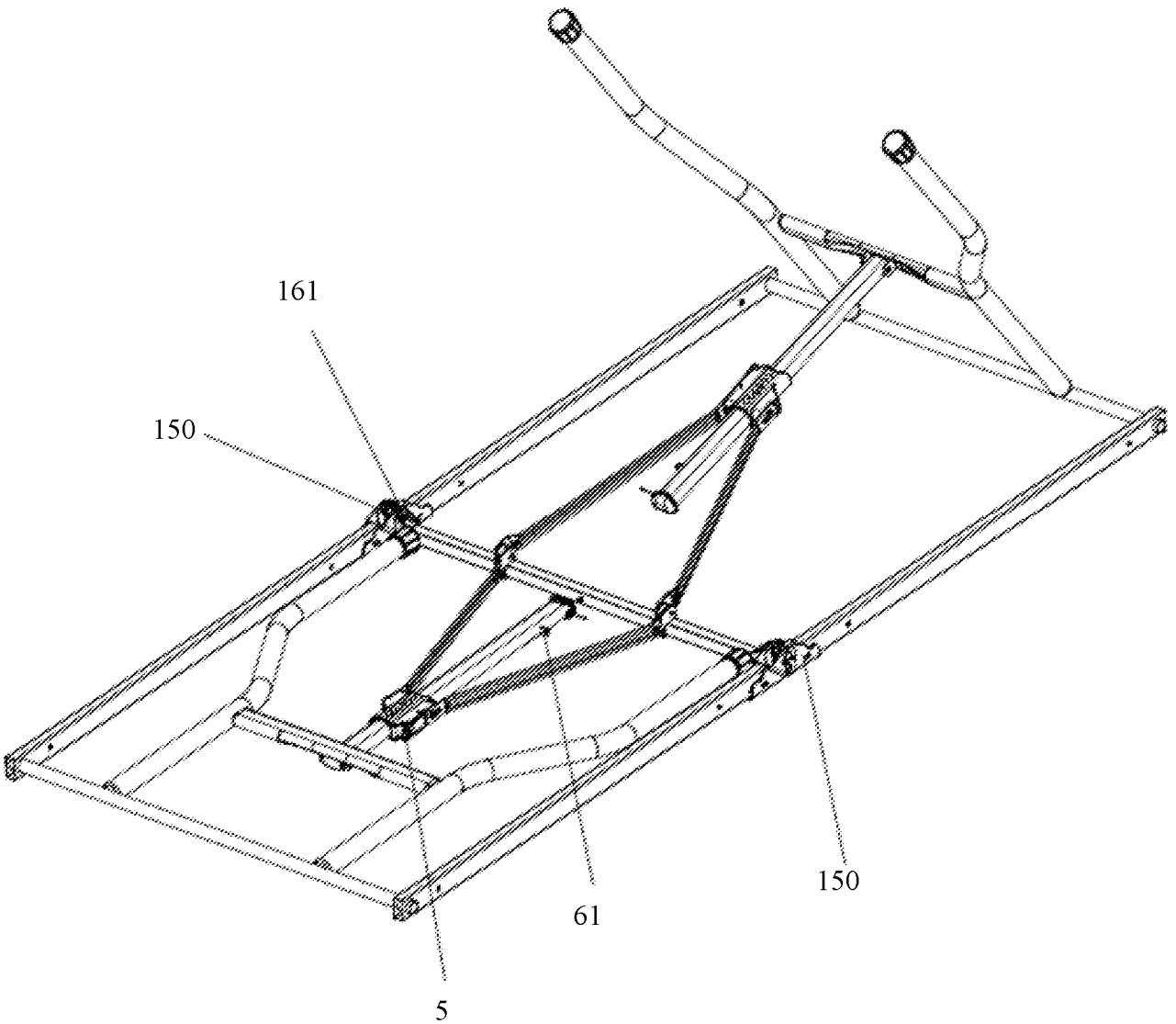
FIG. 12B is a perspective view illustrating the exemplary frame of FIG. 12A in a first partially folded state in accordance with exemplary embodiments of the present disclosure.
Figure 12C:
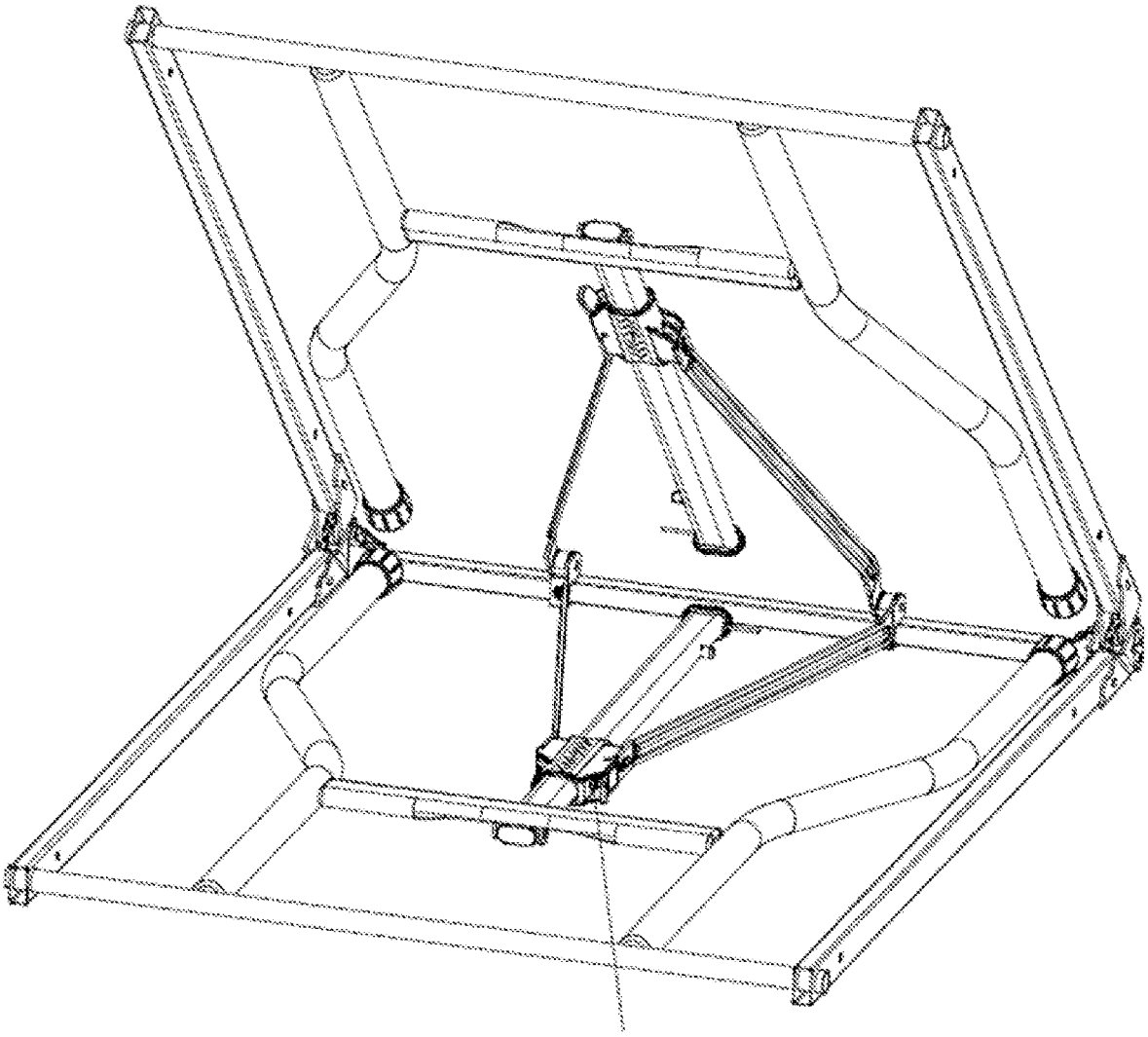
FIG. 12C is a perspective view illustrating the exemplary frame of FIG. 12A in a second partially folded state in accordance with exemplary embodiments of the present disclosure.
Figure 12D:
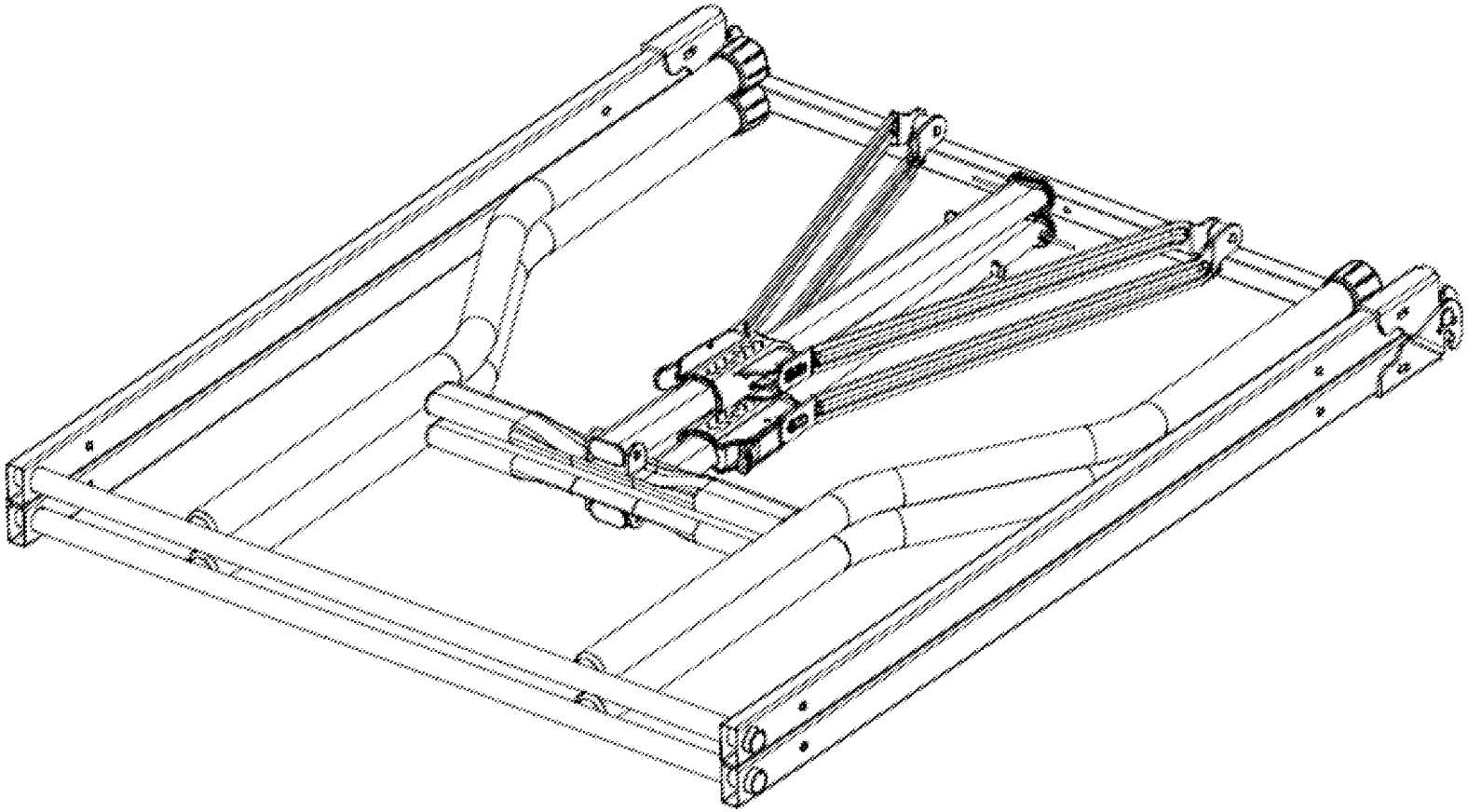
FIG. 12D is a perspective view illustrating the exemplary frame of FIG. 12A in a folded state in accordance with exemplary embodiments of the present disclosure.
Figure 12E:
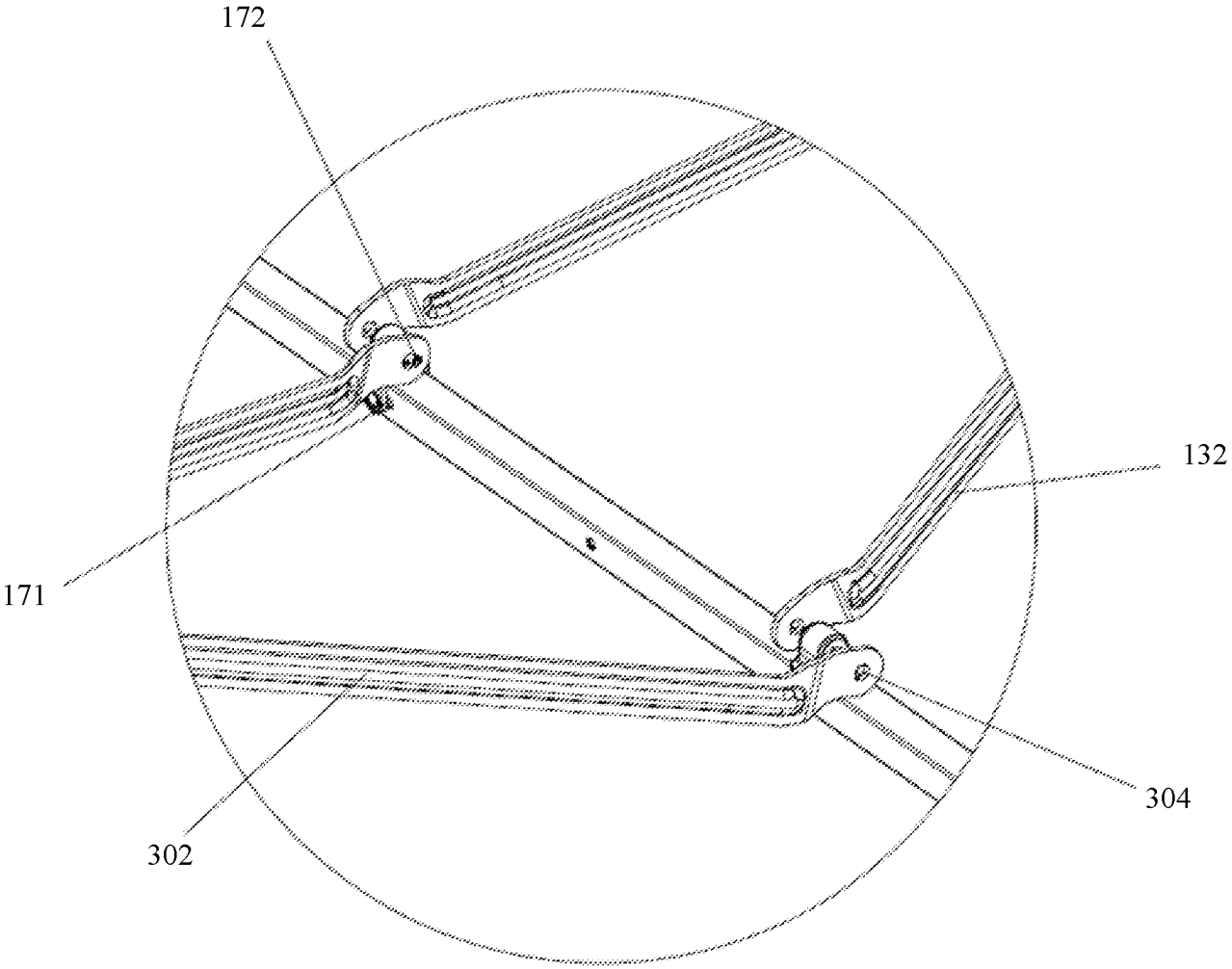
FIG. 12E is an enlarged view taken along circle 12E of FIG. 12A.

The frames and tables of the present disclosure can include additional, optional or alternative components. For instance, referring to FIGS. 11-12E, there is depicted an exemplary table in accordance with some embodiments of the present disclosure. As shown, exemplary table 300 includes a tabletop, such as tabletop 2, and a frame, such as frame 310, coupled with the tabletop and supporting the tabletop when in use.

In some exemplary embodiments, tabletop 2 includes a lip, such as lip 25, extending downward along at least a portion of the tabletop. In some exemplary embodiments, the tabletop (e.g., the first or second panel of the tabletop) includes one or more strengthening members 23 formed on the lower surface of the tabletop to enhance the strength of the tabletop, reduce the thickness of the tabletop, reduce material consumption, and/or lowering the cost. A strengthening member can be a channel, groove, depression, rib or the like. In some exemplary embodiments, tabletop 2 includes one or more vents 24 to improve comfort. A vent can have any suitable regular or irregular shapes, including but not limited to oval, oblong, circle, rectangle, square, or the like.

Frame 310 includes mounting assembly 110 coupled with the tabletop. For instance, in the illustrated embodiment, the first and second mounting members of the mounting assembly are connected to lip 25 of the tabletop by fasteners or the like. Frame 310 also includes first leg assembly 220*a*, second leg assembly 220*b*, first supporting assembly 130*a*, and second supporting assembly 130*b*. Second supporting members 132 of the first and second supporting assemblies are pivotally coupled with the third lateral bar, for instance, via two couplers 170 disposed at the third lateral bar. The two couplers are spaced apart from each other along the length direction of the third lateral bar. For instance, in the illustrated embodiment, one coupler 170 is disposed adjacent to first mounting member 11*a* and one coupler 170 is disposed adjacent to second mounting member 11*b*. In some exemplary embodiments, second supporting member 132 is formed with a slot, such as slot 302, elongated along the length direction of the second supporting member to reduce the weight of the second supporting member. In some exemplary embodiments, second supporting member 132 is formed with a hole, such as hole 304, configured to be coupled with pivoting piece 172 of coupler 170.

Figure 13A:
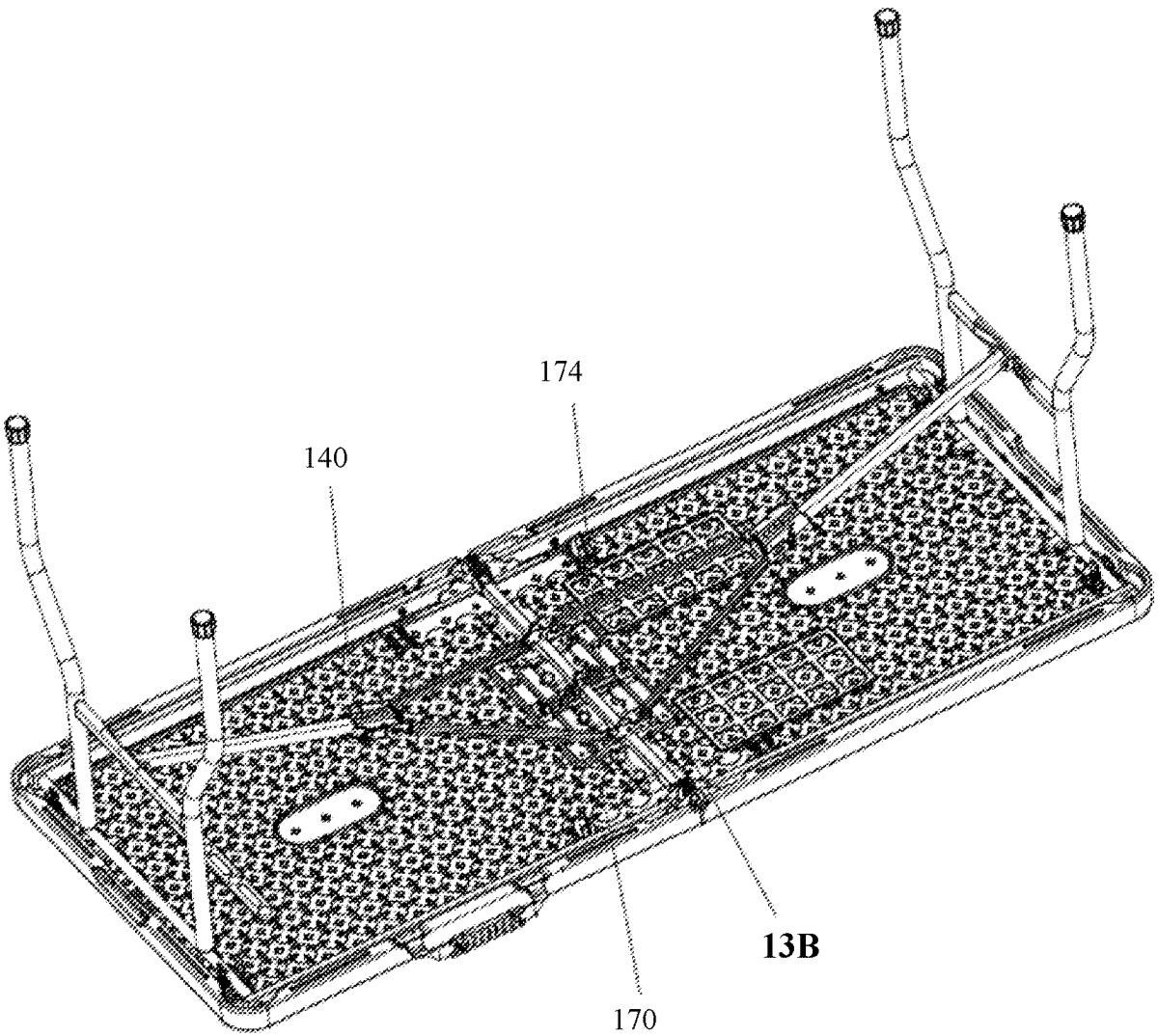
FIG. 13A is a bottom perspective view illustrating an exemplary table in an unfolded state in accordance with exemplary embodiments of the present disclosure.
Figure 13B:
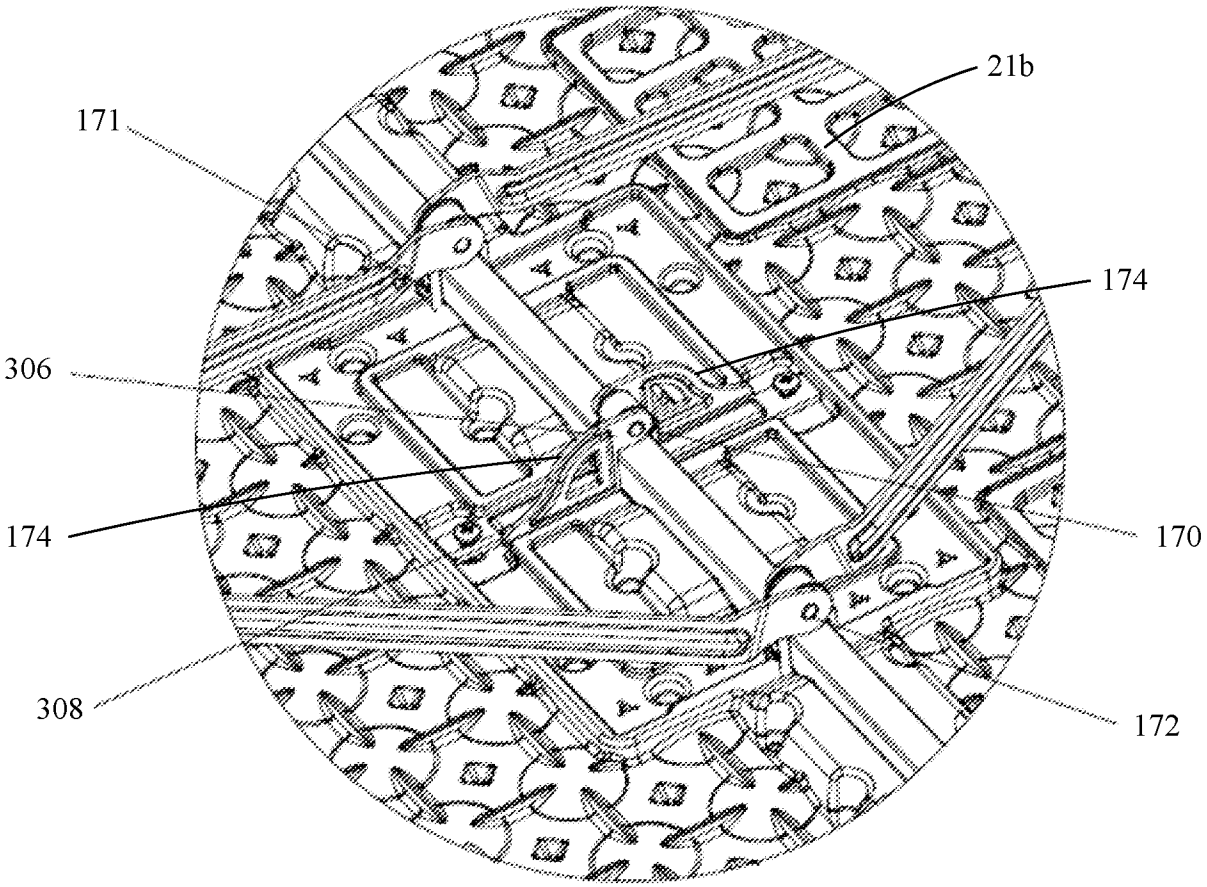
FIG. 13B is an enlarged view taken along circle 13B of FIG. 13A.

Referring to FIGS. 13A and 13B, in some exemplary embodiments, an additional coupler 170 is disposed at the third lateral bar, preferably at the middle portion of the third lateral bar. Frame 310 further includes a first connecting piece (e.g., connecting piece 174 at the left side of the third lateral bar) and a second connecting piece (e.g., connecting piece 174 at the right side of the third lateral bar). First connecting piece 174 is fixedly coupled with first panel 21*a* and pivotally coupled with the additional coupler. Second connecting piece 174 is fixedly coupled with second panel 21*b* and pivotally coupled with the additional coupler. For instance, in some embodiments, connecting piece 174 includes first portion 306 pivotally coupled with the pivoting piece of coupler 170, and second portion 308 fixedly coupled, for instance, by a fastener or the like, with the first or second panel of the tabletop. In an exemplary embodiment, first portion 306 and second portion 308 form a generally "L" shape. In some exemplary embodiments, connecting piece 174 is formed with one or more openings or holes or the like to reduce the weight.

Figure 14A:
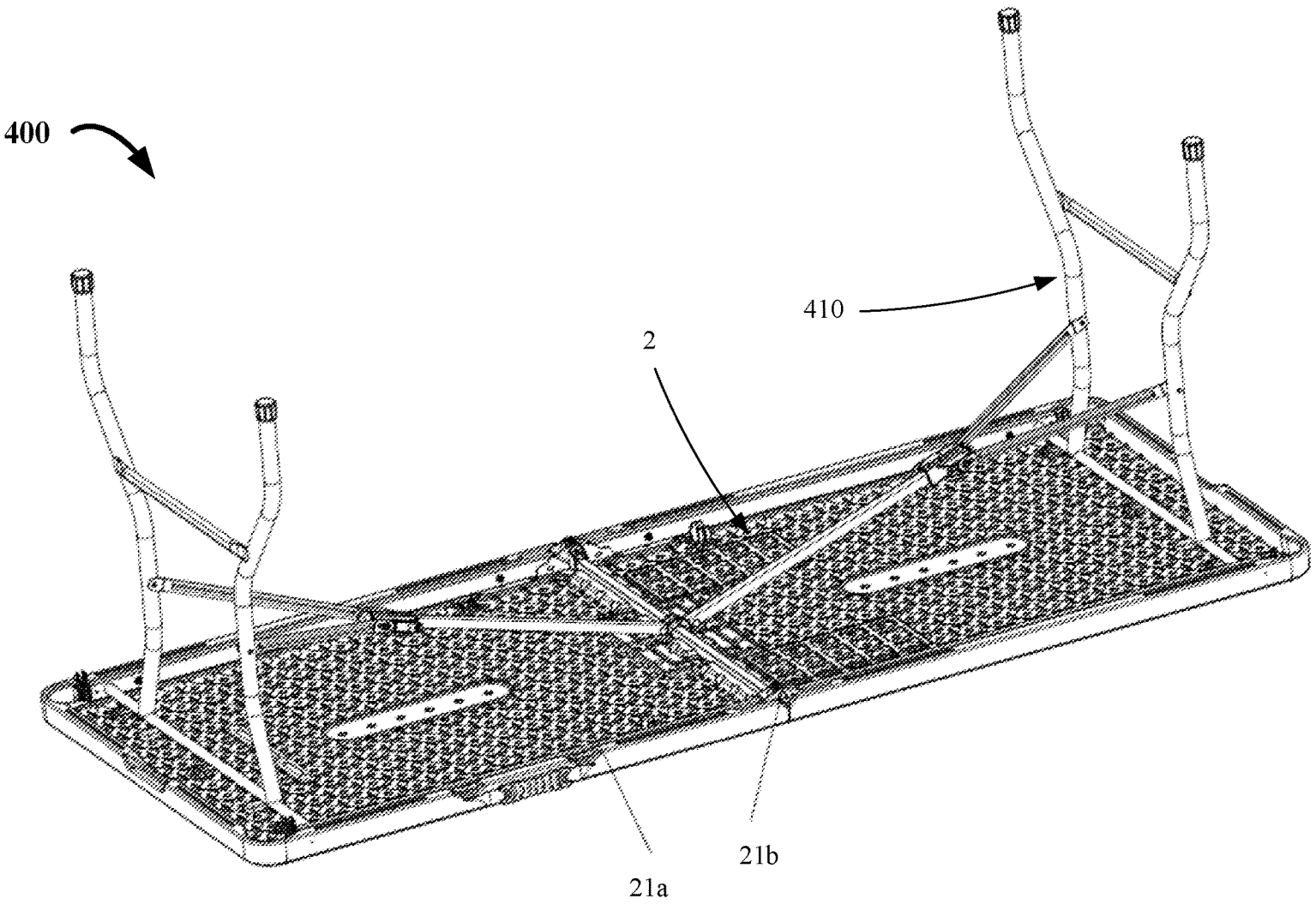
FIG. 14A is a bottom perspective view illustrating an exemplary table in an unfolded state in accordance with exemplary embodiments of the present disclosure.
Figure 14B:
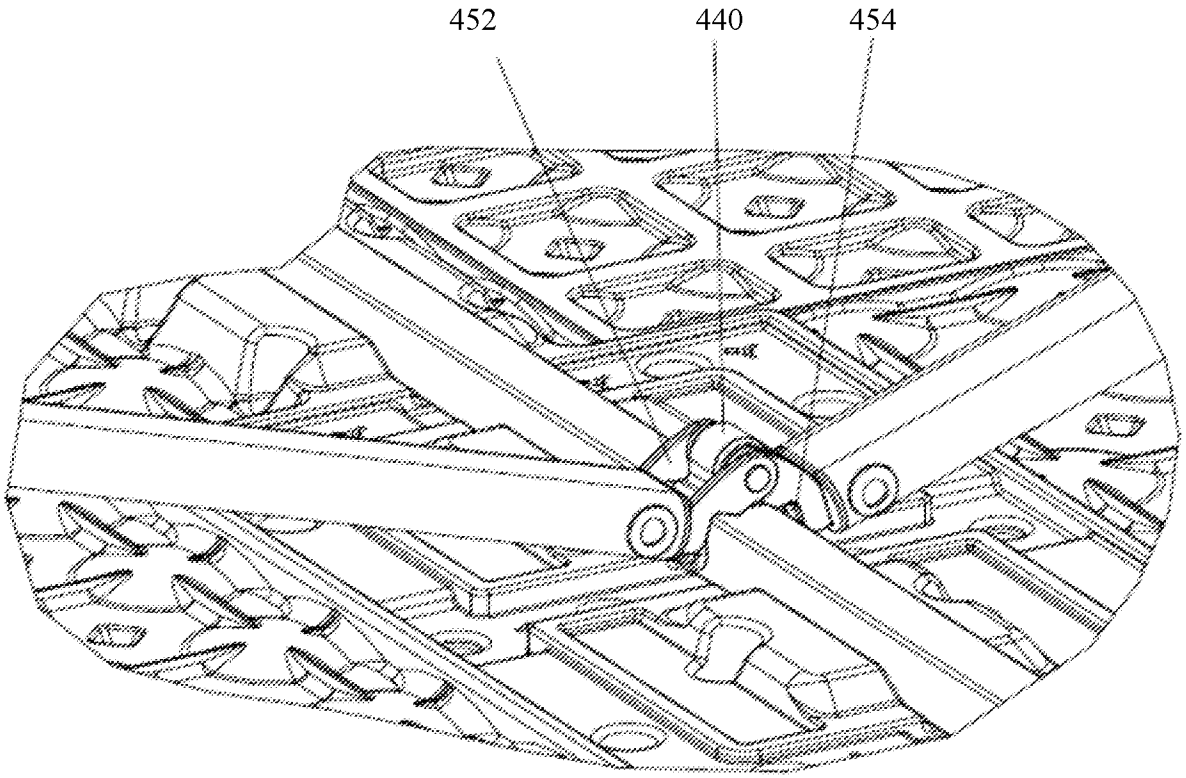
FIG. 14B is an enlarged view illustrating a middle portion of FIG. 14A.

Referring now to FIGS. 14A and 14B, there is depicted an exemplary table in accordance with some embodiments of the present disclosure. As shown, exemplary table 400 includes a tabletop, such as tabletop 2, and a frame, such as frame 410, coupled with the tabletop and supporting the tabletop when in use. As disclosed herein elsewhere, in some exemplary embodiments, tabletop 2 includes first table panel 21*a* and second table panel 21*b*, which can be but do not necessarily have to be identical or symmetric with respect to each other.

Referring to FIGS. 15A-15D, similar to frame 1, frame 210 and/or frame 310 disclosed herein, frame 410 includes a mounting assembly, such as mounting assembly 110. Frame 410 also includes a first leg assembly, such as first leg assembly 420*a*, and a second leg assembly, such as second leg assembly 420*b*. First leg assembly 420*a* and second leg assembly 420*b* can be but do not necessarily have to be identical or symmetric with respect to each other. By way of example, FIGS. 15A-15D illustrate that first leg assembly 420*a* and second leg assembly 420*b* are substantially the same. In some exemplary embodiments, first leg assembly 420*a* is substantially the same as or similar to first leg assembly 120*a* or 220*a*, and second leg assembly 420*b* is substantially the same as or similar to second leg assembly 120*b* or 220*b*. In some exemplary embodiments, first leg assembly 420*a* has an upper end coupled with lateral bar 12*a* and second leg assembly 420*b* has an upper end coupled with lateral bar 12*b*. In addition, each of first leg assembly 420*a* and second leg assembly 420*b* includes two legs and a leg lateral bar, such as leg lateral bar 422, disposed between and connected to the two legs.

In some exemplary embodiments, frame 410 includes a first supporting assembly, such as first supporting assembly 430*a*, and a second supporting assembly, such as second supporting assembly 430*b*. First supporting assembly 430*a* is pivotally coupled with the mounting assembly and first table leg assembly 420*a* to control rotation of first leg assembly 420*a*. Second supporting assembly 430*b* is pivotally coupled with the mounting assembly and second table leg assembly 420*b* to control rotation of second leg assembly 220*b*.

In some exemplary embodiments, first supporting assembly 430*a* and second supporting assembly 430*b* are substantially the same as first supporting assembly 130*a* and second supporting assembly 130*b* disclosed herein, except they are oriented differently. For instance, in some exemplary embodiments, first supporting assembly 430*a* or second supporting assembly 430*b* includes a first supporting member, such as first supporting member 131, at least one second supporting member, such as second supporting member 132, and a sliding mechanism, such as sliding mechanism 140. As a non-limiting example, two second supporting members are illustrated. One end portion of the first supporting member is pivotally coupled with third lateral bar 10, for instance, via coupler 440. One end of the second supporting member is coupled with the first supporting member, for instance, through the sliding mechanism. The other end of the second supporting member is pivotally coupled with a leg of the first or second leg assembly.

Figure 15A:
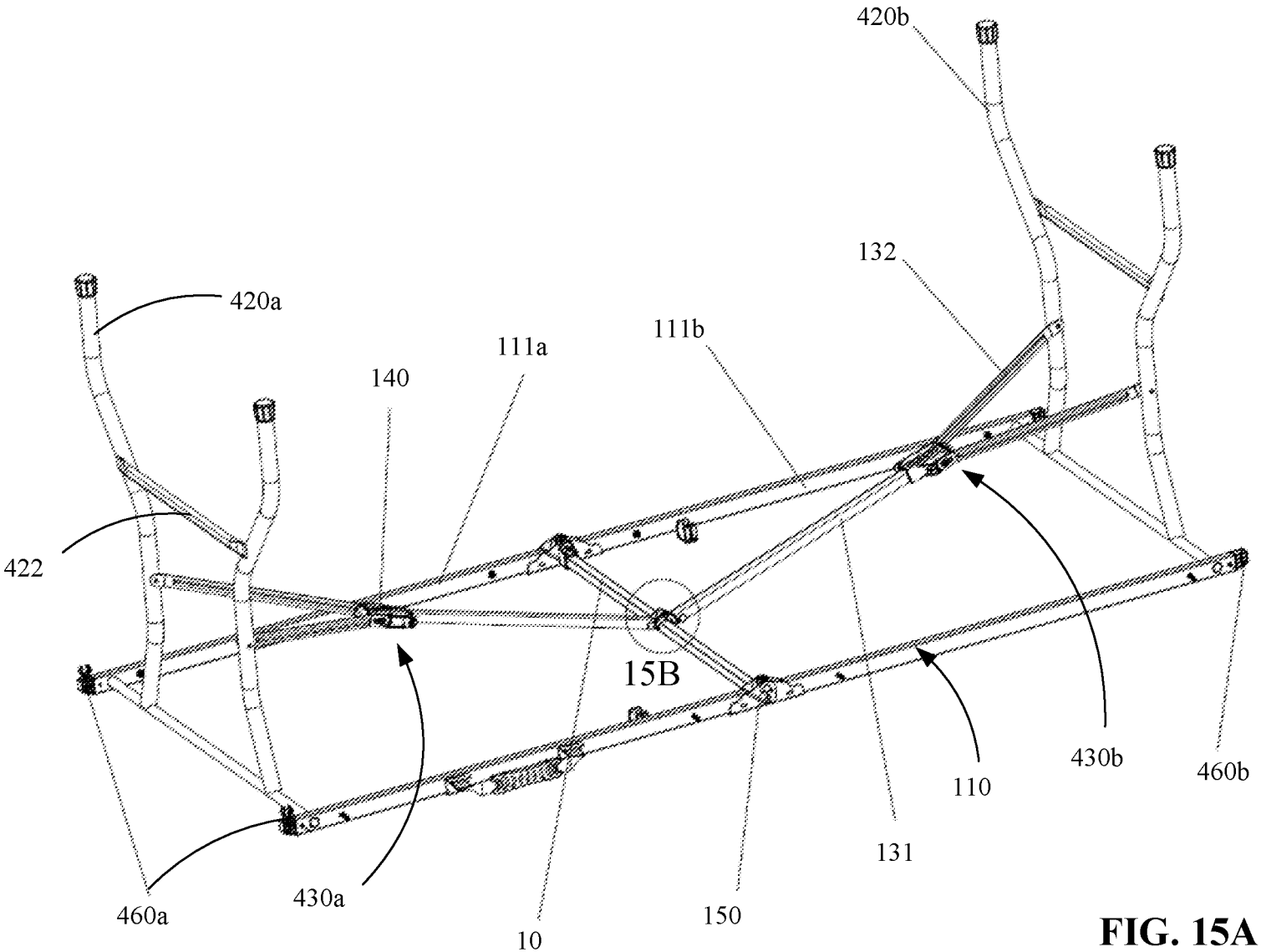
FIG. 15A is a bottom perspective view illustrating an exemplary frame in an unfolded state in accordance with exemplary embodiments of the present disclosure.
Figure 15B:
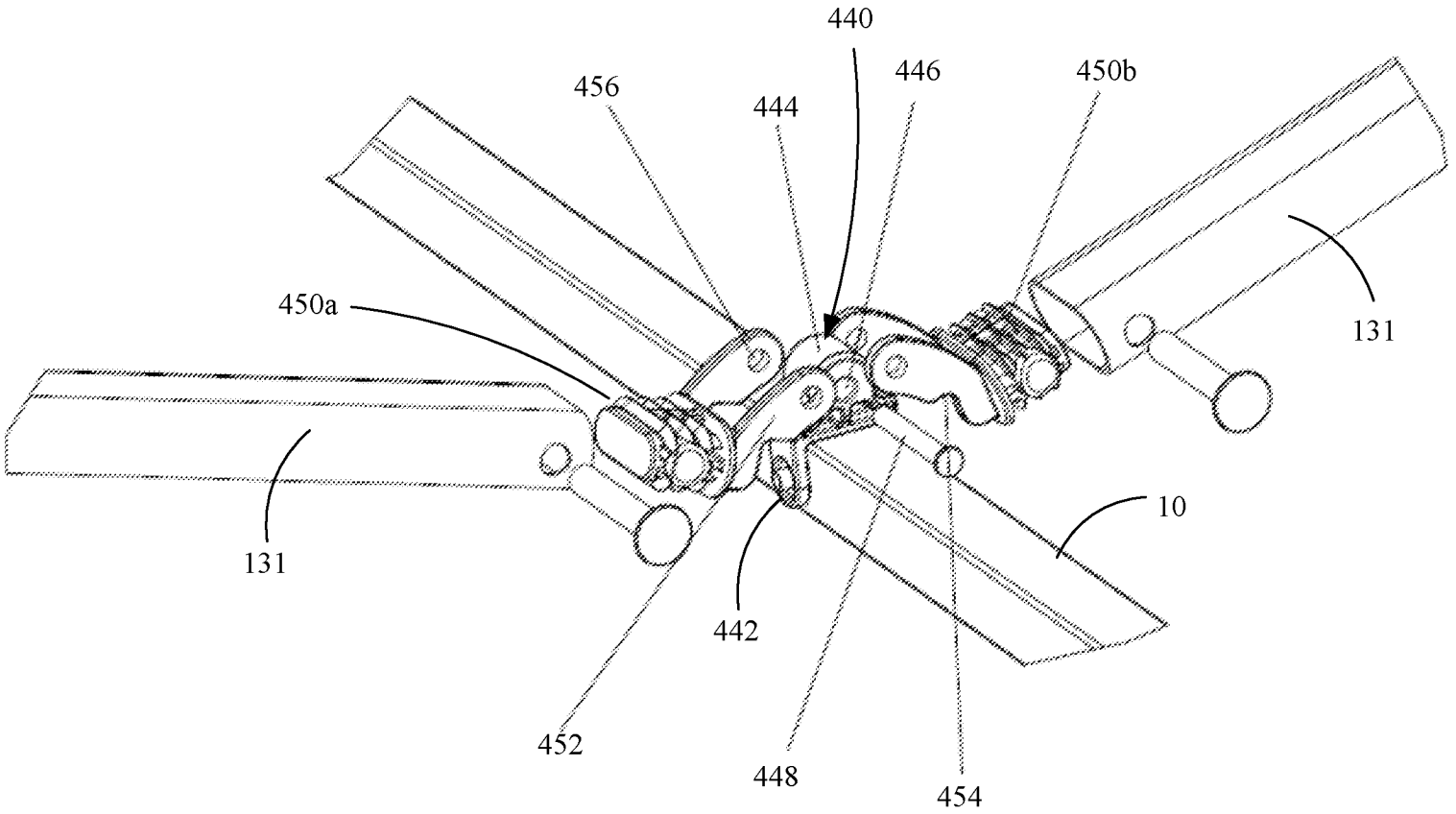
FIG. 15B is an enlarged view taken along circle 15B of FIG. 15A.
Figure 15C:
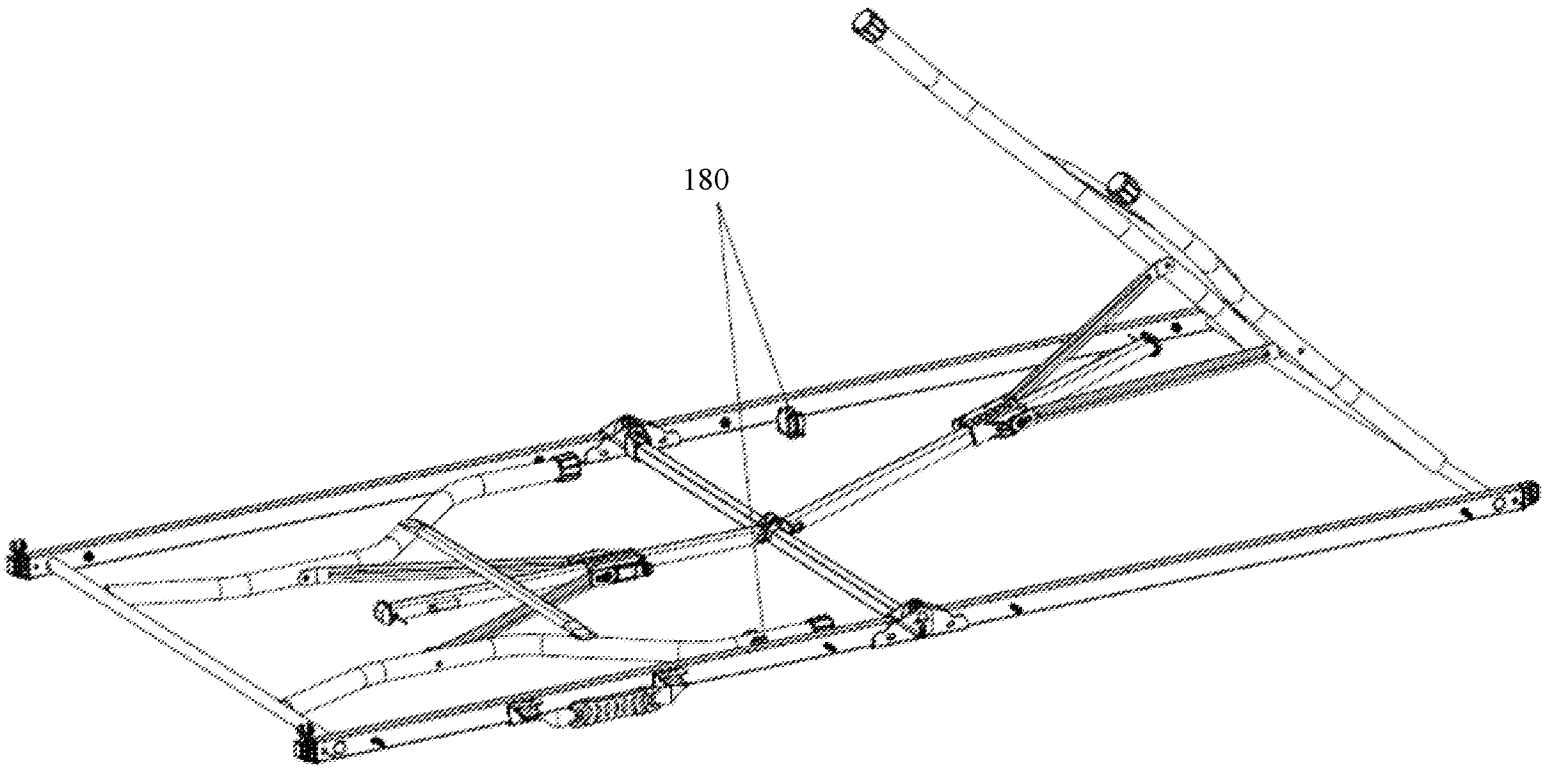
FIG. 15C is a perspective view illustrating the exemplary frame of FIG. 15A in a partially folded state in accordance with exemplary embodiments of the present disclosure.

Referring in particular to FIG. 15B, in some exemplary embodiments, coupler 440 includes a base, such as base 442, and a pivoting piece, such as pivoting piece 444. Base 442 is fixedly coupled with third mounting member 10 and pivoting piece 444 is connected to or formed with the base. In some exemplary embodiments, the pivoting piece has an axis aligned with a pivoting axis along which the first and second bars of the first mounting member and the first and second bars of the second mounting member rotate. For instance, in some exemplary embodiments, the pivoting piece is formed with a through-hole, such as through-hole 446, which has an axis aligned with the pivoting axis along which the first and second bars of the first mounting member and the first and second bars of the second mounting member rotate.

In some exemplary embodiments, the first supporting member of first supporting assembly 430*a* is pivotally coupled with coupler 440 by first connecting member 450*a*, and the first supporting member of second supporting assembly 430*b* is pivotally coupled with coupler 440 by second connecting member 450*b*. First connecting member 450*a* and second connecting member 450*b* can be but do not necessarily have to be identical or symmetric with respect to each other. By way of example, FIG. 15B illustrates that first connecting member 450*a* and second connecting member 450*b* are substantially the same.

First connecting member 450*a* is connected to the end portion of first supporting member 131 of first supporting assembly 430*a*, and pivotally coupled with the pivoting piece of the coupler. Similarly, second connecting member 450*b* is connected to the end portion of first supporting member 131 of second supporting assembly 430*b*, and pivotally coupled with the pivoting piece of the coupler. For instance, in some exemplary embodiments, first connecting member 450*a* or second connecting member 450*b* includes one or more lugs such as lug 452. Lug 452 is formed with a through-hole, such as through-hole 456. First connecting member 450*a* or second connecting member 450*b* is pivotally connected to the pivoting piece of the coupler by a fastener, such as fastener 448, that passes through the through-hole of the one or more lugs and the through-hole of the pivoting piece.

In some exemplary embodiments, each of first connecting member 450*a* and second connecting member 450*b* includes one or more lugs. In an exemplary embodiment, each of first connecting member 450*a* and second connecting member 450*b* includes a pair of lugs. Preferably, the pivoting piece of the coupler is disposed in between the lugs.

In some exemplary embodiments, first connecting member 450*a* or second connecting member 450*b* (e.g., lug 452 of the first or second connecting member) is formed with an indent, such as indent 454, to accommodate, cross-sectional-wise, a portion of third mounting member 10. The indent allows the frame to fold and unfold more smoothly. In addition, the indent allows first connecting member 450*a* or second connecting member 450*b* to abut third mounting member 10 more firmly when the frame is in use, and thus help stabilizing the frame when the frame is in use.

The indent can have a variety of sizes and shapes. Preferably, the indent is configured in accordance with the configuration (e.g., size and shape) of third mounting member 10. For instance, in a non-limiting embodiment, cross-sectional-wise, the third mounting member has a substantially rectangular or square shape, and the indent has a substantially right-angled corner shape. In another non-limiting embodiment, cross-sectional-wise, the third mounting member has a substantially circular shape, and the indent has a substantially rounded corner shape.

Figure 15D:
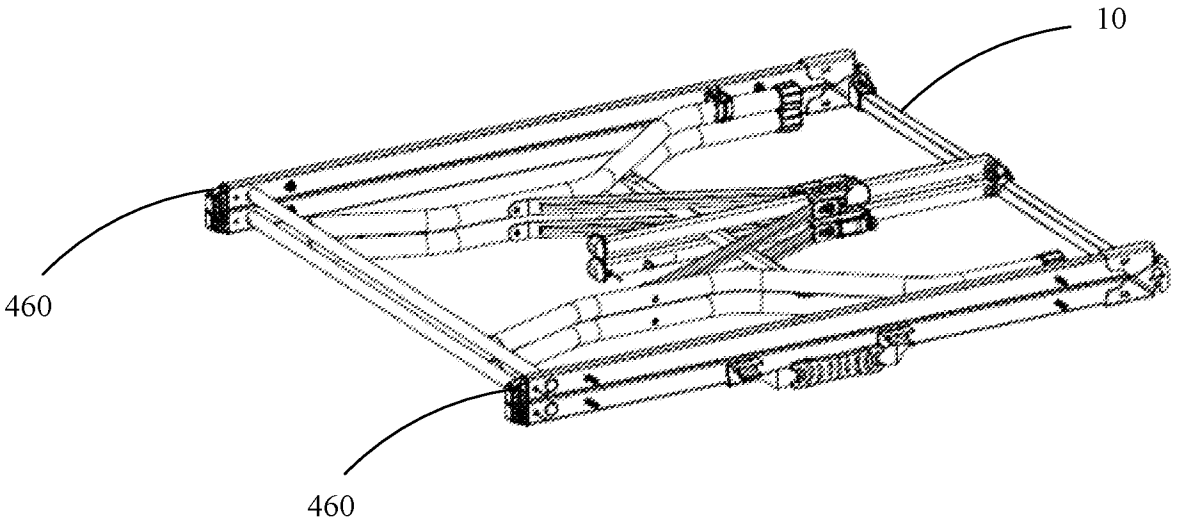
FIG. 15D is a perspective view illustrating the exemplary frame of FIG. 15A in a folded state in accordance with exemplary embodiments of the present disclosure.

Referring in particular to FIGS. 15A and 15D, in some exemplary embodiments, frame 410 includes one or more second retainers, such as retainer 460. Retainer 460 can be substantially the same as or similar to those disclosed in U.S. patent application Ser. No. 17/583,087 filed Jan. 24, 2022, the content of which is incorporated herein for all purposes by reference in its entirety. Generally, retainer 460 includes first engaging member 460*a* and second engaging member 460*b*. One of the first and second engaging members of retainer 460 is disposed at a distal end portion of the first bar of the first or second mounting member, and the other of the first and second engaging members is disposed at a distal end portion of the second bar of the first or second mounting member. When the first and second bars of the first or second mounting member are folded onto each other, the first and second engaging members of retainer 460 engage with each other, and thus retain the frame in a folded position to prevent the folded frame from accidental unfolding. In some exemplary embodiments, the frame includes two second retainers, one having the engaging members disposed at the first and second bars of the first mounting member and the other having the engaging members disposed at the first and second bars of disposed at the second mounting member.

The frames and tables of the present disclosure have several advantages. For instance, the frames and tables can be folded in half by pivoting mechanisms 150, and thus are convenient for use and transportation. The pivoting mechanism, operated by gravity, automatically locks the frame (e.g., first bar 111*a* and second bar 111*b*) when the table is in use, and thus improves the safety and stability of the table. Moreover, the leg assemblies can be folded or unfolded by the control of sliding mechanisms 140, thereby further stabilizing the frames and tables when in use and reducing the sizes of the frames and tables when folded. The sliding mechanism, operated by elastic pieces, automatically locks the leg assembly when it is unfolded, and thus further improves the safety and stability of the table. Further, with coupler 170, coupler 440, and/or coaxial arrangement of the coupler(s) with pivoting mechanism 150, load to the panel(s) is more evenly distributed over the frame, making the frame and table more reliable and last longer. In addition, retainer 180 assists in maintaining the leg assemblies in the folded position and preventing accidental unfolding of the leg assemblies. Retainer 460 retains the frame in the folded position and prevents accidental unfolding of the frame and table. The frames and tables of the present disclosure are easy and safe to use.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "top" or "bottom", "lower" or "upper", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first bar could be termed a second bar, and, similarly, a second bar could be termed a first bar, without changing the meaning of the description, so long as all occurrences of the "first bar" are renamed consistently and all occurrences of the "second bar" are renamed consistently.

What is claimed is:

1. A frame comprising:

a mounting assembly comprising a first mounting member, a second mounting member and a third mounting member, wherein each of the first and second mounting members comprises a first bar and a second bar;

proximal end portions of the first and second bars of the first mounting member are connected to or formed with each other;

proximal end portions of the first and second bars of the second mounting member are connected to or formed with each other; and the third mounting member having an end portion coupled with the proximal end portions of the first bars of the first and second mounting members and another end portion coupled with the proximal end portions of the second bars of the first and second mounting members;

a first leg assembly and a second leg assembly, wherein the first leg assembly is coupled with distal end portions of the first bars of the first and second mounting members and rotatable with respect to the first bars, and the second leg assembly is coupled with distal end portions of the second bars of the first and second mounting members and rotatable with respect to the second bars;

a first supporting assembly and a second supporting assembly configured to control rotation of the first and second leg assemblies, wherein each of the first and second assemblies comprises:

a first supporting member having an end portion pivotally coupled with the third mounting member;

a slider coupled with the first supporting member and selectively movable along the first supporting member; and one or more second supporting members, each having an end portion coupled with the slider and another end portion pivotally coupled with the first or second leg assembly;

a coupler comprising a base fixedly coupled with the third mounting member and a pivoting piece connected to or formed with the base;

a first connecting member formed or coupled with the end portion of the first supporting member of the first supporting assembly and pivotally coupled with the pivoting piece of the coupler and rotatable with respect to the base of coupler; and a second connecting member formed or coupled with the end portion of the first supporting member of the second supporting assembly and pivotally coupled with the pivoting piece of the coupler and rotatable with respect to the base of coupler.

2. The frame of claim 1, wherein each of the first and second connecting members comprises an indent to accommodate, cross-sectional-wise, a portion of the third mounting member, thereby facilitating smooth folding and unfolding of the frame and abutting the third mounting member to help stabilizing the frame when the frame is in use.

3. The frame of claim 2, wherein cross-sectional-wise, the third mounting member has a substantially rectangular or square shape, and the indent has a substantially right-angled corner shape.

4. The frame of claim 2, wherein cross-sectional-wise, the third mounting member has a substantially circular shape, and the indent has a substantially rounded corner shape.

5. The frame of claim 1, wherein:

the first and second bars of the first mounting member are pivotally coupled with each other, and the first and second bars of the second mounting member are pivotally coupled with each other; and the pivoting piece of the coupler has an axis aligned with a pivoting axis along which the first and second bars of the first mounting member and the first and second bars of the second mounting member rotate.

6. The frame of claim 1, wherein:

the first and second bars of the first mounting member are pivotally coupled with each other, and the first and second bars of the second mounting member are pivotally coupled with each other;

the pivoting piece of the coupler is formed with a through-hole aligned with a pivoting axis along which the first and second bars of the first mounting member and the first and second bars of the second mounting member rotate; and each of the first and second connecting members comprises one or more lugs, each lug formed with a through-hole, wherein each of the first and second connecting members is pivotally connected to the pivoting piece of the coupler by a fastener passing through the through-hole of the one or more lugs and the through-hole of the pivoting piece.

7. The frame of claim 6, wherein each of the first and second connecting members comprises a pair of lugs.

8. The frame of claim 6, wherein for each of the first and second connecting members, each of the one or more lugs is formed with an indent to accommodate, cross-sectional-wise, a portion of the third mounting member, thereby facilitating smooth folding and unfolding of the frame and abutting the third mounting member to help stabilizing the frame when the frame is in use.

9. The frame of claim 1, wherein:

the first or second leg assembly comprises a first leg and a second leg; and the one or more second supporting members of the first or second supporting assembly comprise two second supporting members, one connected to the first let and another connected to the second leg.

10. The frame of claim 1, further comprising:

a plurality of first retainers, each disposed at or adjacent to an interior side of the first or second bar of the first or second mounting member and configured to retain the first or second leg assembly when the first or second leg assembly is folded to retain the first or second leg assembly.

11. The frame of claim 1, wherein the first and second bars of the first mounting member are pivotally coupled with each other, and the first and second bars of the second mounting member are pivotally coupled with each other, the frame further comprising:

one or more second retainers, each comprising a first engaging member and a second engaging member, wherein:

the first engaging member is disposed at a distal end portion of the first bar of the first or second mounting member;

the second engaging member is disposed at a distal end portion of the second bar of the first or second mounting member; and when the first and second bars of the first or second mounting member are folded onto each other, the first and second engaging members engage with each other, thereby retaining the frame in a folded position to prevent the folded frame from accidental unfolding.

12. The frame of claim 11, wherein the one or more second retainers comprise two second retainers, one disposed at the first mounting member and the other disposed at the second mounting member.

13. A table comprising:

the frame of claim 1;

a first panel coupled with the first bars of the first and second mounting members; and a second panel coupled with the second bars of the first and second mounting members.

14. A frame comprising:

a mounting assembly comprising a first mounting member, a second mounting member and a third mounting member, wherein each of the first and second mounting members comprises a first bar and a second bar;

proximal end portions of the first and second bars of the first mounting member are connected to or formed with each other;

proximal end portions of the first and second bars of the second mounting member are connected to or formed with each other; and the third mounting member having an end portion coupled with the proximal end portions of the first bars of the first and second mounting members and another end portion coupled with the proximal end portions of the second bars of the first and second mounting members;

a first leg assembly and a second leg assembly, wherein the first leg assembly is coupled with distal end portions of the first bars of the first and second mounting members and rotatable with respect to the first bars, and the second leg assembly is coupled with distal end portions of the second bars of the first and second mounting members and rotatable with respect to the second bars; and a first supporting assembly and a second supporting assembly configured to control rotation of the first and second leg assemblies, wherein each of the first and second assemblies comprises:

a first supporting member having an end portion pivotally coupled with the third mounting member;

a slider coupled with the first supporting member and selectively movable along the first supporting member; and one or more second supporting members, each having an end portion coupled with the slider and another end portion pivotally coupled with the first or second leg assembly;

wherein the proximal end portions of the first and second bars of the first mounting member are pivotally coupled with each other by a first pivoting mechanism and the proximal end portions of the first and second bars of the second mounting member are pivotally coupled with each other by a second pivoting mechanism, wherein the first or second pivoting mechanism comprises:

a first coupling piece fixed at the proximal end of the first bar of the first or second mounting member and comprising a first slot elongated in a first direction;

a second coupling piece fixed at the proximal end of the second bar of the first or second mounting member and comprising a second slot, wherein the second slot has a closed bottom and an open top, and wherein the second slot has a length in the first direction that is shorter than the first slot of the first coupling piece in the first direction;

a third coupling piece comprising a third slot having a closed bottom and a closed top, wherein the third slot is elongated in the first direction;

a first rod disposed, cross-sectional-wise, in the third slot of the third coupling piece and movable along the third slot of the third coupling piece, wherein the first and second coupling pieces are pivotally coupled with each other by the first rod; and a second rod integrally formed or coupled with a top portion of the third coupling piece, wherein the second rod is disposed, cross-sectional-wise, in the first slot of the first coupling piece and movable along the first slot of the first coupling piece;

wherein when the first and second coupling pieces are aligned with each other and the open top of the second slot of the second coupling piece faces downwardly, the third coupling piece together with the second rod moves by gravity to a first position where the second rod is disposed outside of the second slot of the second coupling piece, thereby allowing the first and second coupling pieces to rotate with respect to each other around the first rod; and wherein when the first and second coupling pieces are aligned with each other and the open top of the second slot of the second coupling piece faces upwardly, the third coupling piece together with the second rod moves by gravity to a second position where the second rod is disposed in the second slot of the second coupling piece, thereby restricting the first and second coupling pieces from rotating with respect to each other around the first rod.

15. A frame comprising:

a mounting assembly comprising a first mounting member, a second mounting member and a third mounting member, wherein each of the first and second mounting members comprises a first bar and a second bar;

proximal end portions of the first and second bars of the first mounting member are pivotally connected to each other;

proximal end portions of the first and second bars of the second mounting member are pivotally connected to each other; and the third mounting member having an end portion coupled with the proximal end portions of the first bars of the first and second mounting members and another end portion coupled with the proximal end portions of the second bars of the first and second mounting members;

a first leg assembly coupled with the mounting assembly and rotatable with respect to the first bars of the first and second mounting members;

a second leg assembly coupled with the mounting assembly and rotatable with respect to the second bars of the first and second mounting members;

a coupler comprising a base fixedly coupled with the third mounting member and a pivoting piece connected to or formed with the base, wherein the pivoting piece has an axis aligned with a pivoting axis along which the first and second bars of the first mounting member and the first and second bars of the second mounting member rotate;

a first connecting member and a second connecting member, each pivotally connected to the pivoting piece of the coupler and rotatable with respect to the base of coupler;

a first supporting assembly connected to the first connecting member and the first leg assembly to control rotation of the first leg assembly with respect to the first bars of the first and second mounting members; and a second supporting assembly connected to the second connecting member and the second leg assembly to control rotation of the second leg assembly with respect to the second bars of the first and second mounting members.

16. The frame of claim 15, further comprising:

a plurality of first retainers, each disposed at or adjacent to an interior side of the first or second bar of the first or second mounting member and configured to retain the first or second leg assembly when the first or second leg assembly is folded to retain the first or second leg assembly.

17. The frame of claim 15, further comprising:

one or more second retainers, each comprising a first engaging member and a second engaging member, wherein:

the first engaging member is disposed at a distal end portion of the first bar of the first or second mounting member;

the second engaging member is disposed at a distal end portion of the second bar of the first or second mounting member; and when the first and second bars of the first or second mounting member are folded onto each other, the first and second engaging members engage with each other, thereby retaining the frame in a folded position to prevent the folded frame from accidental unfolding.

18. A table comprising:

the frame of claim 15;

a first panel coupled with the first bars of the first and second mounting members; and a second panel coupled with the second bars of the first and second mounting members.

19. A frame comprising:

a mounting assembly comprising a first mounting member, a second mounting member and a third mounting member, wherein each of the first and second mounting members comprises a first bar and a second bar;

proximal end portions of the first and second bars of the first mounting member are pivotally connected to each other;

proximal end portions of the first and second bars of the second mounting member are pivotally connected to each other; and the third mounting member having an end portion coupled with the proximal end portions of the first bars of the first and second mounting members and another end portion coupled with the proximal end portions of the second bars of the first and second mounting members;

a first leg assembly coupled with the mounting assembly and rotatable with respect to the first bars of the first and second mounting members;

a second leg assembly coupled with the mounting assembly and rotatable with respect to the second bars of the first and second mounting members;

a coupler comprising a base fixedly coupled with the third mounting member and a pivoting piece connected to or formed with the base, wherein the pivoting piece has an axis aligned with a pivoting axis along which the first and second bars of the first mounting member and the first and second bars of the second mounting member rotate;

a first connecting member and a second connecting member, each pivotally connected to the pivoting piece of the coupler;

a first supporting assembly connected to the first connecting member and the first leg assembly to control rotation of the first leg assembly with respect to the first bars of the first and second mounting members; and a second supporting assembly connected to the second connecting member and the second leg assembly to control rotation of the second leg assembly with respect to the second bars of the first and second mounting members;

wherein:

the pivoting piece of the coupler is formed with a through-hole; and each of the first and second connecting members comprises one or more lugs, each lug formed with a through-hole, wherein each of the first and second connecting members is pivotally connected to the pivoting piece of the coupler by a fastener passing through the through-hole of the one or more lugs and the through-hole of the pivoting piece.

* * * * *